US012637859B2

(12) United States Patent
Hoag et al.

(10) Patent No.: US 12,637,859 B2
(45) Date of Patent: May 26, 2026

(54) LIGHT TRANSMITTING BUILDING BLOCKS

(71) Applicants: Bowling Green State University, Bowling Green, OH (US); Regents of the University of Michigan, Ann Arbor, MI (US)

(72) Inventors: Allison Hoag, Bowling Green, OH (US); Cathlyn Newell, Ann Arbor, MI (US)

(73) Assignees: Bowling Green State University, Bowling Green, OH (US); Regents of the University of Michigan, Ann Arbor, MI (US)

( * ) Notice: Subject to any disclaimer, the term of this patent is extended or adjusted under 35 U.S.C. 154(b) by 256 days.

(21) Appl. No.: 18/128,392

(22) Filed: Mar. 30, 2023

(65) Prior Publication Data

US 2023/0313529 A1 Oct. 5, 2023

Related U.S. Application Data

(60) Provisional application No. 63/325,345, filed on Mar. 30, 2022.

(51) Int. Cl.
*E04C 1/42* (2006.01)
*E04C 1/40* (2006.01)

(52) U.S. Cl.
CPC . *E04C 1/42* (2013.01); *E04C 1/40* (2013.01)

(58) Field of Classification Search
CPC ..... E04C 1/42; E04C 1/40; E02D 17/205
See application file for complete search history.

(56) References Cited

U.S. PATENT DOCUMENTS 614,524 A * 11/1898 Yardley ..... A63F 9/0415 273/146
1,855,987 A * 4/1932 Rammer ..... E04B 2/04 D25/113
2,167,764 A * 8/1939 Lytle ..... E04C 1/42 65/47
2,306,939 A * 12/1942 Ferris ..... A63F 9/0613 250/461.1
4,651,486 A * 3/1987 Erickson ..... E04C 1/42 428/34.4
5,033,245 A * 7/1991 Kline ..... E04C 1/42 52/308

(Continued)

FOREIGN PATENT DOCUMENTS

DE 10306529 A1 * 6/2004 ..... E04C 1/42
DE 202005004988 U1 * 5/2005 ..... A63F 9/1204

(Continued)

OTHER PUBLICATIONS

Oikonomopoulou et al., "Innovative structural applications of adhesively bonded solid glass blocks," GPD Glass Performance Days 2015, Glass Bonding and Point Fixing, pp. 256-261.

*Primary Examiner* — Theodore V Adamos
(74) *Attorney, Agent, or Firm* — MacMillan, Sobanski & Todd, LLC

(57) ABSTRACT

Building blocks, wall structures made therefrom, building systems made therefrom, structures made therefrom, and methods of constructing a structure therewith, are described.

28 Claims, 73 Drawing Sheets
(57 of 73 Drawing Sheet(s) Filed in Color)

(56) References Cited

U.S. PATENT DOCUMENTS

| | | | | | |
|---|---|---|---|---|---|
| 5,067,295 | A * | 11/1991 | Francik | E04C 1/42 | 52/308 |
| 5,294,216 | A * | 3/1994 | Sievert | E04C 1/395 | 405/262 |
| 5,655,345 | A * | 8/1997 | Thompson | E04C 1/42 | 52/249 |
| 5,918,881 | A * | 7/1999 | Kirby | A63F 9/0415 | 273/146 |
| 2005/0014112 | A1* | 1/2005 | Fentress | G09B 23/02 | 434/211 |
| 2009/0007510 | A1* | 1/2009 | McCoy | E04C 1/42 | 52/306 |

FOREIGN PATENT DOCUMENTS

| | | | | | |
|---|---|---|---|---|---|
| DE | 102005024556 | A1 * | 12/2006 | E04C 1/42 | |
| GB | 2360799 | A * | 10/2001 | E04C 1/42 | |
| GB | 2443679 | A * | 5/2008 | E04C 1/42 | |

* cited by examiner

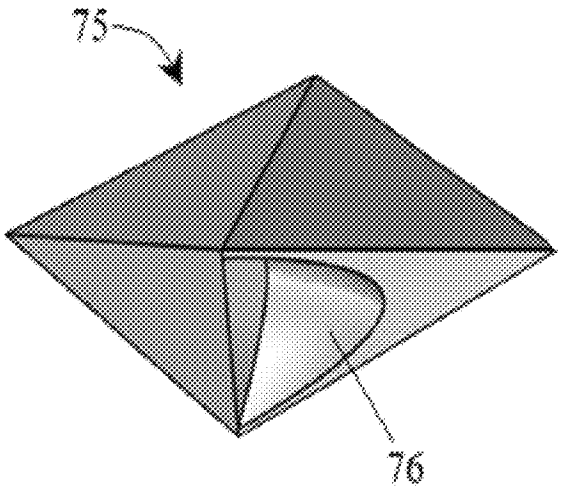
FIG. 6A
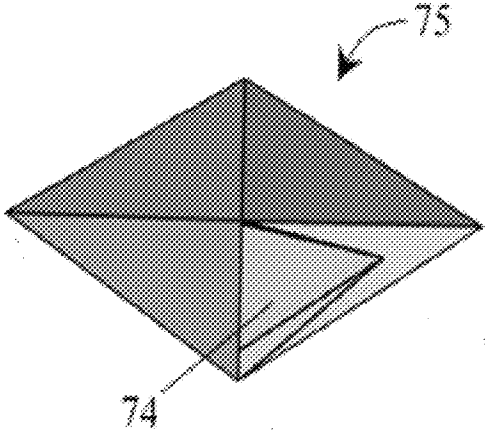
FIG. 6F
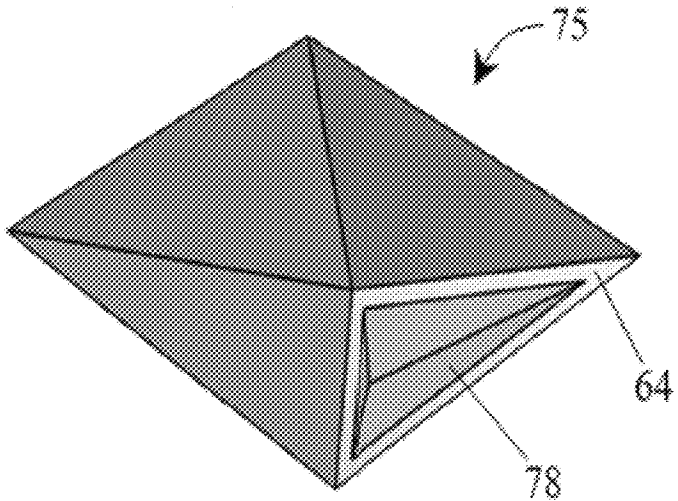
FIG. 6G
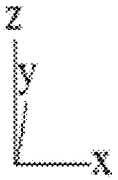

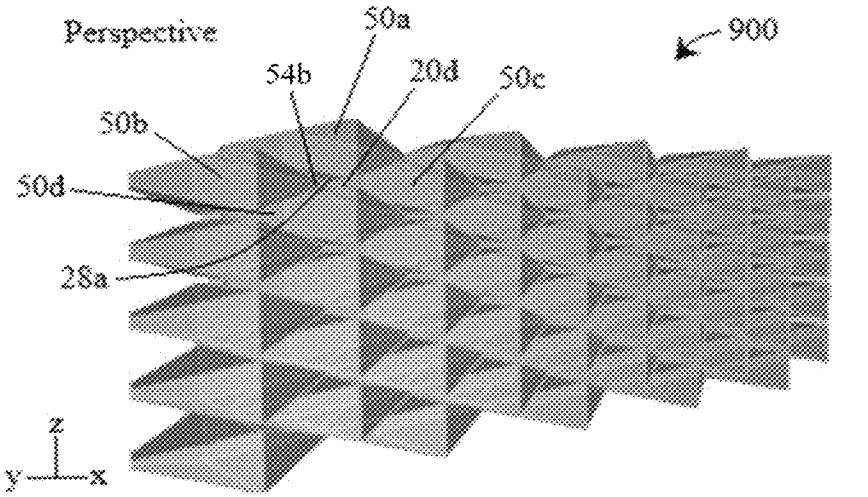
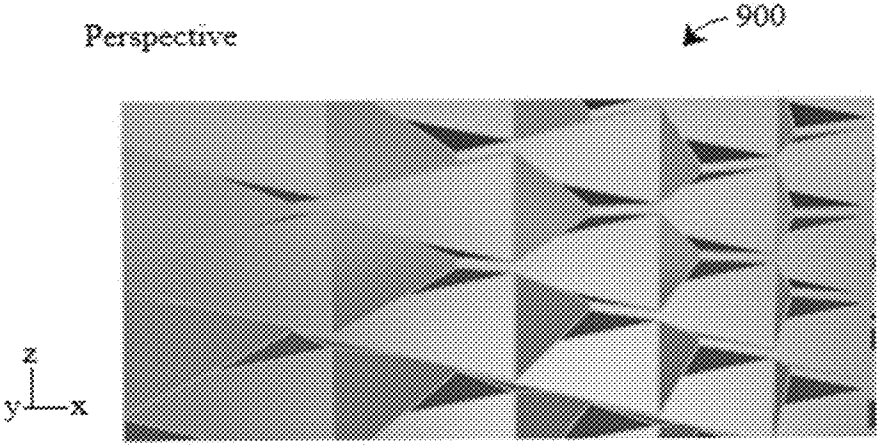
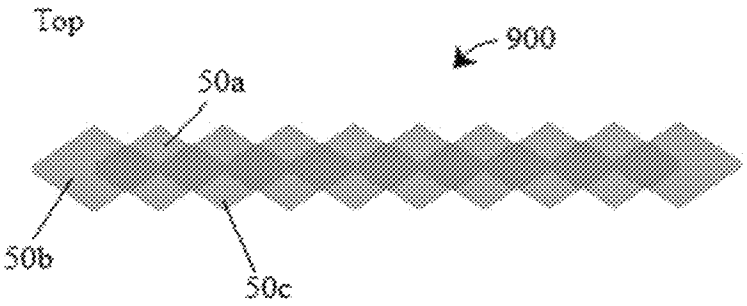
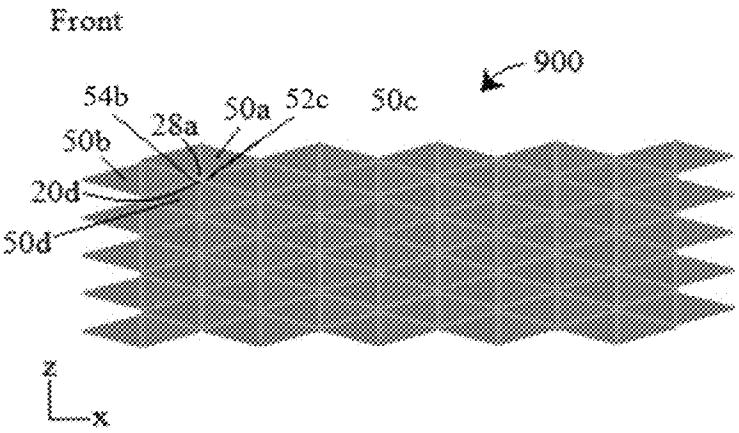
FIG. 19

LUX TRANSMISSION OF BUILDING BLOCKS IN VARIOUS AGGREGATION PATTERNS AND SIMILAR MATERIALS

| | | Lux Transmitted through glass ⊥ to Aggregation | Lux Transmitted through glass ⊥ to Aggregation | Lux Transmitted through glass ⊥ to Aggregation | Lux Transmitted through glass ⊥ to Aggregation | Lux Transmitted through glass ⊥ to Aggregation |
|---|---|---|---|---|---|---|
| Aggregation Components | Modular Aggregation Pattern | 5cm | 1cm | 10cm | 20cm | 30cm |
| Empty Screen | Middle Face | 140.7 | 103.7 | 76.8 | 45.0 | 30.2 |
| 5 Solid Clear Building Block | Middle Face | 140.4 | 77.3 | 36.4 | 22.5 | 11.6 |
| 3 Clear 5 Sided Elongated Void Building Block Thin Face | Middle Face | 52.2 | 43 | 22.1 | 10.6 | 6.2 |
| 3 Clear 5 Sided Elongated Void Building Block Thick Face | Middle Face | 124 | 46.5 | 22.3 | 10.5 | 5 |
| Solid Dream Color Glue Joint | Middle Face | 61.1 | 34.8 | 15.7 | 6.3 | 3.4 |
| Dream Glue-6 sided-Thick Face | Middle Face | 77.6 | 38.6 | 14.1 | 7.9 | 4.3 |
| Dream Glue-6 sided-Thin Face | Middle Face | 34.3 | 30.7 | 14.6 | 7.6 | 4.4 |
| Float Glass | Middle Face | 123.7 | 96.5 | 69.4 | 43.9 | 30.6 |
| Bullseye Cast Glass Ingot-Clear | Middle Face | 121.9 | 88.5 | 56.1 | 42.4 | 28.9 |
| Bullseye Cast Glass Ingot-Grey Blue Tint | Middle Face | 65.7 | 36.6 | 30 | 18.5 | 13.9 |

| | | Lux Transmitted through glass ⊥ to Face | Lux Transmitted through glass Normal to Face | Lux Transmitted through glass Normal to Aggregation | Lux Transmitted through glass Normal to Face | Lux Transmitted through glass Normal to Face | Lux Transmitted through glass Normal to Face |
|---|---|---|---|---|---|---|---|
| Aggregation Components | Modular Aggregation Pattern | 5cm | 1cm | 5cm | 10cm | 20cm | 30cm |
| Empty Screen | Middle Face | 146.7 | 123.3 | 90.2 | 61 | 39.4 | 26.2 |
| 5 Solid Clear Building Block | Middle Face | 114.2 | 60.3 | 36.8 | 26 | 15.1 | 8.6 |
| 3 Clear 5 Sided Elongated Void Building Block Thin Face | Middle Face | 59 | 26.8 | 20.6 | 18.7 | 8.2 | 4.5 |
| 3 Clear 5 Sided Elongated Void Building Block Thick Face | Middle Face | 71.9 | 60.5 | 28.9 | 15.3 | 8.4 | 3.3 |
| Solid Dream Color Glue Joint | Middle Face | 21.8 | 21.7 | 19.1 | 9 | 6.5 | 2.9 |
| Dream Glue-6 sided-Thick Face | Middle Face | 56.6 | 34.6 | 20.6 | 13.4 | 8.2 | 3.1 |
| Dream Glue-6 sided-Thin Face | Middle Face | 36.8 | 30.5 | 17 | 12.2 | 6.2 | 3.4 |
| Float Glass | Middle Face | 141 | 127.7 | 97.3 | 67.4 | 31.6 | 18.4 |
| Bullseye Cast Glass Ingot-Clear | Middle Face | 136.7 | 122.6 | 82.6 | 63 | 27.9 | 17 |
| Bullseye Cast Glass Ingot-Grey Blue Tint | Middle Face | 63 | 57 | 37.8 | 34.5 | 13.6 | 7.9 |

FIG. 28A

LUX TRANSMISSION OF BUILDING BLOCKS IN VARIOUS AGGREGATION PATTERNS AND SIMILAR MATERIALS

| | | Lux Transmitted through glass L to Aggregation | Lux Transmitted through glass L to Aggregation | Lux Transmitted through glass L to Aggregation | Lux Transmitted through glass L to Aggregation | Lux Transmitted through glass L to Aggregation |
|---|---|---|---|---|---|---|
| Aggregation Components | Modular Aggregation Pattern | 5cm | 5cm | 10cm | 20cm | 30cm |
| Empty Screen | Bowed | 267.2 | 243.6 | 201.1 | 127.3 | 91 |
| 1 Solid Clear Building Block | Bowed | 204 | 196.3 | 144.4 | 92.9 | 90.9 |
| 3 Clear 5 Sided Elongated Void Building Block Thin Face | Bowed | 176.1 | 148.1 | 114.8 | 77.7 | 67 |
| 3 Clear 5 Sided Elongated Void Building Block Thick Face | Bowed | 161 | 117.3 | 103.3 | 78 | 69.4 |
| Solid Dream Color Glue Joint | Bowed | 177.7 | 139.1 | 125.8 | 95.6 | 56.8 |
| Dream Glue-5 sided Thick Face | Bowed | 159.3 | 117.0 | 102.2 | 75.9 | 56.8 |
| Dream Glue-5 sided Thin Face | Bowed | 172.2 | 122.8 | 108.9 | 90.3 | 59.2 |
| Float Glass | Bowed | 203.5 | 209.9 | 171.6 | 114.9 | 62.9 |
| Bullseye Cast Glass Ingot-Clear | Bowed | 187.9 | 207.6 | 160.9 | 119.5 | 63 |
| Bullseye Cast Glass Ingot- Grey Blue Tint | Bowed | 117.1 | 105.6 | 90.1 | 64.9 | 36.3 |

| | | Lux Transmitted through glass P to Face | Lux Transmitted through glass Normal to Face | Lux Transmitted through glass Normal to Aggregation | Lux Transmitted through glass Normal to Face | Lux Transmitted through glass Normal to Face | Lux Transmitted through glass Normal to Face |
|---|---|---|---|---|---|---|---|
| Aggregation Components | Modular Aggregation Pattern | 5cm | 5cm | 5cm | 20cm | 20cm | 30cm |
| Empty Screen | Bowed | 243.7 | 273.9 | 220.6 | 161.8 | 119.5 | 69.2 |
| 1 Solid Clear Building Block | Bowed | 151.7 | 147.4 | 116.9 | 108 | 109.7 | 91.6 |
| 3 Clear 5 Sided Elongated Void Building Block Thin Face | Bowed | 192.3 | 168.5 | 118.4 | 126.7 | 86 | 69.8 |
| 3 Clear 5 Sided Elongated Void Building Block Thick Face | Bowed | 204.5 | 198.7 | 121.5 | 114.2 | 65 | 49.5 |
| Solid Dream Color Glue Joint | Bowed | 187.4 | 136.4 | 96.5 | 114.2 | 82.7 | 46 |
| Dream Glue-5 sided Thick Face | Bowed | 192.4 | 180.3 | 104.5 | 118.2 | 100.9 | 62 |
| Dream Glue-5 sided Thin Face | Bowed | 193.7 | 141.9 | 109.3 | 121.3 | 109 | 52.9 |
| Float Glass | Bowed | 219.2 | 212.7 | 187.9 | 183.9 | 104.8 | 92.8 |
| Bullseye Cast Glass Ingot-Clear | Bowed | 222.7 | 214.5 | 188.7 | 180.2 | 109.5 | 89 |
| Bullseye Cast Glass Ingot- Grey Blue Tint | Bowed | 96.9 | 94.4 | 91.6 | 79.3 | 51.8 | 38.2 |

FIG. 28B

LUX TRANSMISSION OF BLUCONS BLOCKS IN VARIOUS AGGREGATION PATTERNS AND SIMILAR MATERIALS

| | | % Lux Transmitted | % Lux Transmitted | % Lux Transmitted | % Lux Transmitted | % Lux Transmitted |
|---|---|---|---|---|---|---|
| Aggregation Components | Modular Aggregation Pattern | 0cm | 5cm | 10cm | 20cm | 30cm |
| Empty Screen | Middle Face | 100% | 72.00% | 54.00% | 28.00% | 14.70% |
| 3 Solid Clear Building Block | Middle Face | 68.70% | 24.30% | 27.70% | 14.40% | 5.20% |
| 3 Clear 5 Sided Elongated Void Building Block Thin Face | Middle Face | 36% | 20.20% | 15.80% | 7.90% | 4.80% |
| 3 Clear 5 Sided Elongated Void Building Block Thick Face | Middle Face | 37.20% | 24.10% | 15.90% | 7.30% | 4.20% |
| Solid Dream Color Glue Joint | Middle Face | 32.90% | 24.60% | 11.00% | 4.80% | 1.30% |
| Dream Glue-5 sided-Thick Face | Middle Face | 24.30% | 20.20% | 9.60% | 5.20% | 1.00% |
| Dream Glue-5 sided-Thin Face | Middle Face | 24.10% | 21.50% | 10.40% | 5.20% | 1.00% |
| Float Glass | Middle Face | 86.90% | 60.20% | 46.90% | 35.60% | 11.70% |
| Bullseye Cast Glass Ingot-Clear | Middle Face | 85.70% | 60.20% | 45.70% | 29.50% | 11.50% |
| Bullseye Cast Glass Ingot-Grey Blue Tint | Middle Face | 36.80% | 27.60% | 21.00% | 11.70% | 2.70% |

| | | % Lux Transmitted | % Lux Transmitted | % Lux Transmitted | % Lux Transmitted | % Lux Transmitted | % Lux Transmitted |
|---|---|---|---|---|---|---|---|
| Aggregation Components | Modular Aggregation Pattern | 0cm | 5cm | 10cm | 20cm | 30cm | 50cm |
| Empty Screen | Middle Face | 100% | 91.10% | 83.00% | 41.70% | 20.80% | 10.80% |
| 3 Solid Clear Building Block | Middle Face | 76.11% | 60.13% | 38.81% | 19.15% | 10.38% | 5.86% |
| 3 Clear 5 Sided Elongated Void Building Block Thin Face | Middle Face | 48.68% | 40.84% | 20.38% | 12.79% | 6.23% | 3.08% |
| 3 Clear 5 Sided Elongated Void Building Block Thick Face | Middle Face | 49.83% | 42.81% | 19.70% | 13.20% | 5.70% | 2.67% |
| Solid Dream Color Glue Joint | Middle Face | 45.38% | 14.84% | 6.91% | 5.19% | 2.70% | 1.38% |
| Dream Glue-5 sided-Thick Face | Middle Face | 34.68% | 27.26% | 14.23% | 9.17% | 4.34% | 2.12% |
| Dream Glue-5 sided-Thin Face | Middle Face | 40.07% | 27.06% | 11.63% | 9.34% | 4.34% | 2.00% |
| Float Glass | Middle Face | 89.54% | 87.36% | 69.71% | 38.26% | 21.79% | 13.27% |
| Bullseye Cast Glass Ingot-Clear | Middle Face | 81.38% | 83.88% | 50.50% | 38.25% | 19.98% | 11.03% |
| Bullseye Cast Glass Ingot-Grey Blue Tint | Middle Face | 39.79% | 38.96% | 25.92% | 18.73% | 9.23% | 5.40% |

FIG. 28C

LUX TRANSMISSION OF BUILDING BLOCKS IN VARIOUS AGGREGATION PATTERNS AND SIMILAR MATERIALS

| | | % Lux Transmitted | % Lux Transmitted | % Lux Transmitted | % Lux Transmitted | % Lux Transmitted |
|---|---|---|---|---|---|---|
| Aggregation Components | Modular Aggregation Pattern | 5cm | 5cm | 10cm | 20cm | 30cm |
| Empty Screen | Bowed | 100% | 98.30% | 96.40% | 94.20% | 91.65% |
| 5 Solid Clear Building Block | Bowed | 70.00% | 56.60% | 50.20% | 32.31% | 23.37% |
| 5 Clear 5 Sided Elongated Post Building Block Thin Plate | Bowed | 51.20% | 46.80% | 34.60% | 27.03% | 19.68% |
| 5 Clear 5 Sided Elongated Post Building Block Thick Plate | Bowed | 50.40% | 46.60% | 34.60% | 26.43% | 19.60% |
| Solid Cream Color Glue Block | Bowed | 51.60% | 48.30% | 43.70% | 38.10% | 30.60% |
| Cream Glue-5 sided-Thick Plate | Bowed | 55.40% | 49.60% | 35.60% | 33.40% | 19.41% |
| Cream Glue-5 sided-Thin Plate | Bowed | 59.60% | 49.70% | 36.80% | 37.61% | 22.59% |
| Float Glass | Bowed | 59.10% | 73.00% | 56.70% | 56.60% | 39.60% |
| Bullseye Cast Glass Ingot-Clear | Bowed | 61.10% | 50.60% | 42.80% | 41.22% | 29.67% |
| Bullseye Cast Glass Ingot-Grey Blue Tint | Bowed | 40.70% | 36.70% | 27.80% | 16.80% | 12.30% |

| | | % Lux Transmitted | % Lux Transmitted | % Lux Transmitted | % Lux Transmitted | % Lux Transmitted | % Lux Transmitted |
|---|---|---|---|---|---|---|---|
| Aggregation Components | Modular Aggregation Pattern | 5cm | 5cm | 5cm | 10cm | 20cm | 30cm |
| Empty Screen | Bowed | 100% | 90.58% | 86.80% | 74.88% | 49.94% | 37.88% |
| 5 Solid Clear Building Block | Bowed | 52.20% | 50.48% | 47.80% | 38.80% | 46.61% | 0.30% |
| 5 Clear 5 Sided Elongated Post Building Block Thin Plate | Bowed | 50.90% | 56.07% | 47.30% | 51.58% | 36.52% | 0.31% |
| 5 Clear 5 Sided Elongated Post Building Block Thick Plate | Bowed | 50.30% | 51.53% | 49.77% | 45.80% | 34.98% | 30.31% |
| Solid Cream Color Glue Block | Bowed | 50.30% | 56.70% | 50.60% | 45.80% | 32.94% | 0.31% |
| Cream Glue-5 sided-Thick Plate | Bowed | 54.80% | 73.80% | 40.68% | 47.08% | 41.40% | 0.21% |
| Cream Glue-5 sided-Thin Plate | Bowed | 48.07% | 50.60% | 44.08% | 49.77% | 44.73% | 0.71% |
| Float Glass | Bowed | 56.44% | 87.20% | 81.04% | 69.44% | 43.00% | 0.00% |
| Bullseye Cast Glass Ingot-Clear | Bowed | 51.98% | 56.00% | 51.53% | 50.70% | 45.08% | 0.00% |
| Bullseye Cast Glass Ingot-Grey Blue Tint | Bowed | 38.76% | 35.74% | 31.69% | 32.84% | 21.47% | 12.30% |

FIG. 28D

LIGHT TRANSMITTING BUILDING BLOCKS

RELATED APPLICATIONS

This application claims priority to U.S. Provisional Application No. 63/325,345 filed under 35 U.S.C. § 111(b) on Mar. 30, 2022, the entire disclosure of which is incorporated herein by reference for all purposes.

STATEMENT REGARDING FEDERALLY SPONSORED RESEARCH

This invention was made with no government support. The government has no rights in this invention.

BACKGROUND

Humans have become an indoor species. It is believed that humans spend a large majority of their time indoors during their lifetime. The connection between humans and their surroundings is limited and often overstepped by virtual screen activities. However, natural light is an important factor in determining one's relationship to their surroundings, and maintaining a healthy alignment to the natural rhythms of day and night. There is a need for architectural systems and building materials which better connect the natural environment to the occupant of a built space.

SUMMARY

Provided herein is a building block comprising a polygon comprising a first half and a second half, wherein the first half meets the second half at a plane defined by top and bottom centerlines, the first half including a first top face and a first bottom face and the second half including a second top face and a second bottom face; wherein a divergence in slope is defined along the top centerline due to the meeting of the first top face and the second top face; wherein a divergence in slope is defined along the bottom centerline due to the meeting of the first bottom face and the second bottom face; and wherein the building block comprises a light transmitting material. In certain embodiments, the light transmitting material is transparent. In certain embodiments, the light transmitting material is translucent.

In certain embodiments, the polygon has eight sides. In certain embodiments, the polygon has ten sides.

In certain embodiments, the building block further comprises an adhesive between the first half and the second half along a plane defined by the top centerline and the bottom centerline. In particular embodiments, the adhesive comprises a dye. In particular embodiments, the adhesive is a UV glue, a silicone, epoxy, or a high bond tape.

In certain embodiments, the building block comprises an internal void and a solid region in one of the first half or the second half.

In certain embodiments, the building block comprises an internal void and a solid region in each of the first half and the second half. In particular embodiments, the building block further comprises an adhesive between the first half and the second half along a plane defined by the top centerline and the bottom centerline. In particular embodiments, the adhesive comprises a dye.

In particular embodiments, the building block further comprises an adhesive between the first half and the second half along a plane defined by the top centerline and the bottom centerline. In particular embodiments, the adhesive comprises a dye.

In certain embodiments, the light transmitting material is glass. In particular embodiments, the building block consists essentially of the light transmitting material material, an adhesive between the first half and the second half along a plane defined by the top centerline and the bottom centerline, and optionally a dye in the adhesive.

Further provided is a wall structure comprising an aggregation of a plurality of the building blocks described herein.

In certain embodiments, the plurality comprises a first building block, a second building block, and a third building block; the first bottom face of the first building block contacts the second top face of the second building block; and the second bottom face of the first building block contacts the first top face of the third building block. In particular embodiments, the wall structure is tilted or leaning.

In certain embodiments, the plurality comprises a first building block, a second building block, a third building block, and a fourth building block each having ten faces, the ten faces including eight faces, and opposing ninth and tenth faces, wherein each of the ten faces is a quadrilateral; the ninth face of the first building block contacts the tenth face of the second building block; the ninth face of the second building block contacts the tenth face of the third building block; the first bottom face of the first building block contacts the second top face of the fourth building block; and a second side face of the second building block contacts the first top face of the fourth building block.

In certain embodiments, the plurality comprises a first building block, a second building block, a third building block, and a fourth building block each having ten faces, the ten faces including eight faces, and opposing ninth and tenth faces, wherein each of the ten faces is a quadrilateral; the bottom centerline of the first building block contacts the tenth face of the second building block; and the ninth face of the third building block contacts the top centerline of the fourth building block.

In certain embodiments, the plurality comprises a first building block, a second building block, a third building block, and a fourth building block each having ten faces, the ten faces including eight faces, and opposing ninth and tenth faces, wherein each of the ten faces is a quadrilateral; a fourth side face of the first building block contacts a first side face of the second building block; a second side face of the first building block contacts a third side face of the third building block; the tenth face of the first building block contacts the ninth face of the fourth building block; a third side face of the fourth building block contacts a second side face of the second building block; and a first side face of the fourth building block contacts a fourth side face of the third building block. In particular embodiments, the wall structure is tilted or leaning.

In certain embodiments, the plurality comprises a first building block, a second building block, a third building block, and a fourth building block; the second bottom face of the first building block contacts the first top face of the second building block; the second bottom face of the second building block contacts the first top face of the third building block; and the first bottom face of the first building block contacts the first top face of the fourth building block.

In certain embodiments, the plurality comprises a first building block, a second building block, a third building block, and a fourth building block; a second side face of the first building block contacts a third side face of the second building block; a first top corner of the first building block meets a second top corner of the third building block; and a second bottom apex corner of the first building block meets a first bottom apex corner of the fourth building block.

In certain embodiments, the plurality comprises a first building block, a second building block, a third building block, and a fourth building block; a first side face of the first building block contacts a fourth side face of the second building block; a first bottom apex corner of the first building block meets a second bottom apex corner of the third building block; and a first top corner of the first building block meets a second top corner of the fourth building block.

In certain embodiments, the plurality comprises a first building block, a second building block, and a third building block; a fourth side face of the first building block contacts a third side face of the second building block; and a first side face of the first building block contacts a third side face of the third building block. In particular embodiments, each of the building blocks in the aggregation comprises an adhesive with a dye.

In certain embodiments, the wall structure is curved.

Further provided is a building comprises a built space defined by a plurality of the wall structures described herein.

Further provided is a building block comprising a light transmitting material material having an octahedron shape, the building block having eight triangular faces, wherein two of the triangular faces define a first and second top face and extend from opposing first and second bottom apex corners and meet at a top centerline on a top side of the building block; two of the triangular faces define a first and second bottom face and extend from the opposing bottom apex corners and meet at a bottom centerline on a bottom side of the building block; and four of the triangular faces define first, second, third, and fourth side faces and are formed around a perimeter of the building block, each of the four of the triangular faces having one point at the top centerline, one point at the bottom centerline, and one point at one of the opposing first and second bottom apex corners.

In certain embodiments, the light transmitting material is transparent. In certain embodiments, the light transmitting material is translucent. In certain embodiments, the building block comprises glass. In certain embodiments, the building block consists of glass. In certain embodiments, the transparent material comprises a plastic. In certain embodiments, the building block comprises a resin. In certain embodiments, the building block comprises ice. In certain embodiments, the building block comprises a combination of glass and a plastic.

In certain embodiments, the building block is formed from two halves glued together at a glue joint, the glue joint comprising a thin veil of color configured to fade in and out of view depending on an orientation of a viewer relative to the building block.

In certain embodiments, the building block comprises a void therein.

In certain embodiments, the building comprises a void therein and is formed from two halves glued together at a glue joint, the glue joint comprising a thin veil of color configured to fade in and out of view depending on an orientation of a viewer relative to the building block.

Further provided is a building block comprising a light transmitting material having a decahedron shape, the building block having eight faces, and opposing ninth and tenth faces, wherein each of the ninth face and tenth face is a quadrilateral; wherein two of the eight faces define a first and second top face and extend from the opposing ninth and tenth faces and meet at a top centerline on a top side of the building block; two of the eight faces define a first and second bottom face and extend from the opposing ninth and tenth faces and meet at a bottom centerline on a bottom side of the building block; and four of the eight faces define first, second, third, and fourth side faces, each of the four of the eight faces having one point at the top centerline, one point at the bottom centerline, and two points at one of the opposing ninth and tenth faces.

In certain embodiments, the light transmitting material is transparent. In certain embodiments, the light transmitting material is translucent. In certain embodiments, the building block comprises glass. In certain embodiments, the building block consists of glass. In certain embodiments, the transparent material comprises a plastic. In certain embodiments, the building block comprises a resin. In certain embodiments, the building block comprises ice. In certain embodiments, the building block comprises a combination of glass and a plastic.

In certain embodiments, the building block is formed from two halves glued together at a glue joint, the glue joint comprising a thin veil of color configured to fade in and out of view depending on an orientation of a viewer relative to the building block.

In certain embodiments, the building block comprises a void therein.

In certain embodiments, the building comprises a void therein and is formed from two halves glued together at a glue joint, the glue joint comprising a thin veil of color configured to fade in and out of view depending on an orientation of a viewer relative to the building block.

Further provided is a method of constructing a wall structure, the method comprising arranging a plurality of light transmitting building blocks in an aggregation to form a wall structure, where one or more of the building blocks includes an adhesive with a colored dye along a glue joint so as to produce a thin veil of color configured to fade in an out of view depending on an orientation of a viewer relative to the building block. In certain embodiments, at least one of the building blocks comprises a void therein. In certain embodiments, each of the plurality of light transmitting building blocks is non-polygonal. In certain embodiments, each of the plurality of light transmitting building blocks is non-rectilinear. In certain embodiments, the light transmitting building blocks are transparent. In certain embodiments, the light transmitting building blocks are translucent.

Further provided is an architectural structure comprising a plurality of the wall structures described herein. In certain embodiments, the architectural structure comprises two or more wall structures having different patterns of the building blocks. In certain embodiments, the architectural structure comprises two or more wall structures having the same pattern of the building blocks.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 1A shows an octahedron building block. FIG. 1B shows a decahedron building block. FIG. 1C shows a perspective view of an octahedron building block with an internal void. FIG. 1D shows a perspective view of a decahedron building block with an internal void. FIG. 1E shows a perspective view of an octahedron building block with a symmetrical void. FIG. 1F shows a perspective view of a decahedron building block with an asymmetrical void.

FIGS. 6A-6G: Perspective views of building blocks having a side face external press-in of solid blocks.

FIGS. 8A, 8B, 8E, and 8F show perspective views. FIGS. 8C and 8G show a top view. Nonlimiting example dimensions are shown.

FIG. 19: Views of a wall structure formed from an aggregation of building blocks referred to as a low horizontal aggregation.

FIGS. 28A-28D: Tables showing lux transmission of building blocks in various aggregation patterns and similar materials. FIG. 28A shows a table relating to a middle face (also known as low horizontal) aggregation pattern. FIG. 28B shows a table relating to a boxed aggregation pattern. FIG. 28C shows a table relating to a middle face aggregation pattern. FIG. 28D shows a table relating to a boxed aggregation pattern.

FIG. 29A shows light transmitted through the glass as a function of the distance to the surface. FIG. 29B shows light transmitted through the glass normal to the face in a middle face aggregation. FIGS. 29C-29D show light transmitted through the glass normal to the face.

DETAILED DESCRIPTION

Figure 1A:
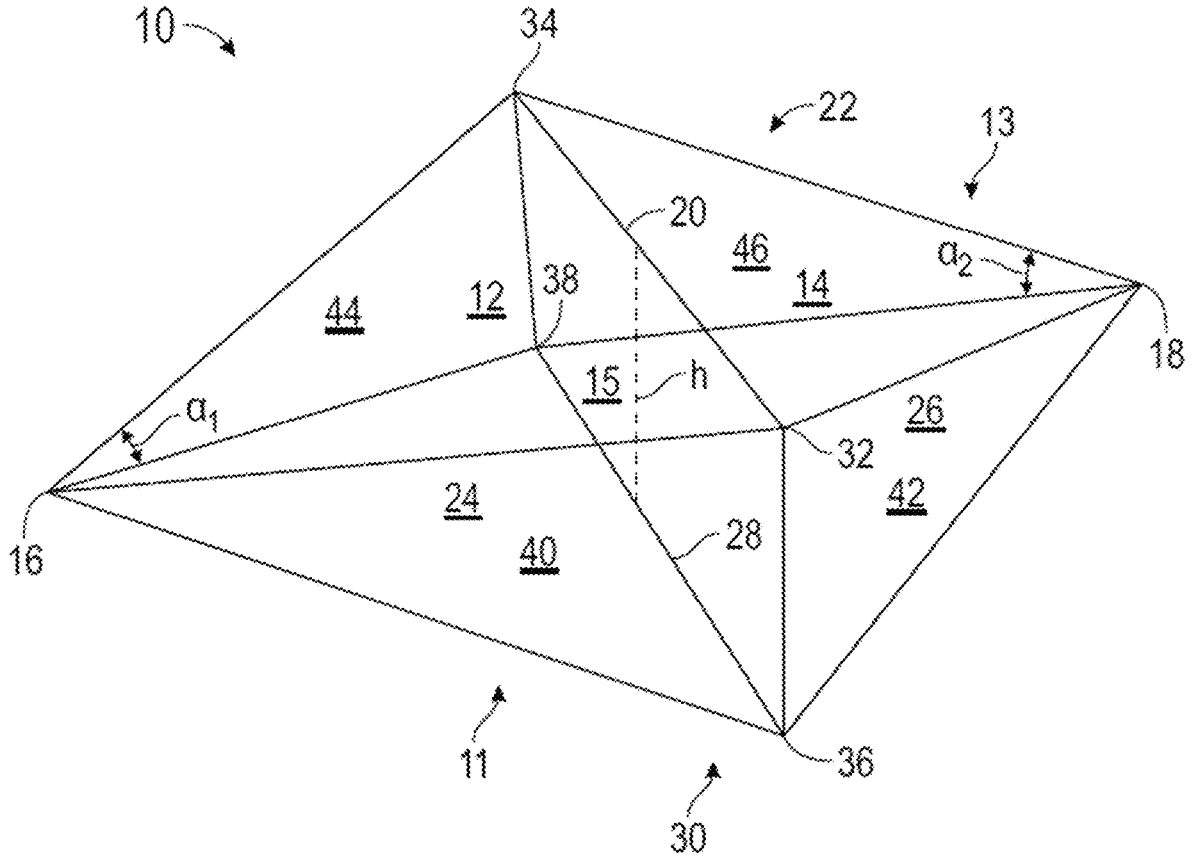
FIGS. 1A-1F: Perspective views of building blocks in accordance with the present disclosure.

Throughout this disclosure, various publications, patents, and published patent specifications may be referenced by an identifying citation. The disclosures of these publications, patents, and published patent specifications are hereby incorporated by reference into the present disclosure in their entirety to more fully describe the state of the art to which the present disclosure pertains.

Provided herein are building materials and methods useful for creating site-specific architectural structures attuned to natural light cycles, circadian rhythms, and the well-being of the occupants as it relates to shifts in light. The materials and methods involve three-dimensional geometric light transmitting forms as the most prominent element of the structure. The shapes of these forms, referred to as building blocks, allow for multiple orientations that each aggregate together to construct wall systems with various patterns that create different textures as well as spatial configurations within the system.

In general, the building blocks described herein are in the form of a polygon composed of a light transmitting material with either eight or ten sides. A light transmitting material is a substance or material that is able to allow light to pass through it without significant absorption, reflection, or refraction. Light transmitting materials can be made from a variety of substances, including, but not limited to, glass, plastics, resins, crystals, ice, and liquids. The degree to which a material transmits light is often measured by its refractive index or its transparency level, which depends on the wavelength of the light and the properties of the material itself. The light transmitting material may be a transparent material. The term "transparent" is used herein to refer to a material that allows at least 70% of visible light to pass through. The light transmitting material may also be a translucent material. The term "translucent" refers to a material or substance that allows some light to pass through it, but diffuses or scatters it in a way that makes objects behind it appear blurry or obscured. Unlike transparent materials, which allow most visible light to pass through them in a clear and undistorted way, translucent materials only allow some light to pass through, while also reflecting or refracting some of it. This results in a diffused and hazy appearance of objects seen through the material. Examples of translucent materials include frosted glass, wax paper, and some types of plastics. The degree of translucency of a material can vary, depending on factors such as thickness, composition, and the angle and intensity of the light passing through it.

The polygon may be formed from two halves that meet at a plane defined by a top centerline and a bottom centerline, where the top and bottom centerlines are edges along which there is a divergence in slope due to the meeting of the two halves. The two halves may extend away from the top and bottom centerlines to respective opposing points, in the case of an eight-sided building block, or may extend away from the top and bottom centerlines to respective quadrilateral faces, in the case of a ten-sided building block. The building blocks may also include internal voids, as described in more detail below. Regardless of whether the building blocks include voids, and regardless of whether the building blocks have eight sides or ten sides, the building blocks are capable of being aggregated in a variety of patterns to form structurally stable wall structures useful for architectural applications, and useful for creating certain optical effects.

Referring now to FIG. 1A, depicted is a perspective view of a building block 10 having eight sides in accordance with the present disclosure. The building block 10 is composed of a light transmitting material having an octahedron shape, which may be formed from a first half 11 and a second half 13 joined together. The light transmitting material may be transparent or translucent. The light transmitting material may be, for example, glass, plastic, a resin, ice, or a combination thereof. In some embodiments, the building block 10 consists of glass or a mixture of recycled glass. In some embodiments, the building block 10 includes a combination of glass and one or more other transparent materials. In some embodiments, the building block 10 includes a plastic. Glass provides the ideal combination of transparency and compressive strength for the architectural advantages described herein. Any suitable architectural glass, such as float glass or other annealed glass, may be used. However, the present disclosure is not limited to glass. Furthermore, in alternative embodiments, the building block 10 may be made from a material which does not allow light through, such as black glass.

Referring still to FIG. 1A, the building block 10 has an octahedron shape, meaning the building block 10 has a three-dimensional shape that includes eight faces 12, 14, 24, 26, 40, 42, 44, 46. The eight faces 12, 14, 24, 26, 40, 42, 44, 46 are divided between a first half 11 and a second half 13 which meet at the plane 15. For ease of nomenclature, the top and bottom faces 12, 24 on the first half 11 are referred to as being "first" faces, and the top and bottom faces 14, 26 on the second half 13 are referred to as being "second" faces. In this particular example, each of the eight faces 12, 14, 24, 26, 40, 42, 44, 46 is triangular. Two of the triangular faces 12, 14, which may be referred to as the first and second top faces, respectively, extend from opposing bottom apex corners 16, 18 and meet at a top centerline 20 on a top side 22 of the building block 10. The first and second top faces 12, 14 each have one point on a bottom apex corner 16, 18 and two points on the top centerline 20. The top centerline 20 is an edge on the top side 22 of the building block 10 at which there is a divergence in slope due to the meeting of the two top faces 12, 14. Two of the other triangular faces 24, 26, which may be referred to as the first and second bottom faces, respectively, extend from the same opposing bottom apex corners 16, 18 and meet at a bottom centerline 28 on a bottom side 30 of the building block 10. The bottom centerline 28 is a edge on the bottom side 30 of the building block 10 at which there is a divergence in slope due to the meeting of the two bottom faces 24, 26. Thus, the top and bottom centerlines 20, 28 are each edges along which there is a divergence in slope due to the meeting of the first half 11 and the second half 13.

Referring still to FIG. 1A, the building block 10 has a height h defined by the distance between the top centerline 20 and the bottom centerline 28. The top centerline 20 extends between opposing top corners 32, 34. The bottom centerline 28 extends between opposing bottom corners 36, 38. Whereas the top corners 32, 34 each have the same height h relative to the corresponding bottom corners 36, 38, the distance between the top and bottom centerlines 20, 28 and the first bottom apex corner 16 may be different than the distance between the top and bottom centerlines 20, 28 and the second bottom apex corner 18. The area of the first top face 12 may be greater or less than the area of the second top face 14, and the area of the first bottom face 24 (which corresponds to the area of the first top face 12) may be greater or less than the area of the second bottom face 26 (which corresponds to the area of the second top face 14). Put another way, the length from the plane 15 defined by the top and bottom centerlines 20, 28 to the first bottom apex corner 16 may be different from the length from the plane 15 defined by the top and bottom centerlines 20, 28 to the second bottom apex corner 16. Accordingly, the angle $\alpha_1$ may be different from the angle $\alpha_2$. This can be visualized by thinking of the building block 10 as being formed from two rectangular pyramids of different heights, the first pyramid corresponding to the first half 11 and having an apex at the first bottom apex corner 16 and the second pyramid corresponding to the second half 13 and having an apex at the second bottom apex corner 18, where a plane 15 defined by the bottom centerline 28 and the top centerline 20 forms the rectangular base shared by both pyramids. Notably, as described in more detail below, the building block 10 may be made by gluing together the first half 11 and the second half 13 along this rectangular base defined by the plane 15 between the top centerline 20 and the bottom centerline 28 (which may be referred to as a glue joint).

Referring still to FIG. 1A, the remaining four triangular faces 40, 42, 44, 46 (i.e., the triangular faces other than the two top faces 12, 14 and the two bottom faces 24, 26), which may be referred to herein as the first, second, third, and fourth side faces, are formed around a perimeter of the building block 10. The first side face 40, second side face 42, third side face 44, and fourth side face 46 each have one point on the top centerline 20, one point on the bottom centerline 28, and one point at a bottom apex corner 16, 18. For example, the first side face 40 has one point at the first bottom apex corner 16, one point at the top centerline 20 at the first top corner 32, and one point at the bottom centerline 28 at the first bottom corner 36.

The building block 10 can be made with a variety of different relative dimensions. FIGS. 2A, 2B, 2C, 2D, 2E, 2F, 2G, 2H, 2I, 2J, 2K, 2L, 2M, 3A, 3B, 3C, 3D, 4A, 4B, 4C, 4D, 5A, 5B, 5C, 5D show different non-limiting example dimensions for the building block 10. As seen in FIG. 3, in one non-limiting example, the building block 10 may have a width, from the first bottom apex corner 14 to the second bottom apex corner 16, of 8 inches, and a length, from the first bottom corner 36 to the second bottom corner 38, of 5.5 inches. In this example, the building block 10 has a height h of 2.25 inches. As seen in FIGS. 4A-4D in another non-limiting example, the building block 10 may have a width, from the first bottom apex corner 14 to the second bottom apex corner 16, of 7.57 inches, and a length, from the first bottom corner 36 to the second bottom corner 38, of 4.35 inches. In this example, the building block 10 has a height h of 1.69 inches. As seen in FIGS. 5A-5D, in another non-limiting example, the building block 10 may have a width, from the first bottom apex corner 14 to the second bottom apex corner 16, of 9 inches, and a length, from the first bottom corner 36 to the second bottom corner 38, of 6.25 inches. In this example, the building block 10 has a height h of 2.5 inches. However, many other relative dimensions are possible and encompassed within the scope of the present disclosure.

Figure 1B:
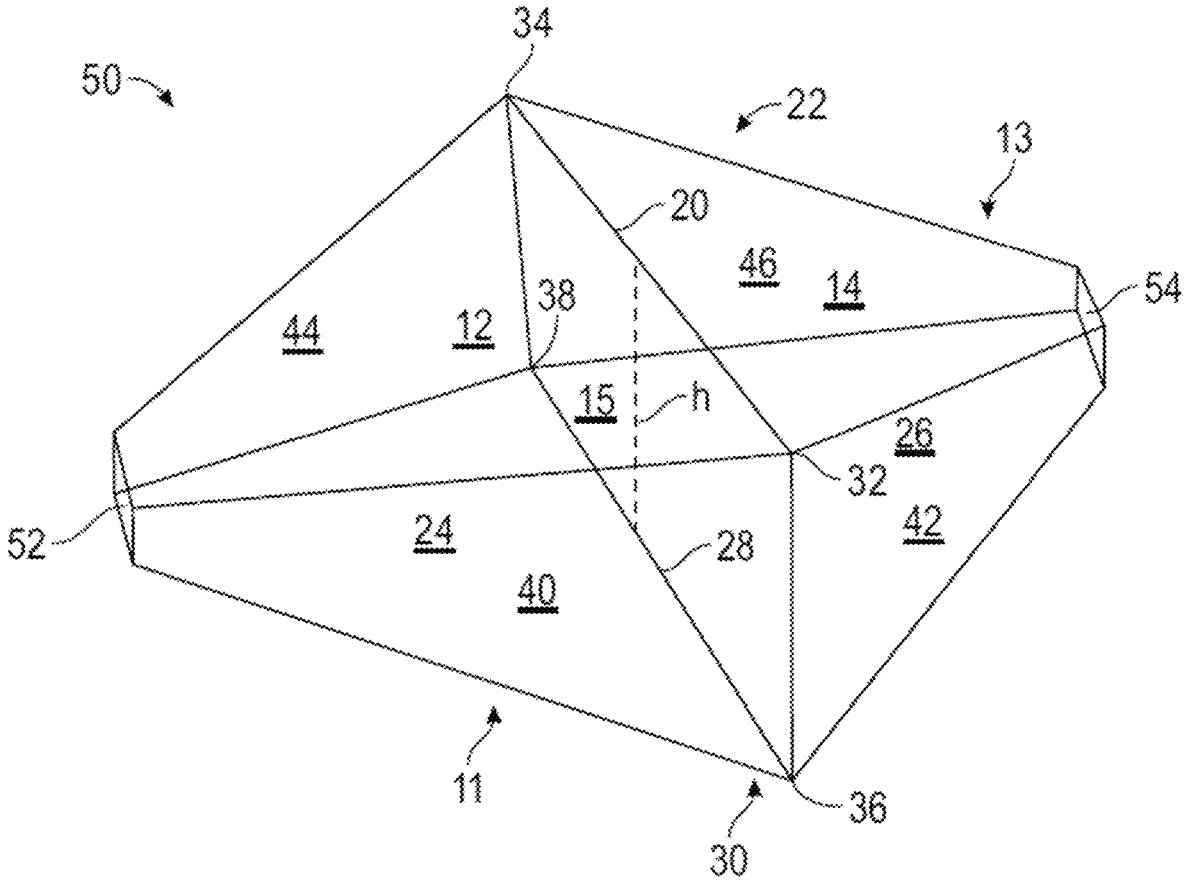

Referring now to FIG. 1B, depicted is a perspective view of a building block 50 having ten sides in accordance with the present disclosure. The building block 50 is composed of a light transmitting material having a decahedron shape, which may be formed from a first half 11 and a second half 13 joined together. The light transmitting material may be transparent or translucent. The light transmitting material may be, for example, glass, plastic, a resin, ice, or a combination thereof. In some embodiments, the building block 50 consists of glass or a mixture of recycled glass. In some embodiments, the building block 50 includes a combination of glass and one or more other transparent materials. In some embodiments, the building block 50 includes a plastic. Glass provides the ideal combination of transparency and compressive strength for the architectural advantages described herein. Any suitable architectural glass, such as float glass or other annealed glass, may be used. However, the present disclosure is not limited to glass. Furthermore, in alternative embodiments, the building block 50 may be made from a material which does not allow light through, such as black glass.

Referring still to FIG. 1B, the building block 50 has ten faces 12, 14, 24, 26, 40, 42, 44, 46, 52, 54. The building block 50 is otherwise similar to the building block 10 depicted in FIG. 1A, except that the building block 50 includes a ninth face 52 and a tenth face 54 instead of opposing bottom apex corners 16, 18, respectively. In this example, the ninth face 52 is a quadrilateral, and the tenth face 54 is a quadrilateral. Each of the eight faces 12, 14, 24, 26, 40, 42, 44, 46 is also a quadrilateral accordingly, instead of triangular as in the building block 10 depicted in FIG. 1A. The first top face 12, the first bottom face 24, the first side face 40, and the third side face 44 meet at the ninth face 52 in the first half 11. Similarly, the second top face 14, the second bottom face 26, the second side face 42, and the fourth side face 46 meet at the tenth face 54 in the second half 13. The ninth face 52 is on a side of the building block 50 opposite the tenth face 54. The building block 50 may otherwise include all of the same features and variations as the building block 10 having eight sides. As with the building block 10, the building block 50 can be made by joining the first half 11 to the second half 13 at a plane 15 defined by the top centerline 20 and the bottom centerline 28.

As shown in FIGS. 1C-1F, the building blocks 10, 50 can include one or more internal voids within its structure. Internal pockets of air can create various optical characteristics, and affect thermal and acoustic performance. When the building block 10, 50 is constructed as two parts adhered together, there is an ability to alter the internal voids, as well as add color variations along the adhered connection within the building block 10, 50. The voids can be created during the casting process. Transparency, opacity, and translucency can be adjusted based on stacked formations, thickness, or detailing in the glass. The internal voids can be symmetrical or asymmetrical.

Figure 1C:
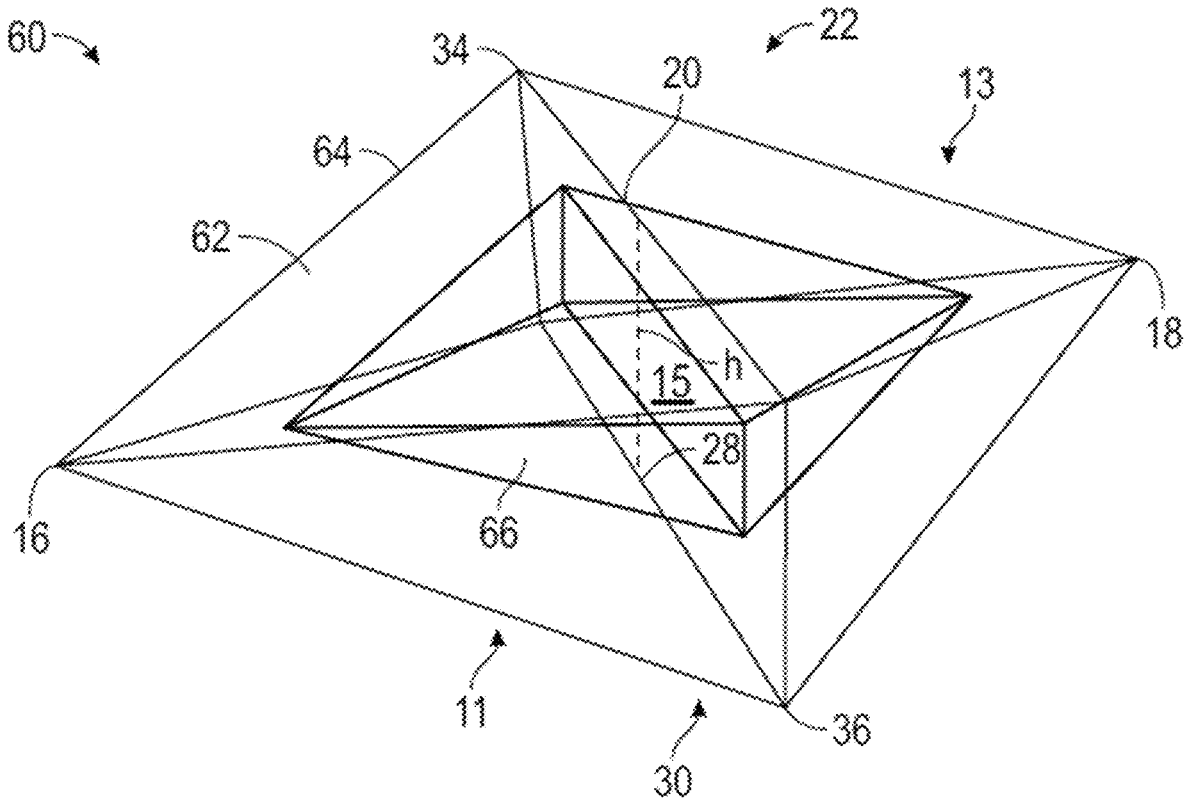

Referring now to FIG. 1C, depicted is a building block 60 having an octahedron shape and an internal void 66. The internal void 66 is an empty space within the solid region 62. The solid region 62 extends from the internal void 66 to the outer wall 64 of the building block 60. In embodiments where the building block 60 is made by joining two halves 11, 13 along the plane 15, the internal void 66 is a hollow space that may extend between the plane 15 and the solid region 62 or may define an opening in the plane 15 such that the internal void 66 extends in each half 11, 13 without being divided by solid material along the plane 15. In the example depicted in FIG. 1C, the internal void 66 has an octahedral shape. The internal void 66 may be the same shape as the building block 60 itself except smaller so as to fit inside the building block 60. However, many other shapes are possible and encompassed within the scope of the present disclosure. As a non-limiting example, the internal void 66 may have a curved shape instead of a shape with corners such as an octahedron. The building block 60 is an example of a building block having a symmetrical void structure, because the internal void 66 mirrors itself, and the solid region 62 mirrors itself, between the two halves 11, 13 of the building block 60. FIGS. 4A-4D show non-limiting example dimensions useful for making the building block 60 with a symmetrical internal void therein.

Figure 1D:
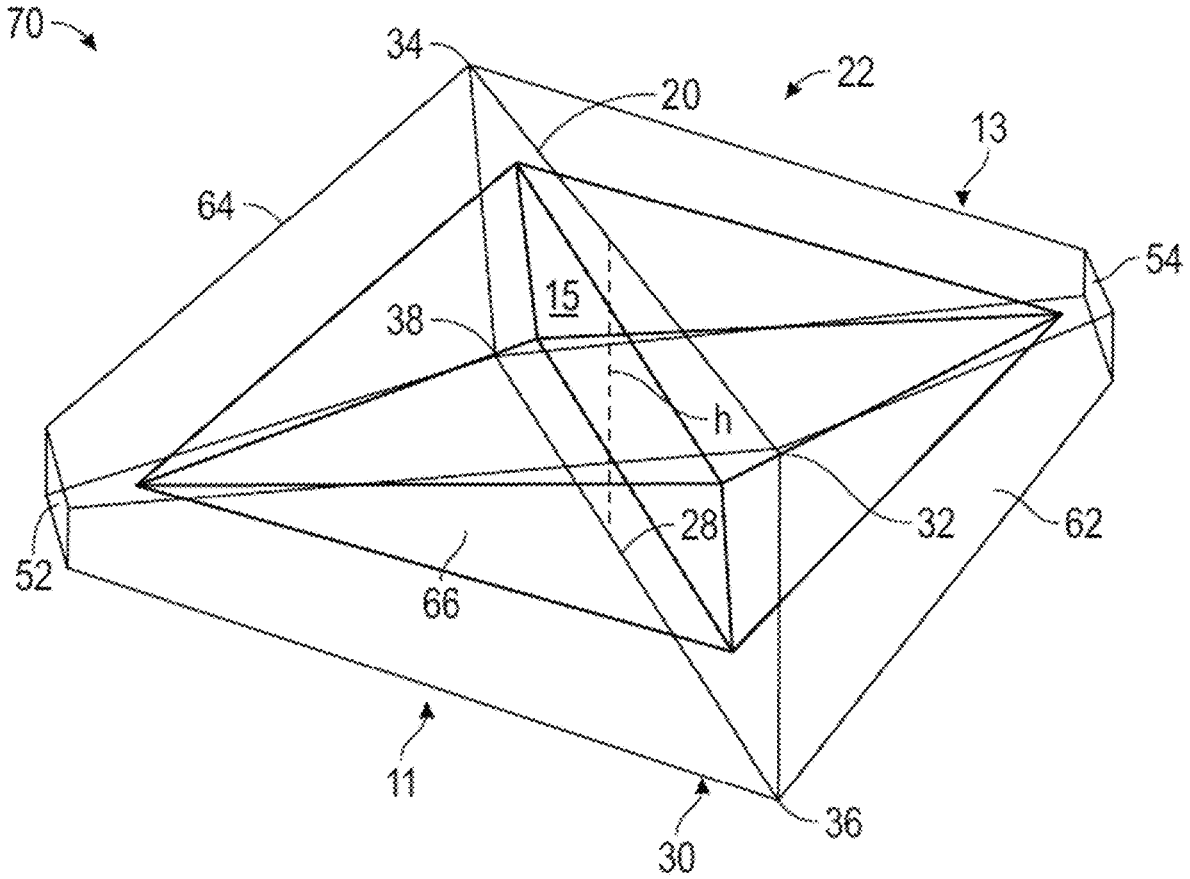

Referring now to FIG. 1D, depicted is a building block 70 having a decahedron shape and an internal void 66. The internal void 66 is an empty space within the solid region 62. The solid region 62 extends from the internal void 66 to the outer wall 64 of the building block 70. In embodiments where the building block 70 is made by joining two halves 11, 13 along the plane 15, the internal void 66 is a hollow space that may extend between the plane 15 and the solid region 62 or may define an opening in the plane 15 such that the internal void 66 extends in each half 11, 13 without being divided by solid material along the plane 15. In the example depicted in FIG. 1D, the internal void 66 has an octahedral shape. Thus, the internal void 66 has an octahedral shape while the building block 70 the internal void 66 is within has a decahedral shape. However, many other shapes are possible and encompassed within the scope of the present disclosure. As a non-limiting example, the internal void 66 may have a curved shape instead of a shape with corners such as an octahedron. The building block 70 is an example of a building block having a symmetrical void structure, because the internal void 66 mirrors itself, and the solid region 62 mirrors itself between the two halves 11, 13 of the building block. FIGS. 2A-2B 2A-2M show non-limiting example dimensions useful for making the building block 70 with a symmetrical internal void therein.

Figure 1E:
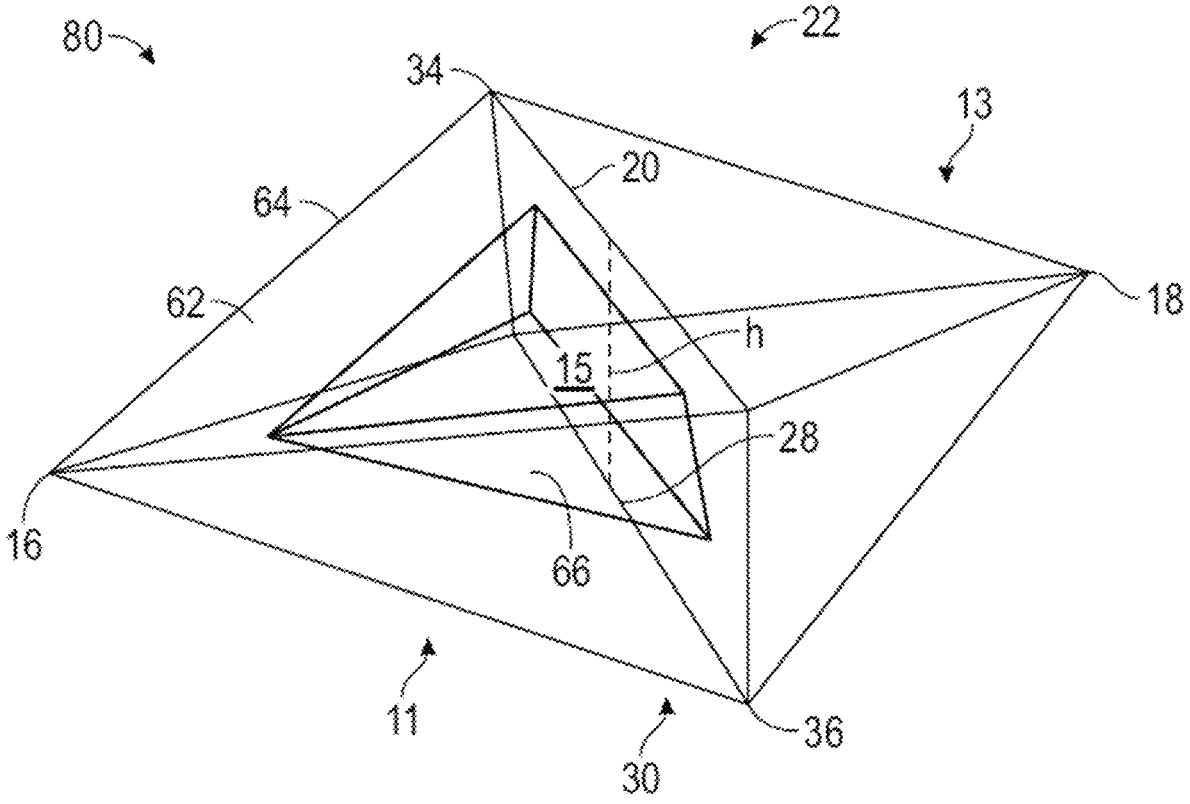

Referring now to FIG. 1E, depicted is a building block 80 having an octahedron shape and an internal void 66 and solid region 62 within the first half 11 but no void within the second half 13 of the building block 80. In other words, the entire second half 13 of the building block 80 is solid. This is an example of an octahedral building block having an asymmetrical void. In this example, the internal void 66 has a pyramidal shape. However, many other shapes are possible and encompassed within the scope of the present disclosure. As a non-limiting example, the internal void 66 may have a curved shape instead of a shape with corners such as a pyramid.

Figure 1F:
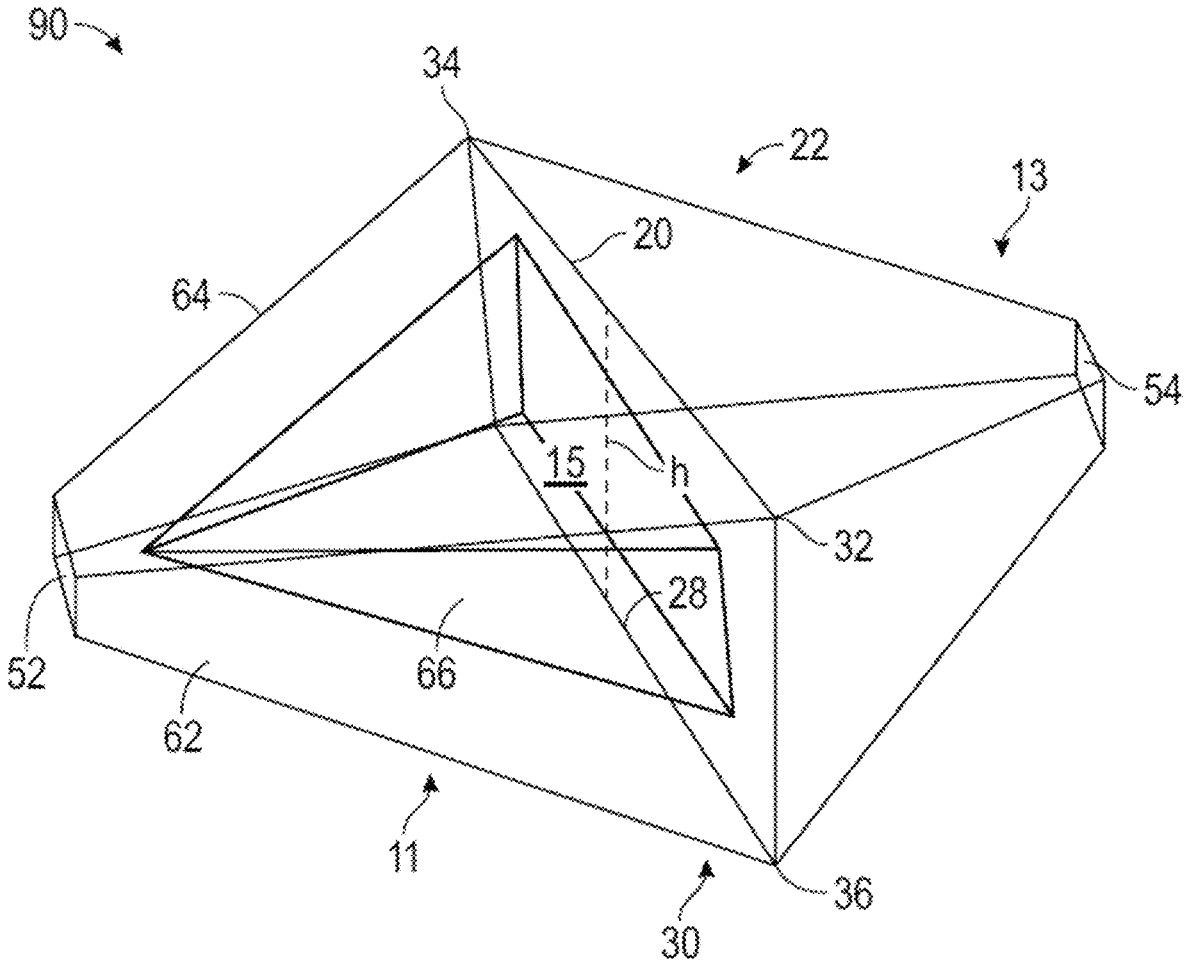
Figure 2A:
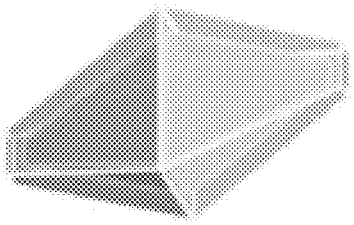
FIGS. 2A-2M: Views of a ten-sided building block in accordance with the present disclosure showing non-limiting example dimensions.
Figure 2C:
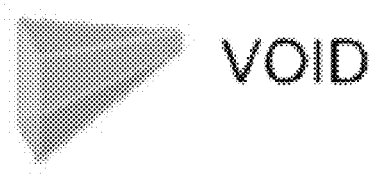
Figure 2D:
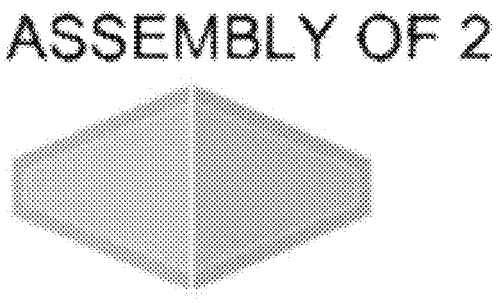
Figure 2E:
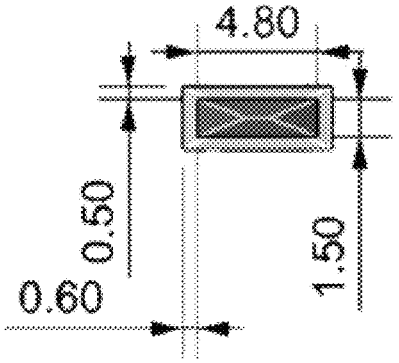
Figure 2F:
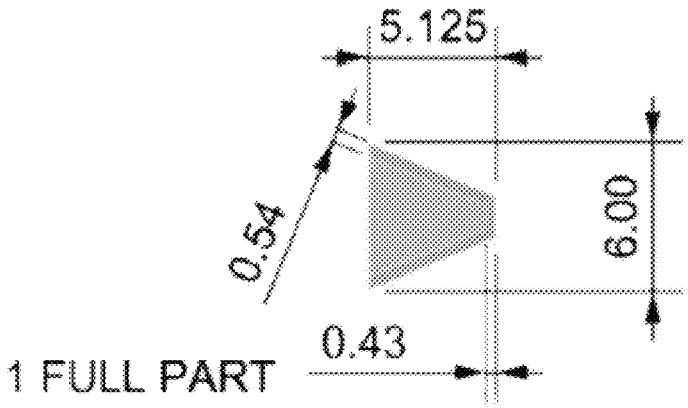
Figure 2G:
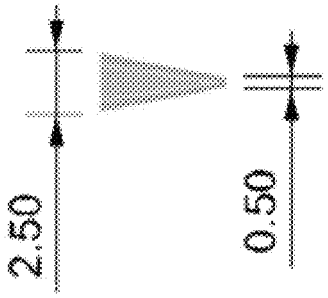
Figure 2B:
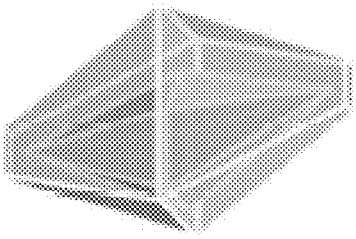
Figure 2H:
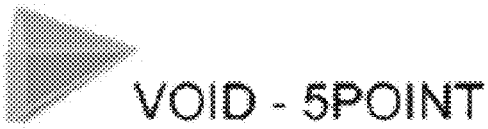
Figure 2J:
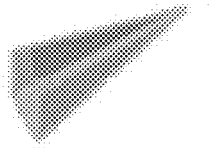
Figure 2I:
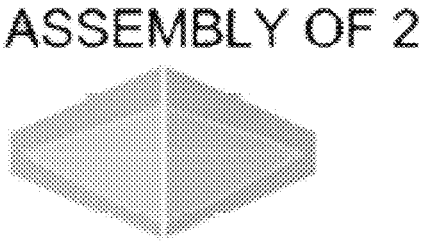
Figure 2L:
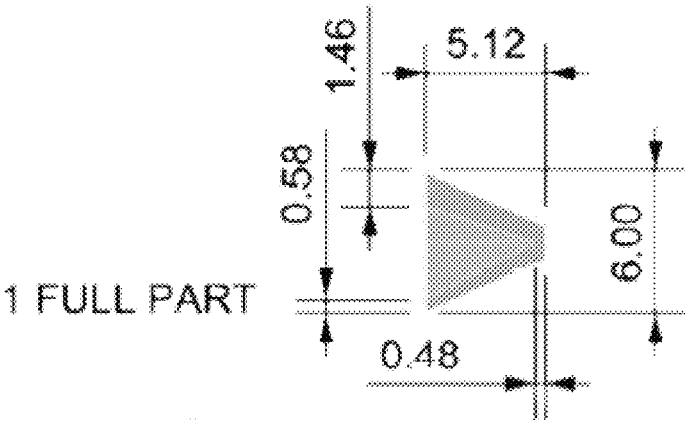
Figure 2K:
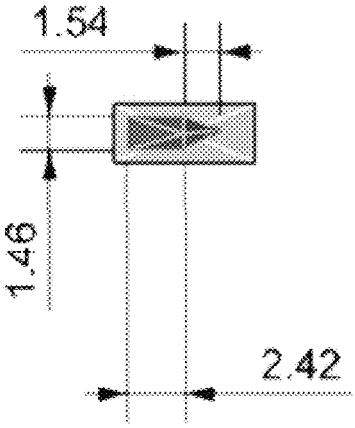
Figure 2M:
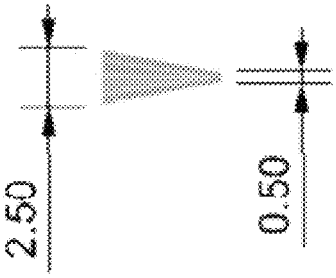
Figure 3A:
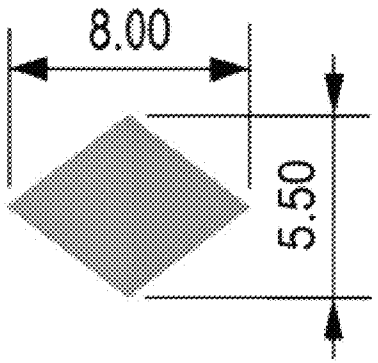
FIGS. 3A-3D: Views of an eight-sided building block in accordance with the present disclosure showing non-limiting example dimensions.
Figure 3B:
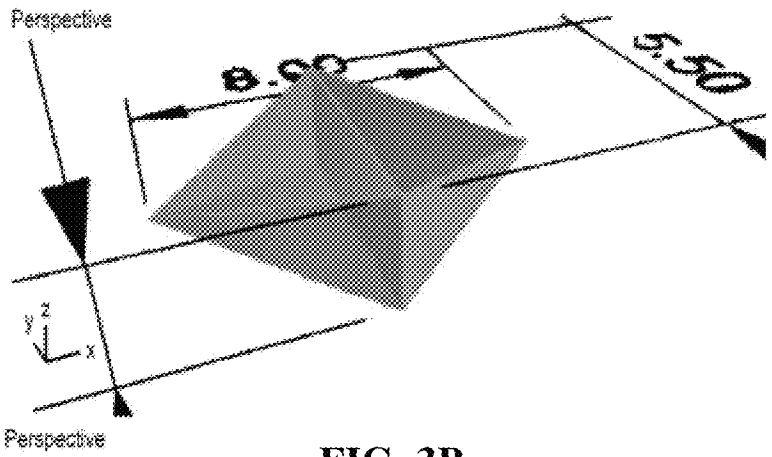
Figure 3C:
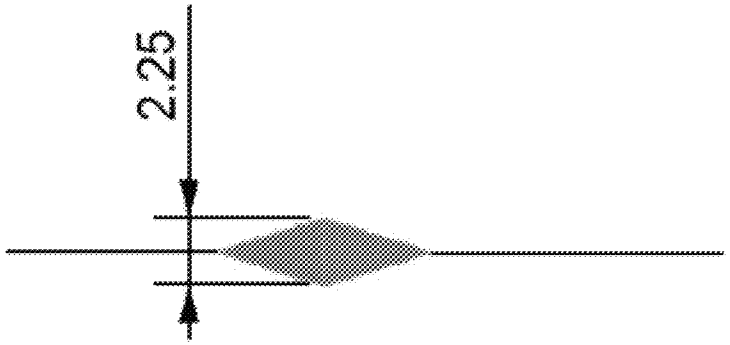
Figure 3D:
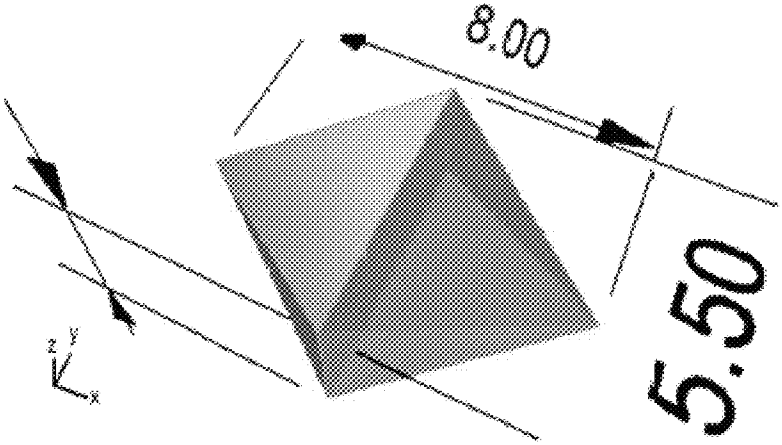
Figure 4A:
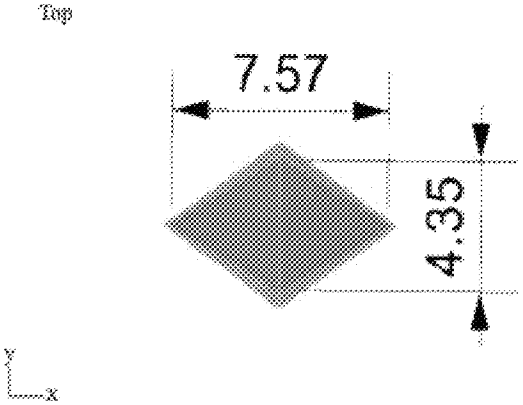
FIGS. 4A-4D: Views of a building block in accordance with the present disclosure showing non-limiting example dimensions.
Figure 4B:
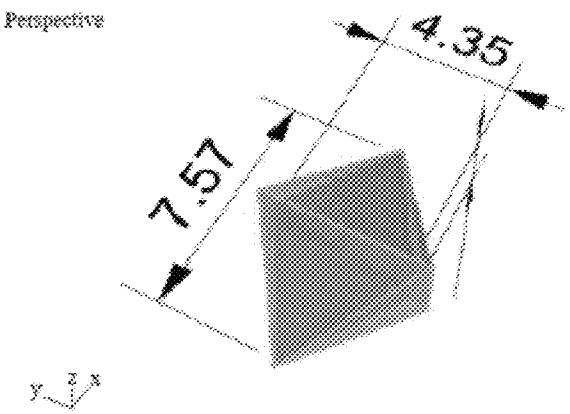
Figure 4C:
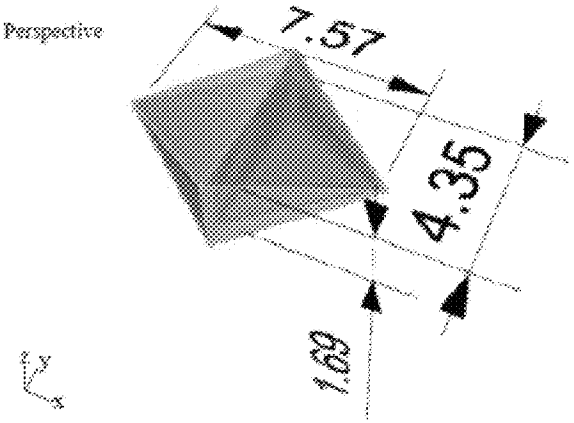
Figure 4D:
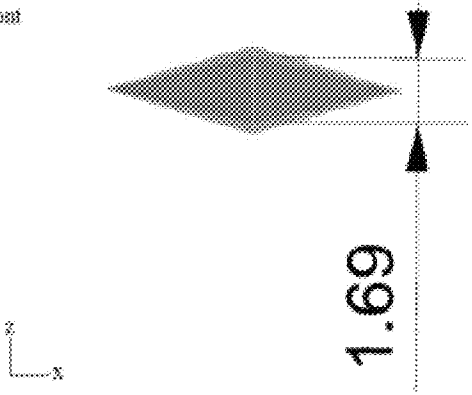
Figure 5A:
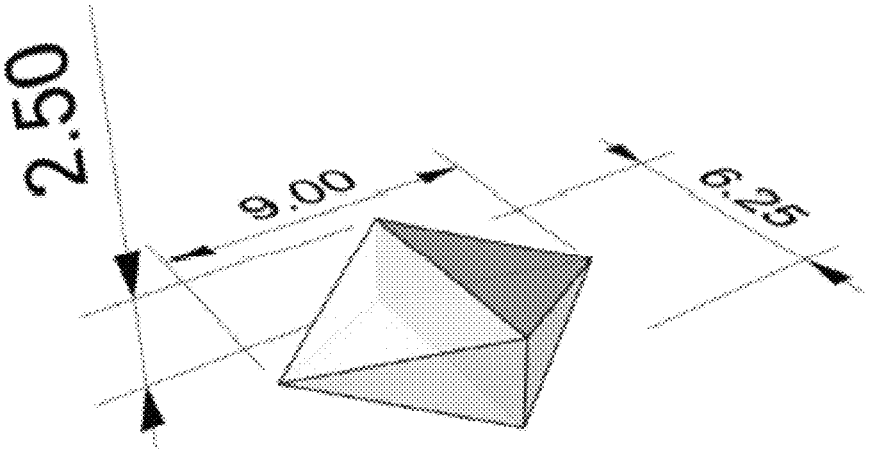
FIGS. 5A-5D: Views of a building block in accordance with the present disclosure showing non-limiting example dimensions.
Figure 5B:
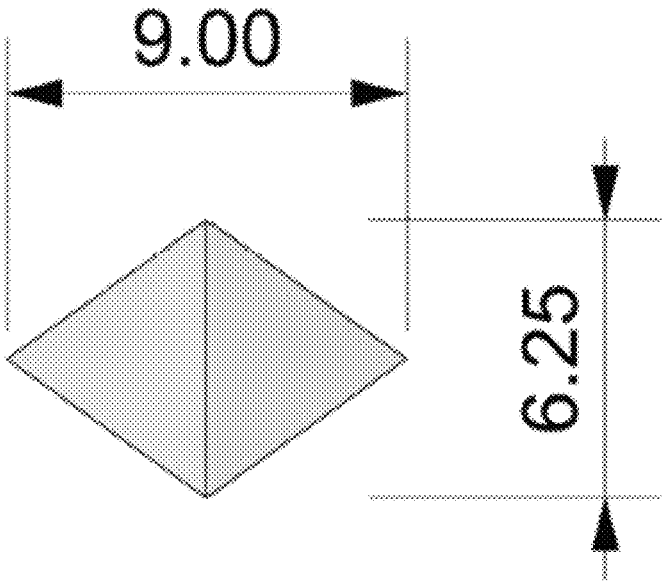
Figure 5C:
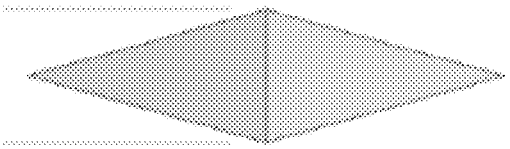
Figure 5D:
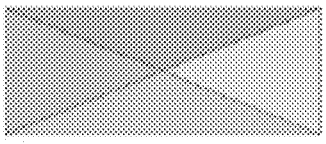

Referring now to FIG. 1F, depicted is a building block 90 having a decahedron shape and an internal void 66 and solid region 62 within the first half 11 but no void within the second half 13 of the building block 80. In other words, the entire second half 13 of the building block 90 is solid. This is an example of a decahedral building block having an asymmetrical void. In this example, the internal void 66 has a pyramidal shape. However, many other shapes are possible and encompassed within the scope of the present disclosure. As a non-limiting example, the internal void 66 may have a curved shape instead of a shape with corners such as a pyramid.

Furthermore, one or both halves 11, 13 in any of the building blocks 10, 50, 60, 70, 80, 90 can be hollow. FIGS. 4A-4D show non-limiting example dimensions of a building block 10 with a hollow half.

Figure 6B:
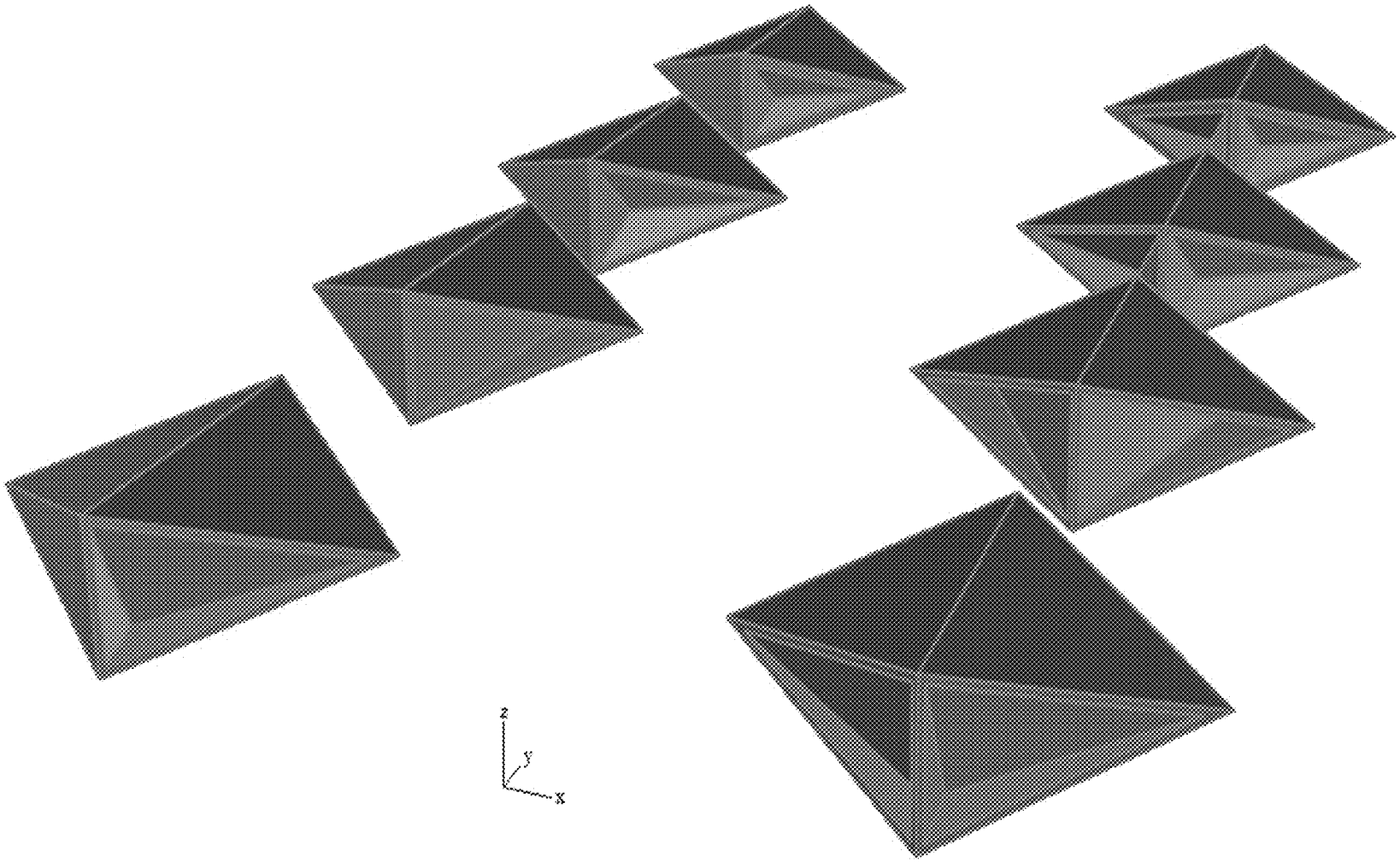
Figure 6C:
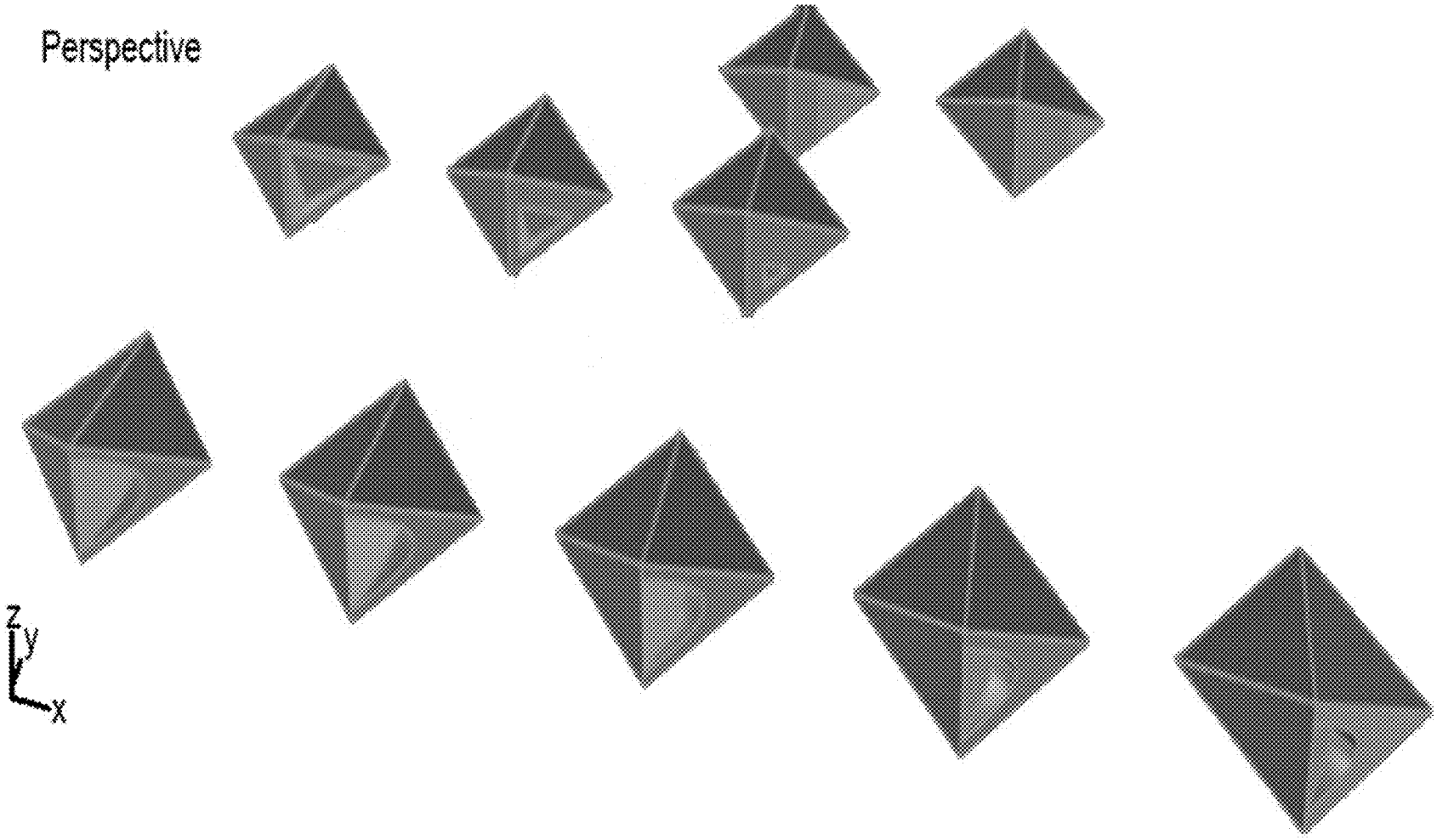
Figure 6D:
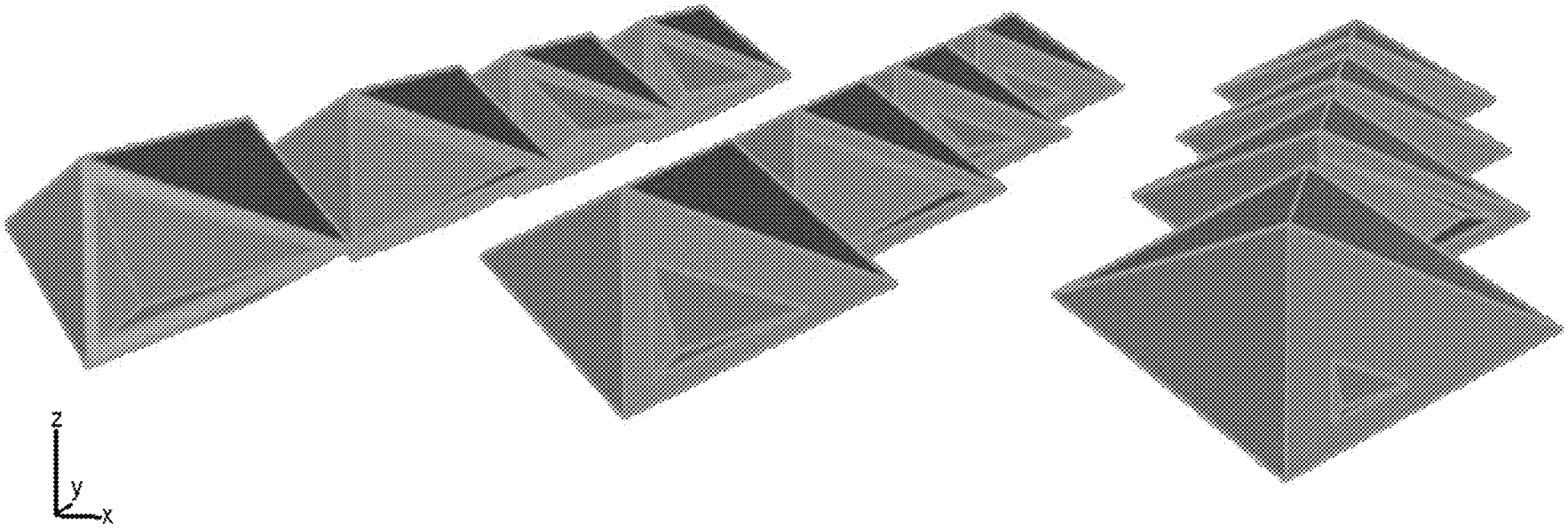
Figure 6E:
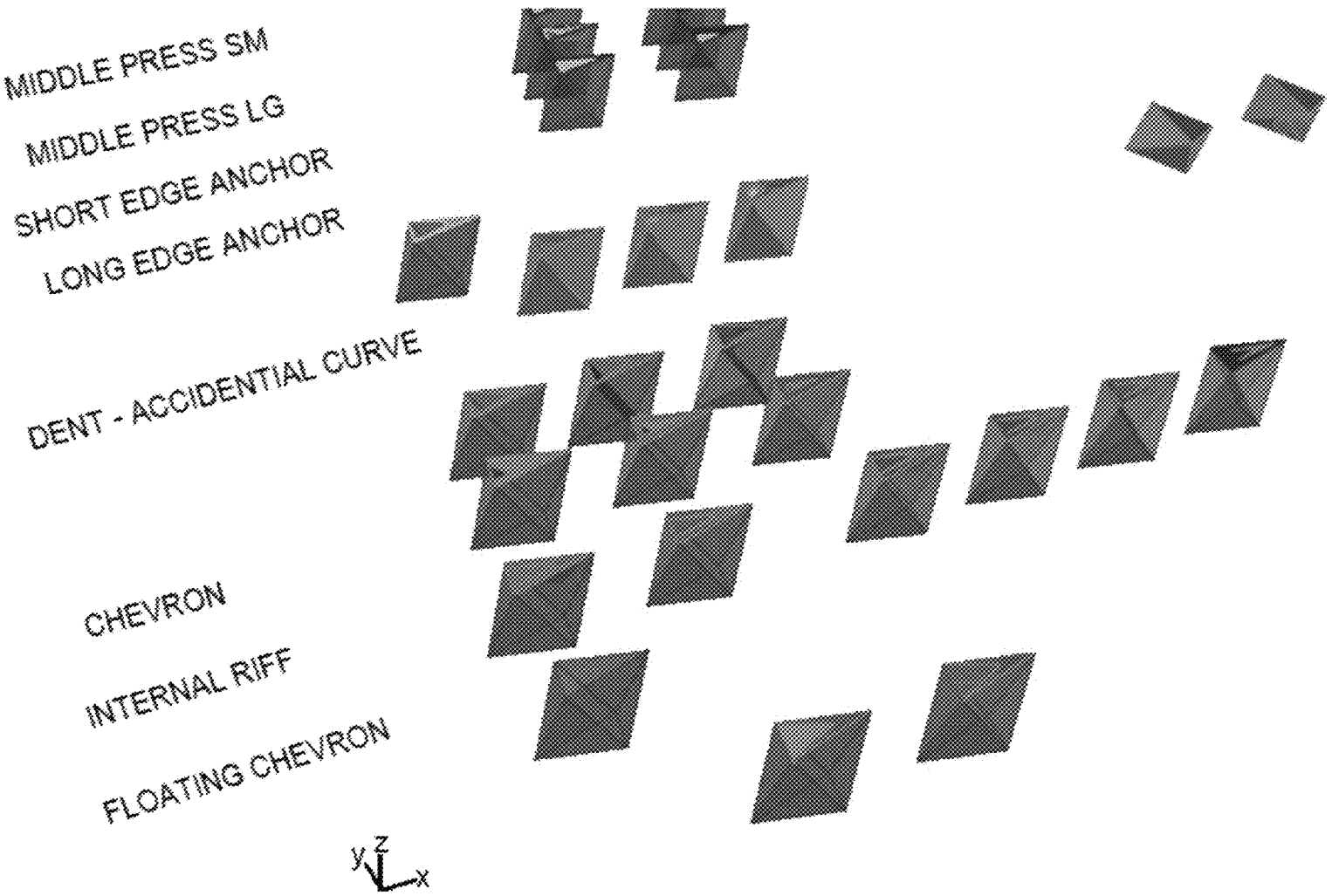
Figure 7C:
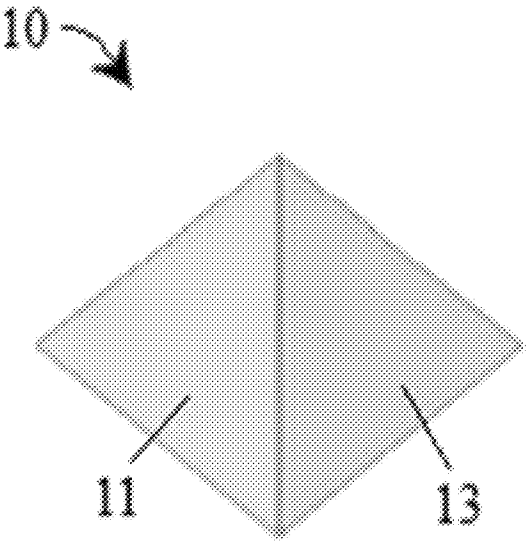
FIGS. 7A-7J: Views of non-limiting example building blocks with solid variations and void variations.
Figure 7A:
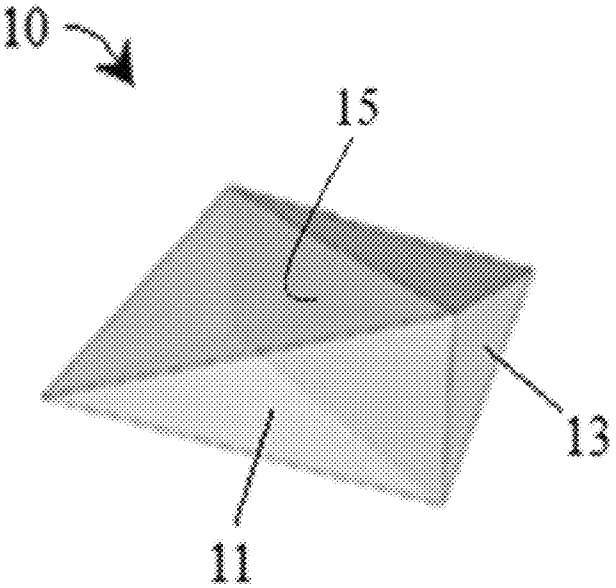
Figure 7B:
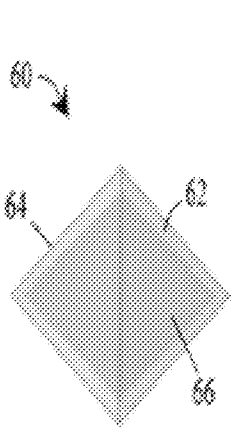
Figure 7D:
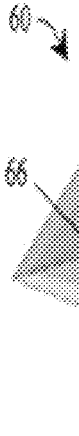
Figure 7E:
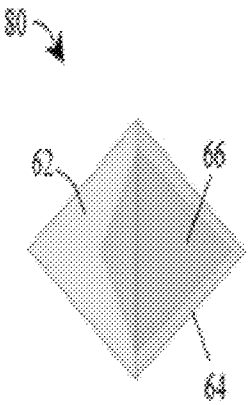
Figure 7F:
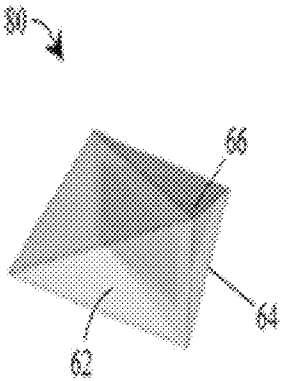
Figure 7G:
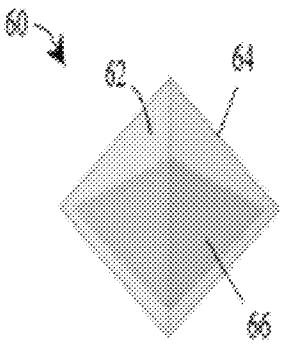
Figure 7H:
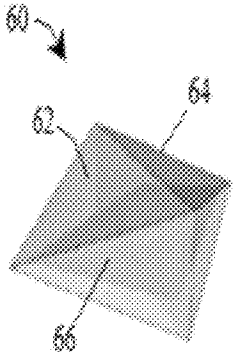
Figure 7I:
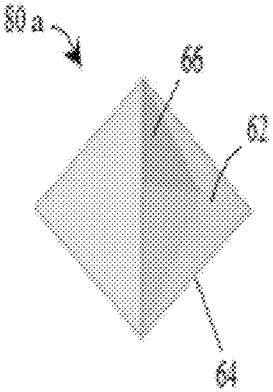
Figure 7J:
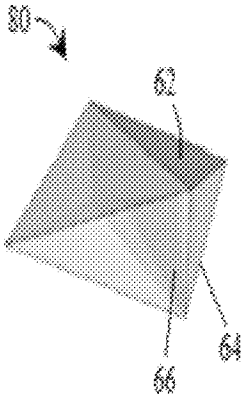
Figure 8E:
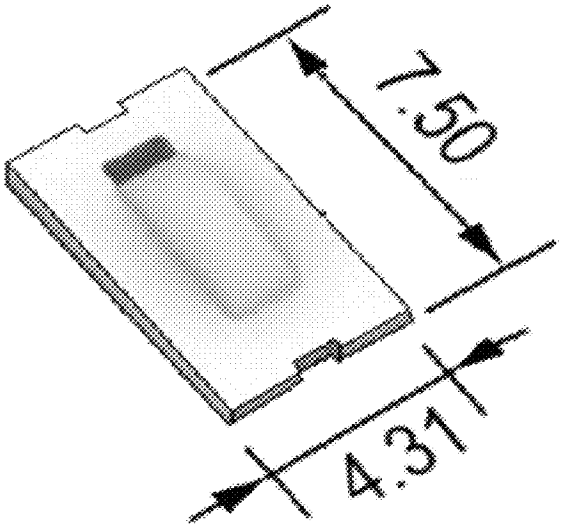
FIGS. 8A-8H: Views of molds used to fabricate non-limiting example building blocks from multiple pieces joined together.
Figure 8A:
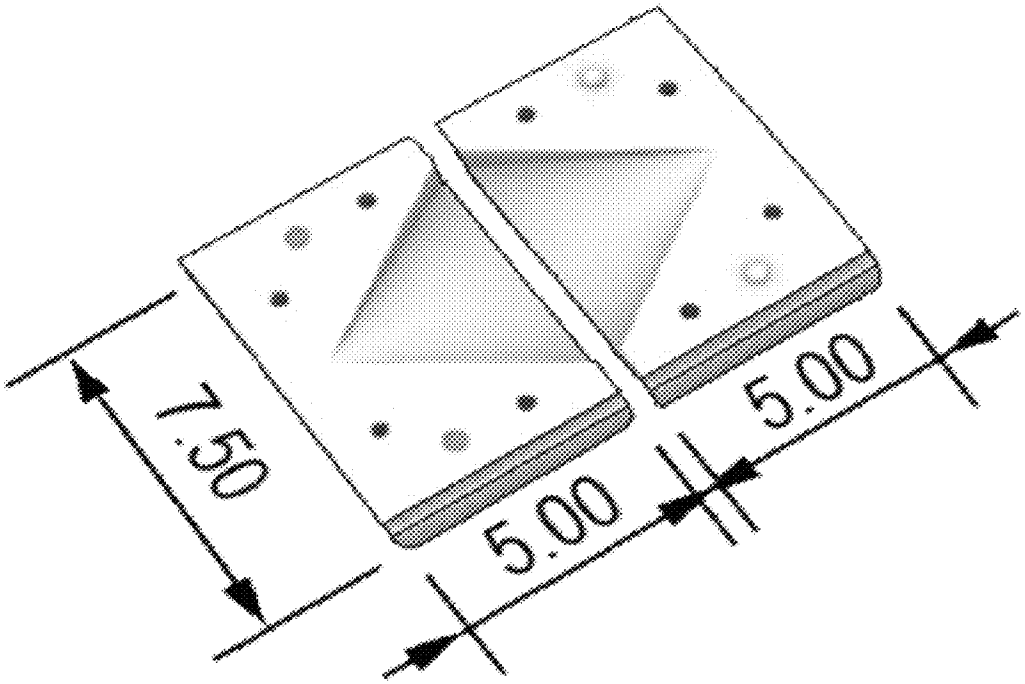
Figure 8F:
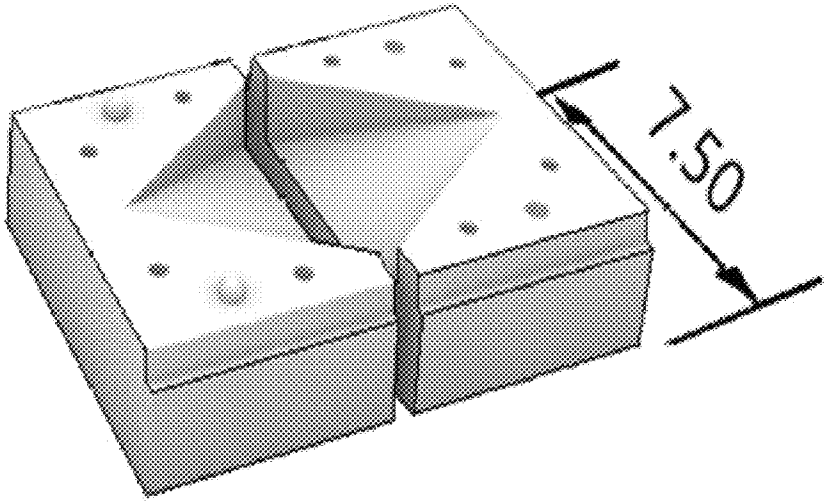
Figure 8B:
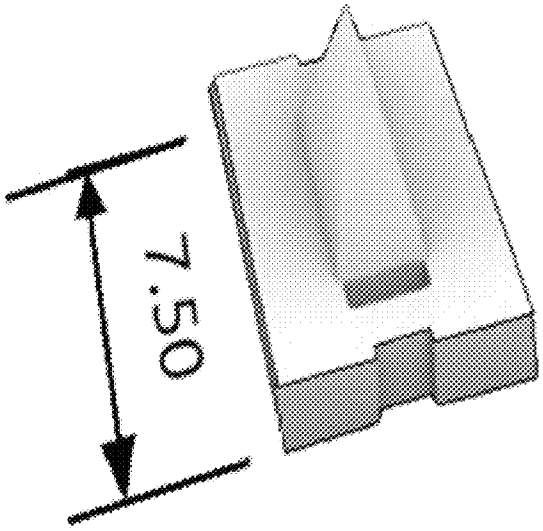
Figure 8G:
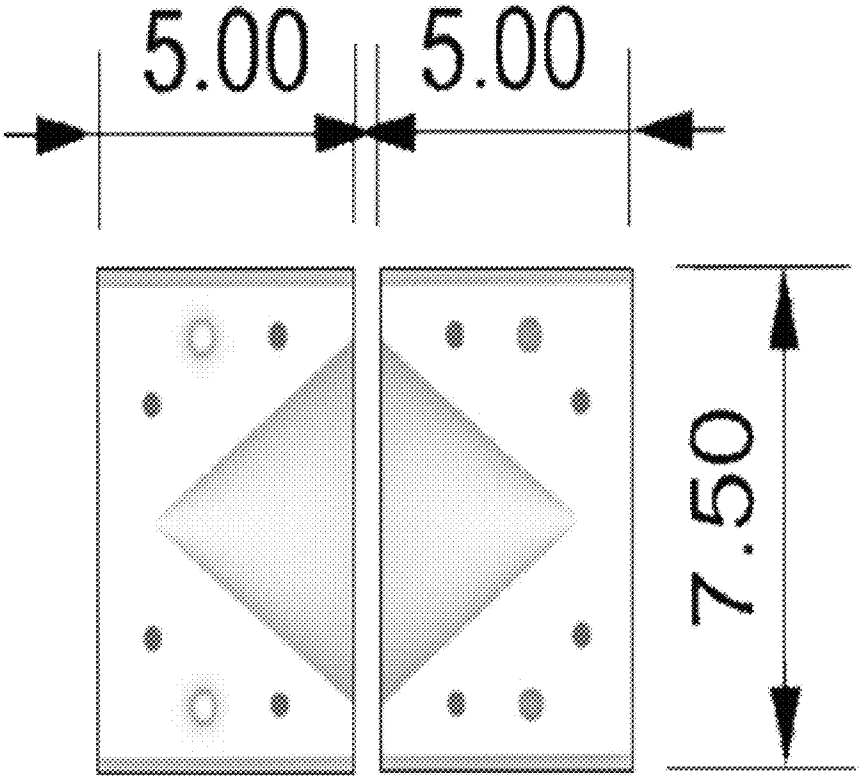
Figure 8C:
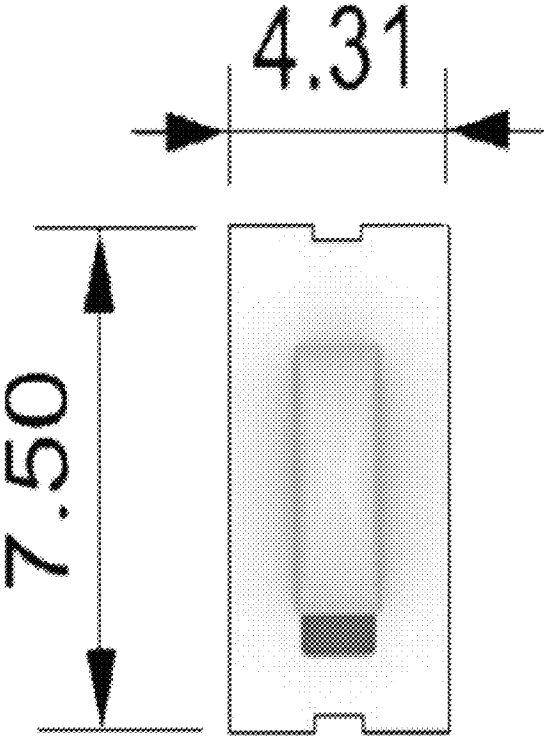
Figure 8H:
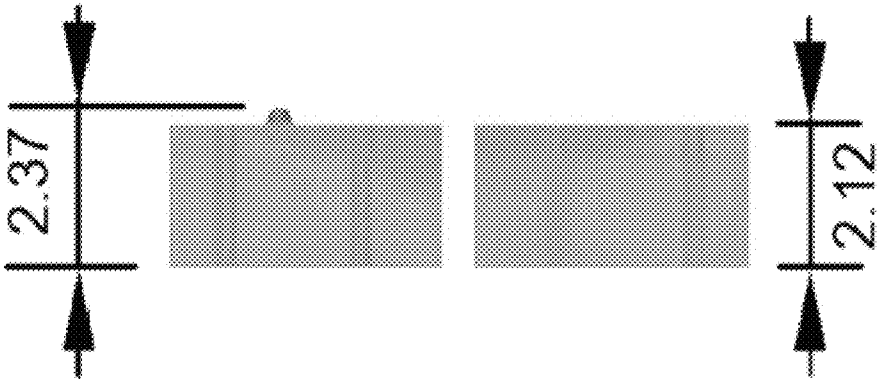
Figure 8D:
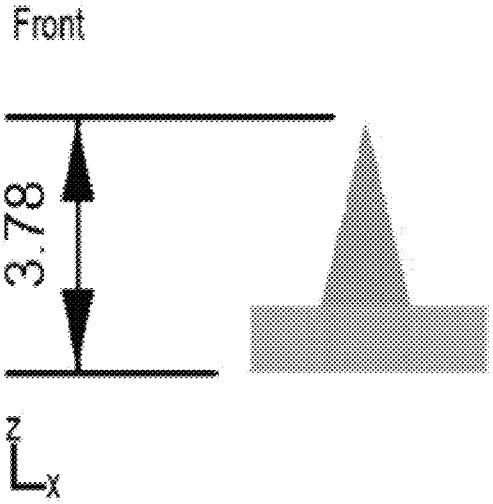

Referring now to FIGS. 6A and 6F-6G, voided building blocks 75 may also be made using a side press-in casting process, to create building blocks 75 with voids 74, 76, 78 that are impressions on the exterior (i.e., voids that are exposed to the outside by extending through the outer wall 64). FIGS. 6A-6G show nonlimiting examples of building blocks 75 formed from a side face press-in casting process that include a surface-contacting void 74, 76, 78. In one non-limiting example, a surface-contacting void 74 has the shape of a triangular prism. In another non-limiting example, a surface-contacting void 76 has a curved, semiellipsoidal shape. In another non-limiting example, a surface-contacting void 78 has the shape of a tetrahedron where the outer wall 64 of the building block 75 would make the fourth side of the tetrahedron. Many other shapes are possible and encompassed within the scope of the present disclosure. The side face press-in is a technique to force the other faces to be perfectly flat by pressing the glass from above with a plunger in the side face for a solid cast. In FIG. 6B, each half of the building blocks depicted has a side face press-in, creating options for the press to be on the same side or opposite sides. The press-in can go to different depths depending on the amount of glass within the mold. The various depth shapes can be changed by adjusting the press and the form of the press device. FIG. 6E depicts and labels various nonlimiting examples of side face press-in building block configurations.

FIGS. 7A-7J, 6A-6G show non-limiting example variations of the octahedral building blocks 10, 60, 80. As seen in FIGS. 7A-7J, the octahedral building block 10 can be made in solid form where both halves 11, 13 are solid, or may be made in a solid variation where one half 11, 13 is solid and the other half 11, 13 is voided or hollow. The building blocks 10 in FIGS. 7A, 7C each have two solid halves 11, 13, while one of the building blocks 80*a* depicted in FIG. 7I has a hollow first half 11 and a solid second half 13.

Furthermore, as shown in FIGS. 7B and 7D-7J, there are many variations of voided building block structures with internal voids that are possible. A voided octahedral building block may have a symmetrical structure, such as the building blocks 60 shown in FIGS. 7B, 7D, 7G, and 7H, or an asymmetrical structure, such as the building blocks 80 shown in FIGS. 7E, 7F, and 7J. Having a symmetrical structure in this context means the shape of the internal void 66 within the solid region 62 of one half 11, 13 of the building block 60, 80 mirrors the shape of the internal void 66 within the solid region 62 of the other half 11, 13 of the building block 60, 80. Having an asymmetrical structure in this context means the shape of the internal void 66 within the solid region 62 of one half 11, 13 of the building block 60, 80 does not mirror the shape of the internal void 66 within the solid region 62 of the other half 11, 13 of the building block 60, 80. While FIGS. 7A-7J show octahedral building blocks 10, 60, 80, all of the same variations are possible in decahedral building blocks 50 (FIG. 1B), 70 (FIG. 1D), 90 (FIG. 1F) and such decahedral building blocks 50, 70, 90 are encompassed within the scope of the present disclosure.

Additionally, an asymmetrical structure for a voided building block may also refer to a building block with an internal void 66 that is within one of the halves 11, 13 and is not symmetrical in the one of the halves 11, 13, or is not symmetrical with the solid region 66. This is shown, for example, in FIGS. 2B and 2H-2M. Many different configurations and combinations of void shapes are possible and encompassed within the scope of the present disclosure.

The building blocks described herein can be made through any suitable production technique including, but not limited to, bottle blowing, hot casting, and press molding, all of which are conducive to mass scale production. Depending on the materials used and whether the building block is constructed out of two or more pieces joined together, one or more molds may be used, such as the molds depicted in FIGS. 8A-8H, for fabricating the building blocks. Graphite molds as depicted in FIGS. 8A-8H have been used to make example eight-sided building blocks that were solid hot cast from the graphite molds. The same molds depicted in FIGS. 8A-8H can be used to fabricate ten-sided building blocks by simply placing corner inserts in the molds to prevent the opposing bottom apex corners from being fabricated. The dimensions shown in FIGS. 8A-8H are included for exemplary purposes only, and are in no way limiting. Molds having different dimensions, useful for making building blocks having different dimensions, are encompassed within the scope of the present disclosure.

Figure 9A:
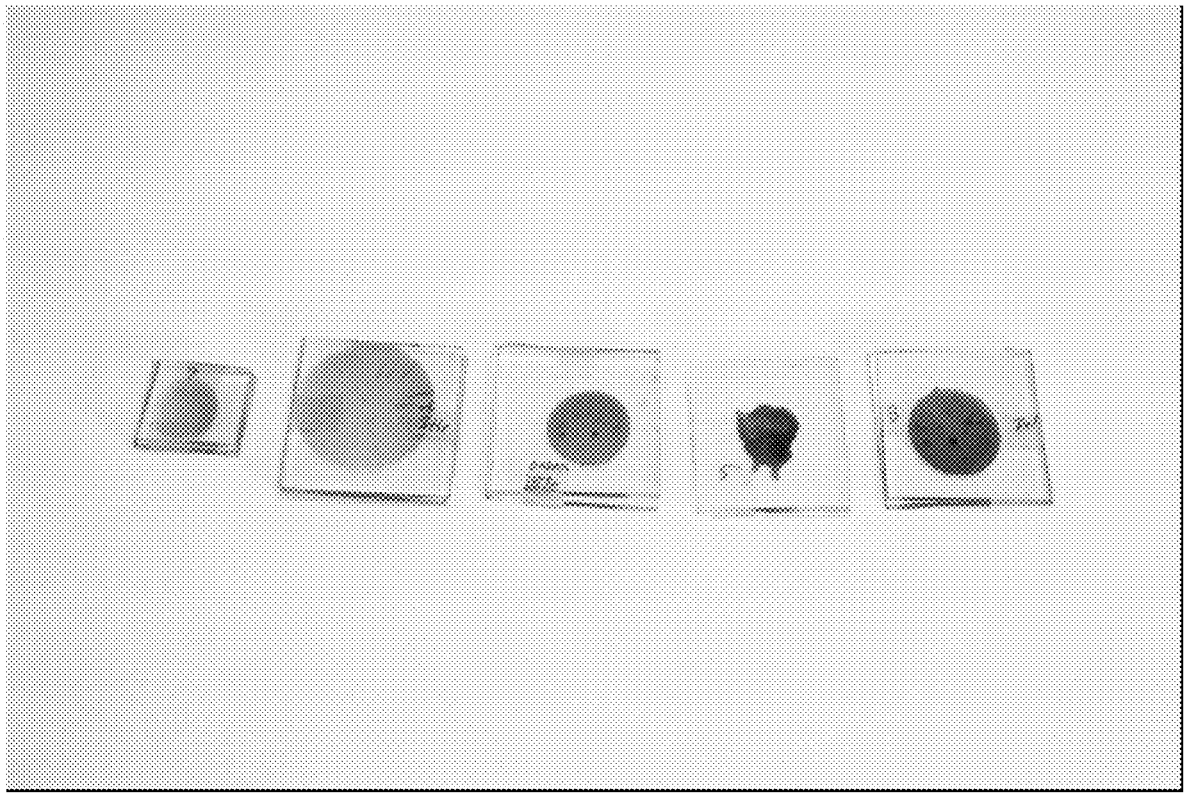
FIGS. 9A-9C: Photographs showing colors from adhesive with orasol dye at a 14% dye-to-adhesive ratio (FIGS. 9A-9B), and a photograph showing time testing results for homogeneous adhesives (FIG. 9C).
Figure 9B:
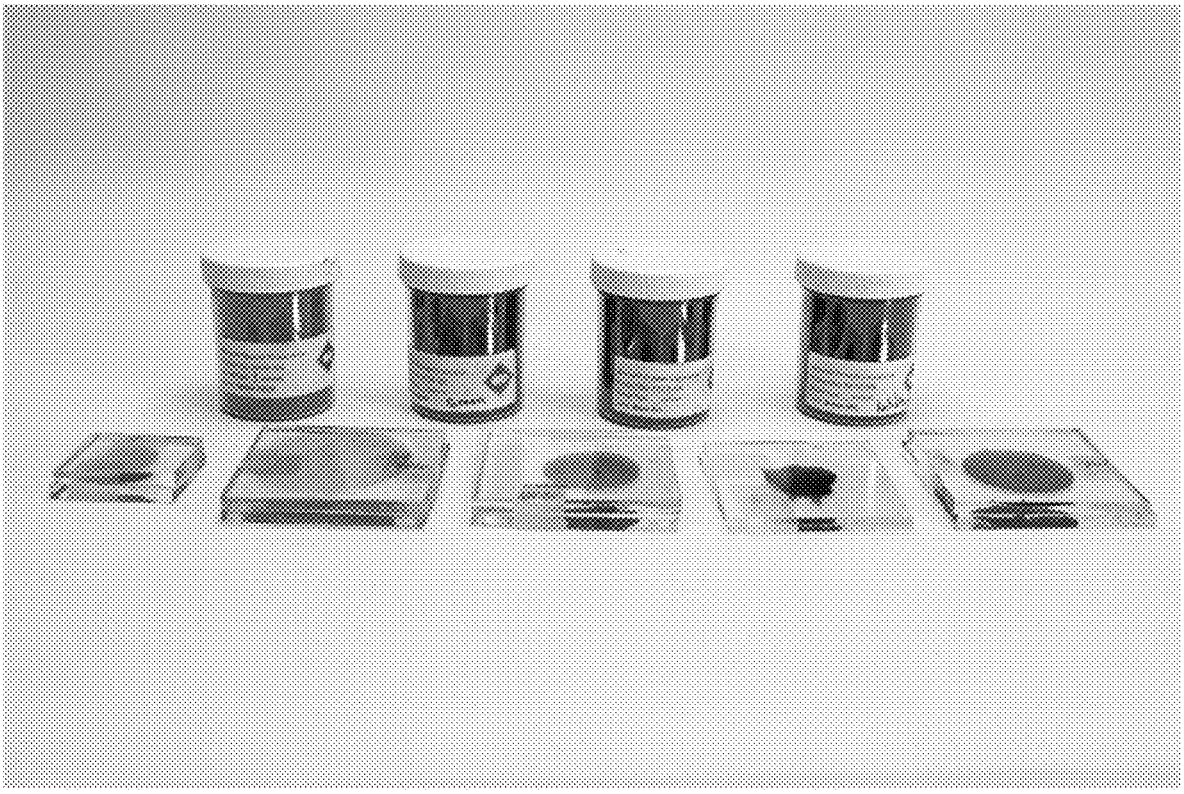
Figure 9C:
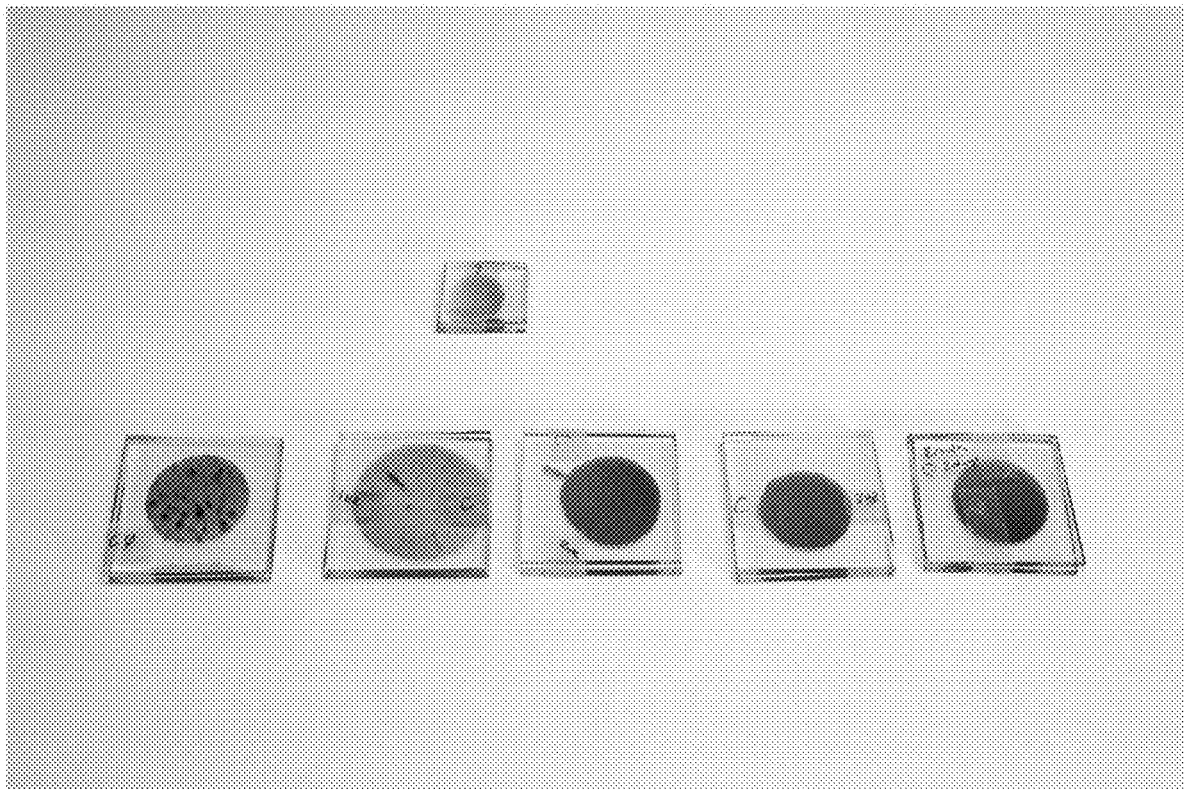

Regardless of the production technique used, two halves 11, 13 can be produced separately and glued or otherwise adhered together to form a building block. Referring now to FIGS. 7A-7J, adhesive may be applied along the plane 15 (also referred to as a glue joint) where the first half 11 meets the second half 13. That is, adhesive may be applied to one or both of the first half 11 and the second half 13 where the halves 11, 13 meet to form the plane 15. A variety of different adhesives can be used to join the two halves of a building block. Non-limiting examples include Delo UV glue, ultra clear silicone, epoxy, 3M high bond tapes, and combinations thereof. Coloring of the adhesive layer presents an opportunity for certain visual effects from the building blocks. The adhesive can be mixed with a dye (in powder or liquid form) in order to provide color to the adhesive and thereby introduce color at the glue joint 15. For example, a mixture of 0.25% dye-to-adhesive ratio can be used. FIGS. 9A-9B show non-limiting example colors of example adhesives mixed with an Orasol dye and UV-cured between glass panes.

Figure 10A:
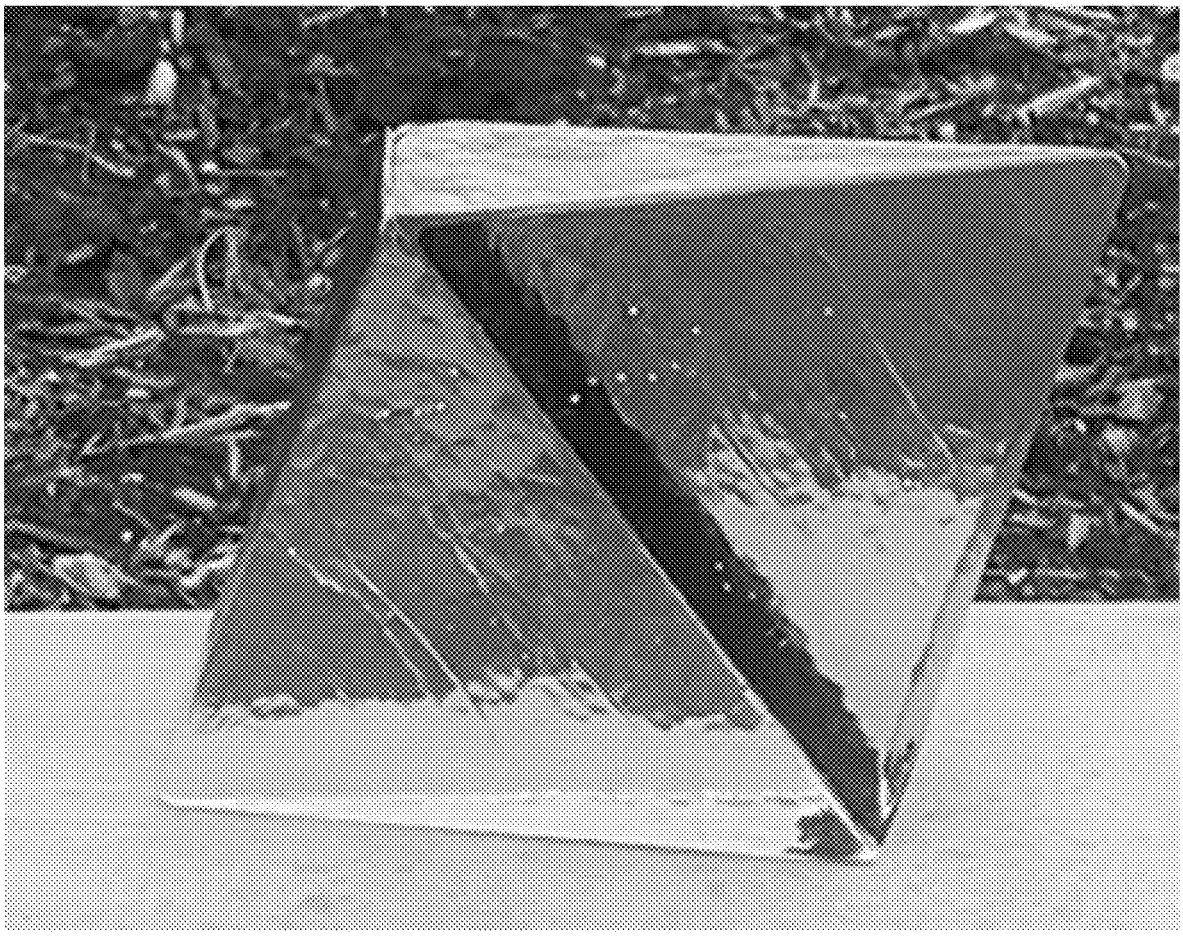
FIGS. 10A-10C: Photographs of the same building block from three different angles, where at a first angle no color is seen in either half of the building block (FIG. 10A), at a second angle a first half of the building block has a bluish color while the second half of the building block appears colorless (FIG. 10B), and at a third angle the second half of the building block has a bluish color while the first half of the building block appear colorless (FIG. 10C).
Figure 10B:
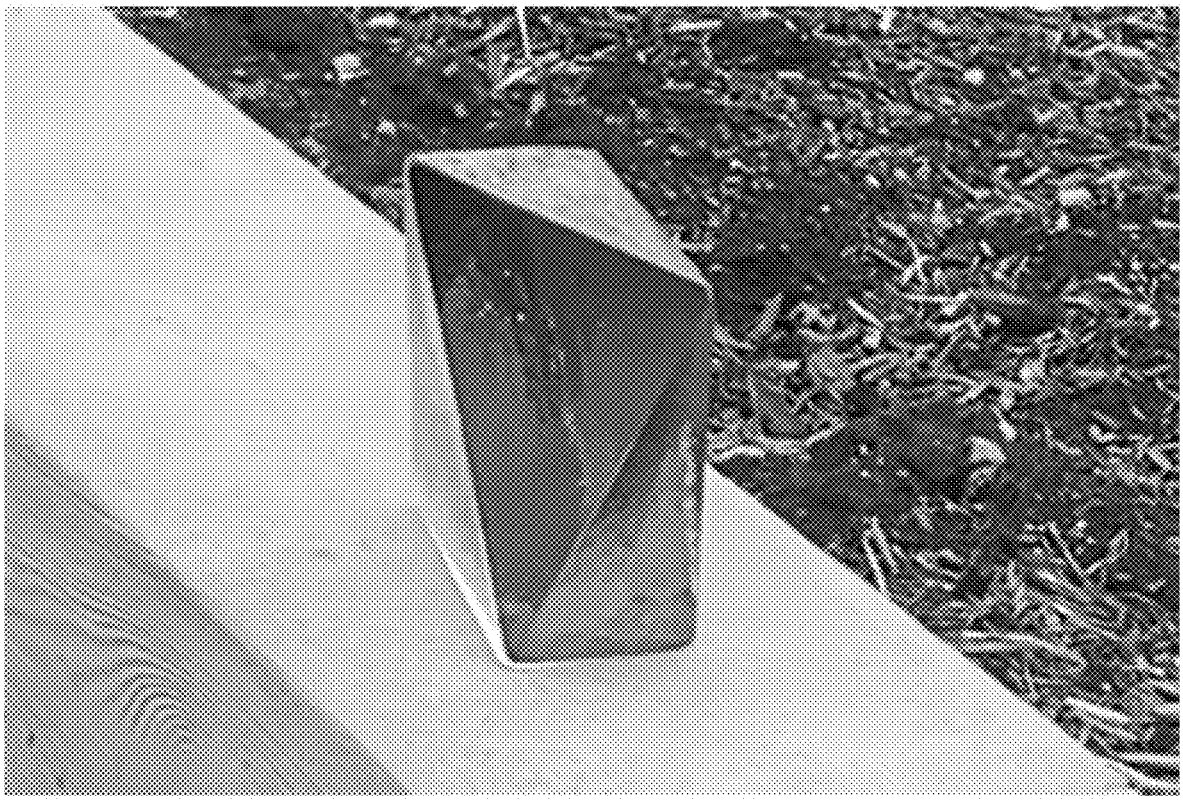
Figure 10C:
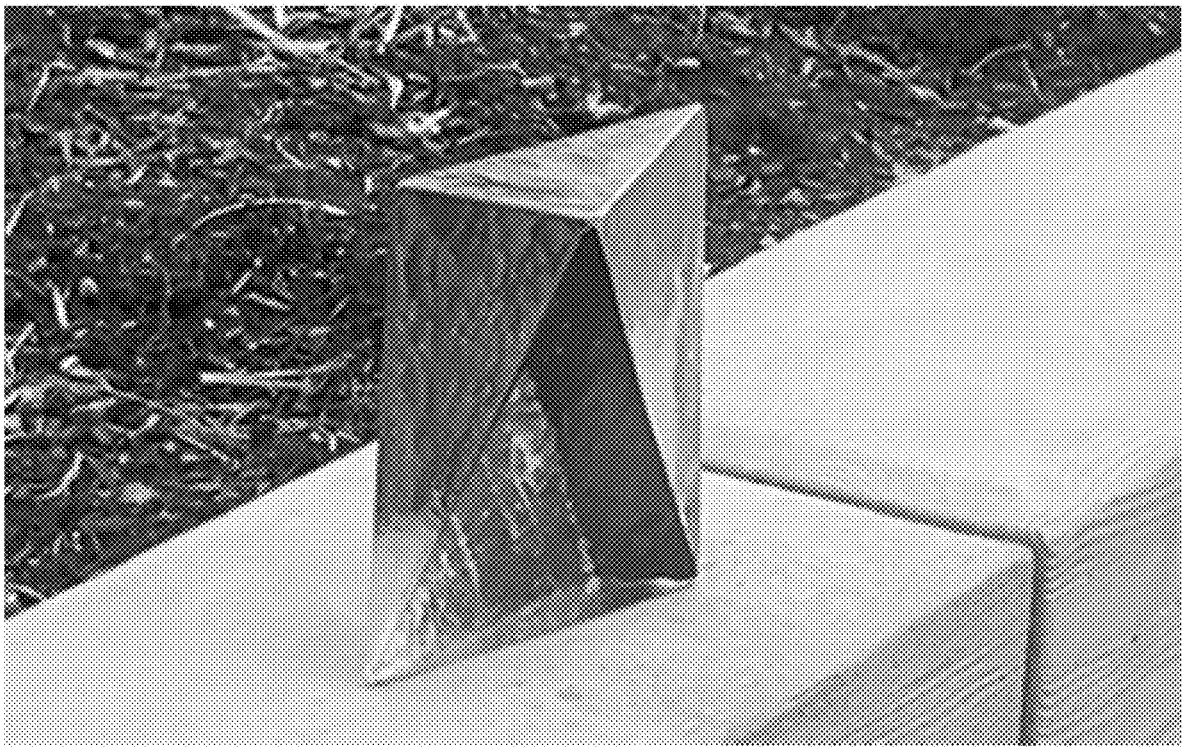

Upon dying the glue joint 15, there can be a thin veil of color that will fade in and out of view depending on the position of the viewer and the building block. Because the glue joint 15 between the two halves 11, 13 is such a thin connection, from different vantage points, the color either really makes a visual impact, or is hard to see. This may be utilized to orient a building environment to the sun, where the colored glue joint 15 can soften transmission into the space and also offer privacy. In any event, it is possible to create building blocks with different colored appearances based on the angle from which they are viewed simply by dying the glue joint between halves of the building block. This is seen in the photographs shown in FIGS. 10A-10C. At a first angle, seen in FIG. 10A, the building block appears colorless except for some color along the glue joint. At a second angle, seen in FIG. 10B, a first half of the building block takes on a bluish color while the second half of the building block appears colorless. At a third angle, seen in FIG. 10C, the second half of the building block takes on a bluish color while the first half appears colorless.

The building blocks described herein may be fit or arranged together in a variety of ways or aggregations, in order to make architectural structures such as walls. The same types of adhesives identified above can be used to adhere adjacent faces in these aggregations of building blocks.

Referring now to FIGS. 11-15, there are many different ways in which a plurality of the building blocks 10 can be fit or arranged together, and bonded together with a suitable adhesive such as a transparent acrylate adhesive (which may or may not involve curing such as UV curing process), to make a wall structure 100, 200, 300, 400, 500. The resulting wall structures 100, 200, 300, 400, 500 have different optical and strength characteristics. A building system that includes one or more such wall structures 100, 200, 300, 400, 500 is useful for building a structure that improves an occupant's connection to natural light cycles.

Figure 11A:
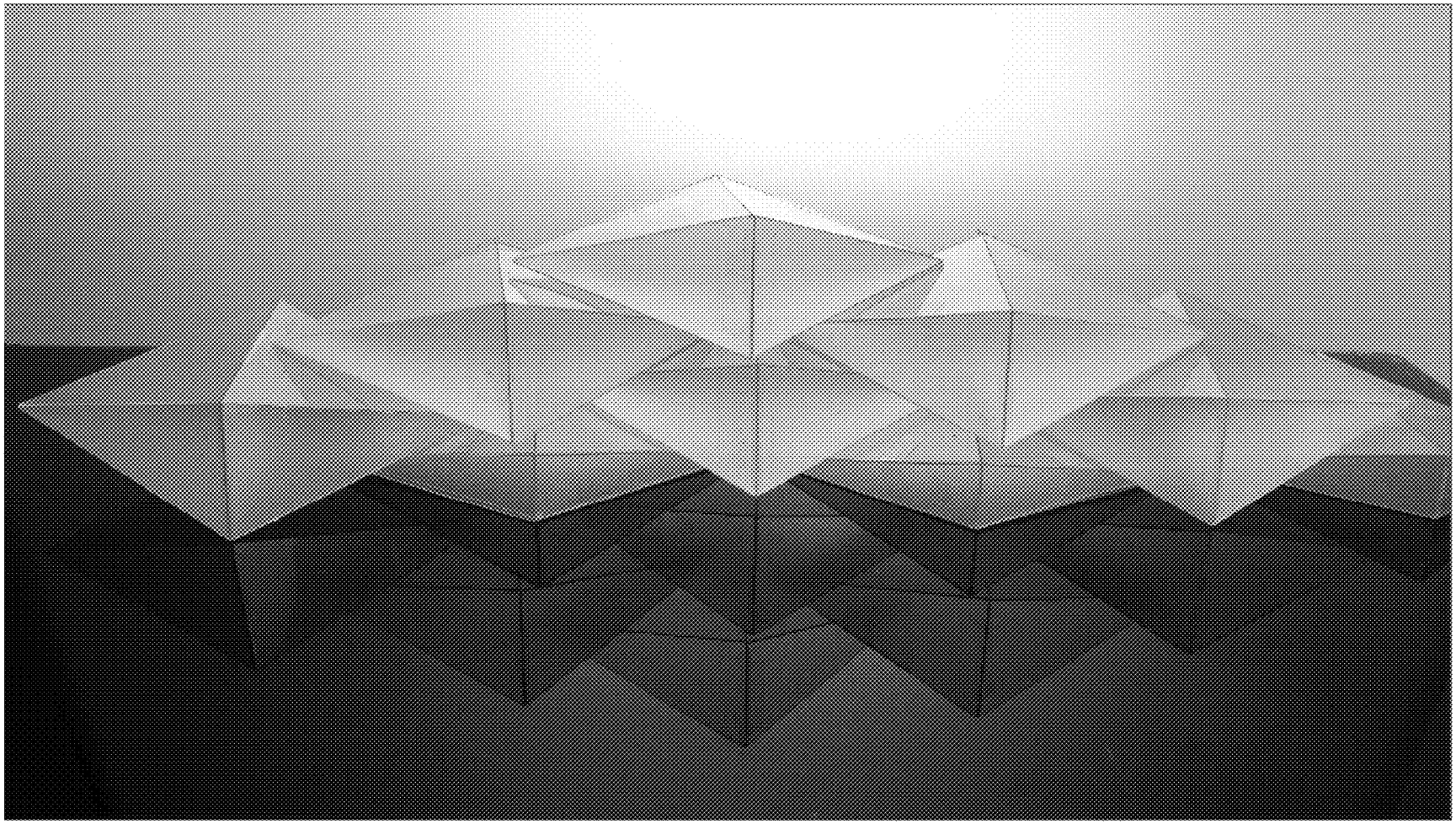
FIGS. 11A-11I: Photograph of a wall structure made from building blocks in accordance with the present disclosure (FIG. 11A), and illustrations of the wall structure from different angles (FIGS. 11B-11I).
Figure 11D:
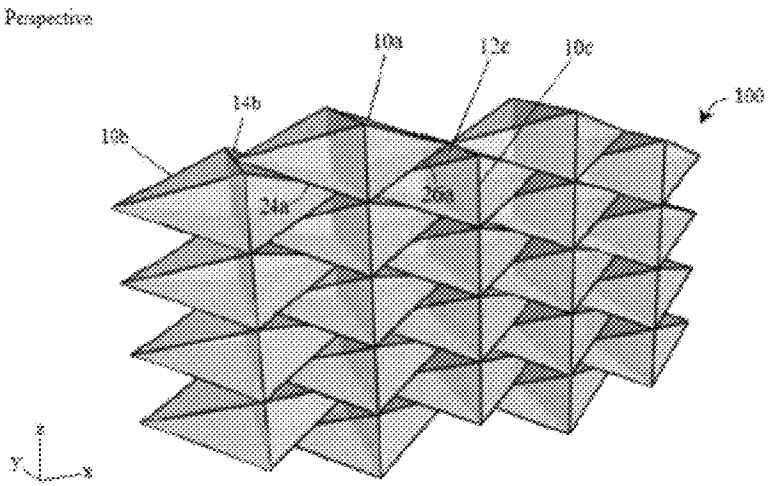
Figure 11F:
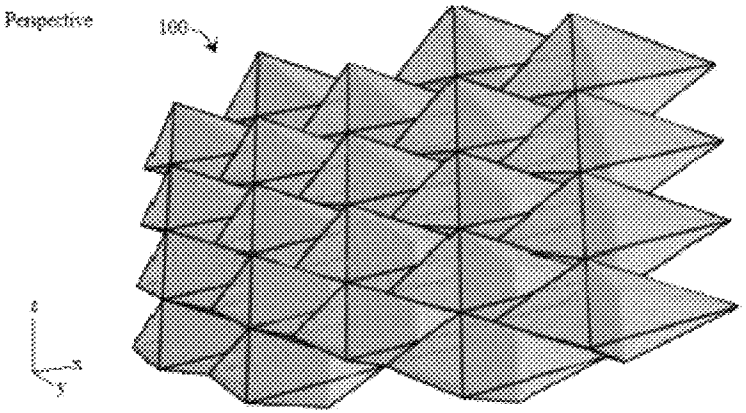
Figure 11B:
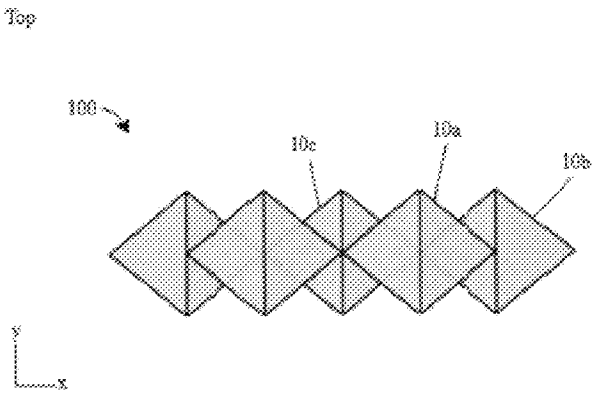
Figure 11E:
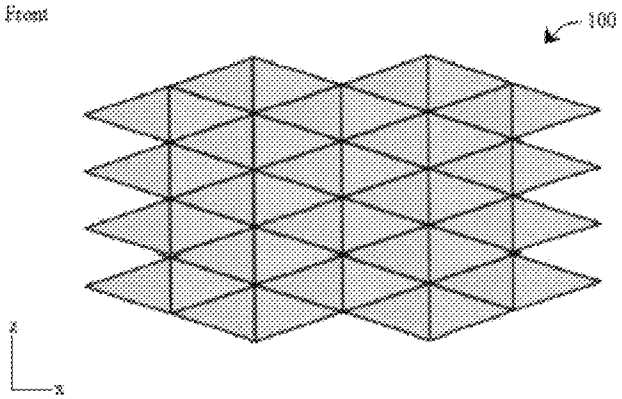
Figure 11G:
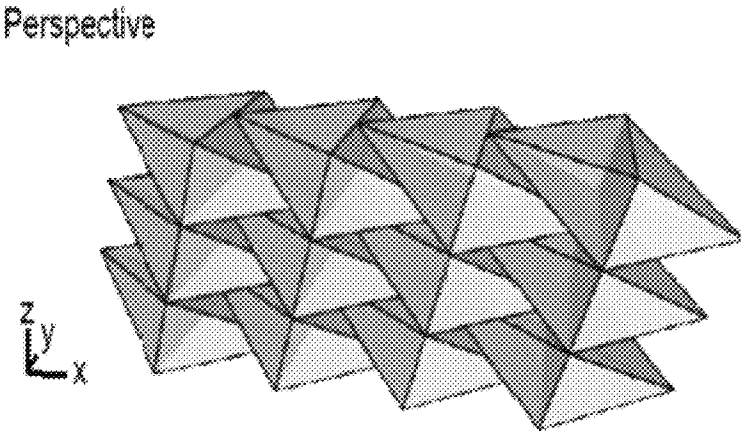
Figure 11C:
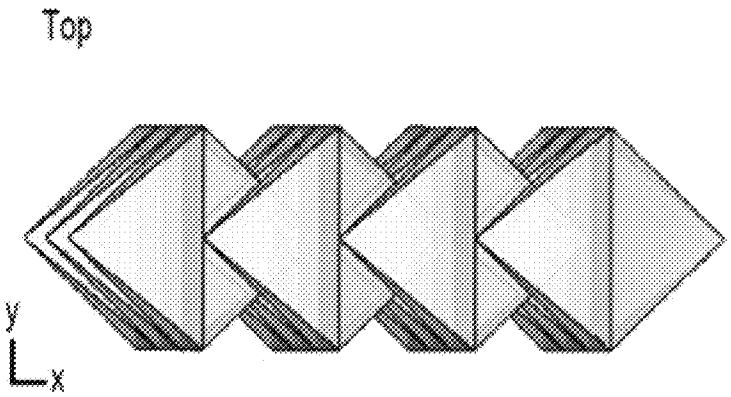
Figure 11I:
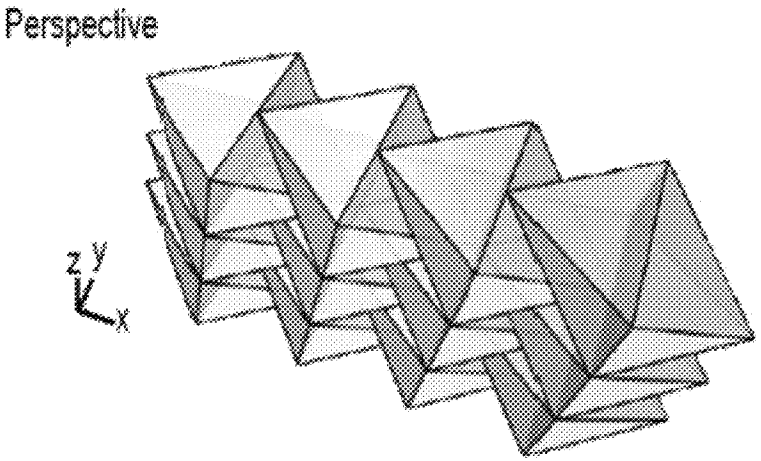
Figure 11H:
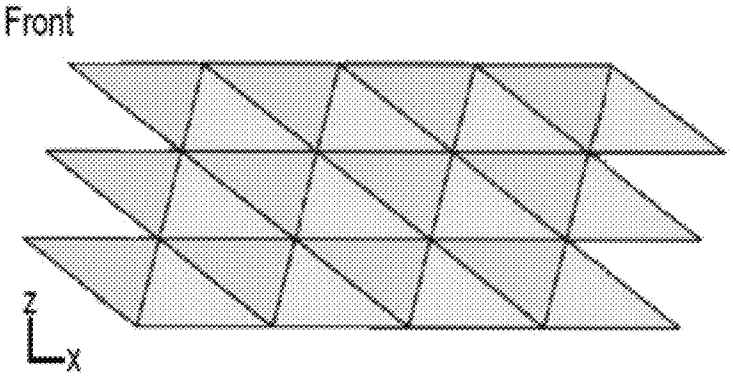
Figure 13A:
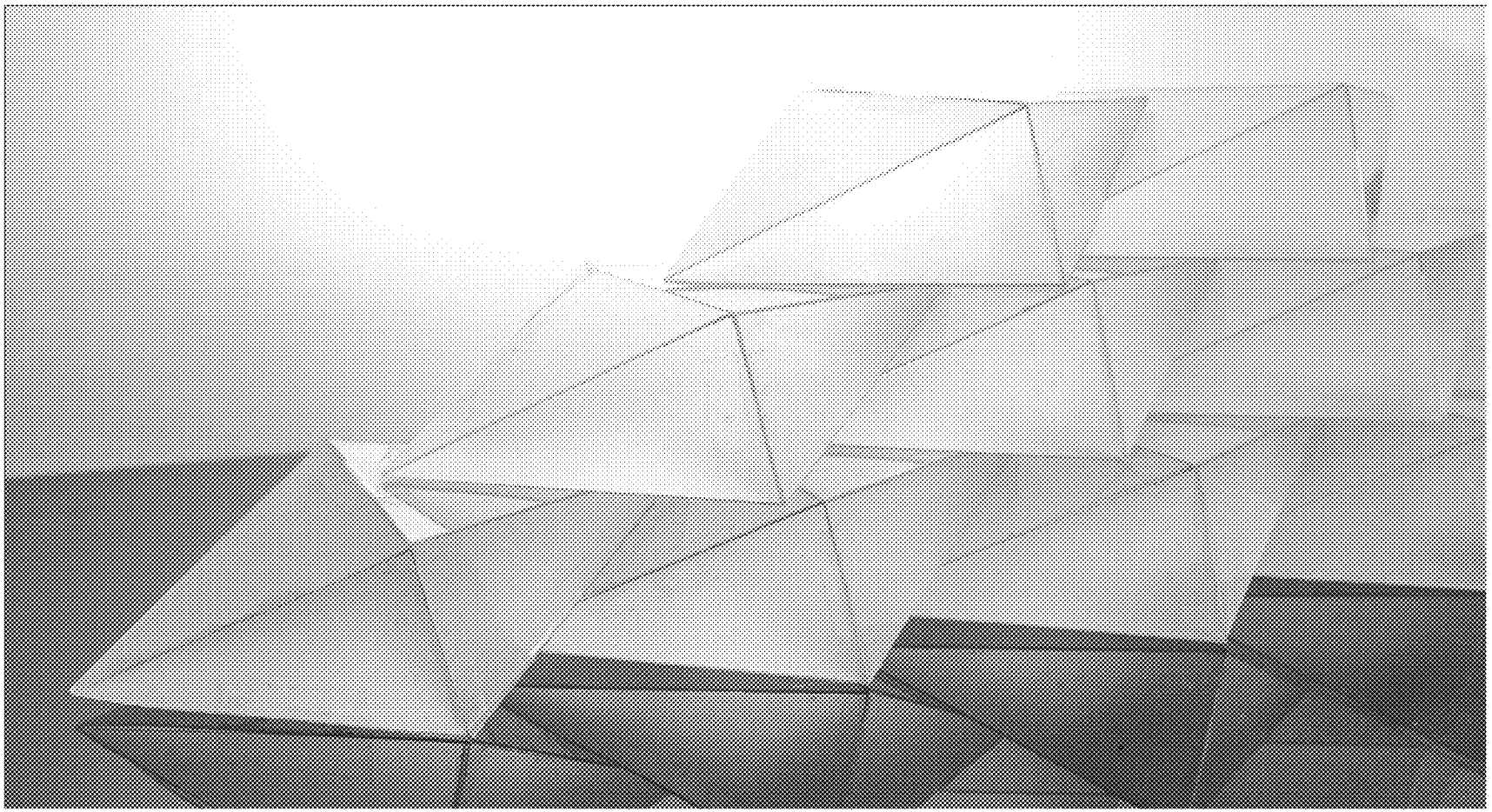
FIGS. 13A-13M: Photographs of a wall structure made from building blocks in accordance with the present disclosure (FIGS. 13A-13C), and illustrations of the wall structure from different angles (FIGS. 13D-13M).
Figure 13B:
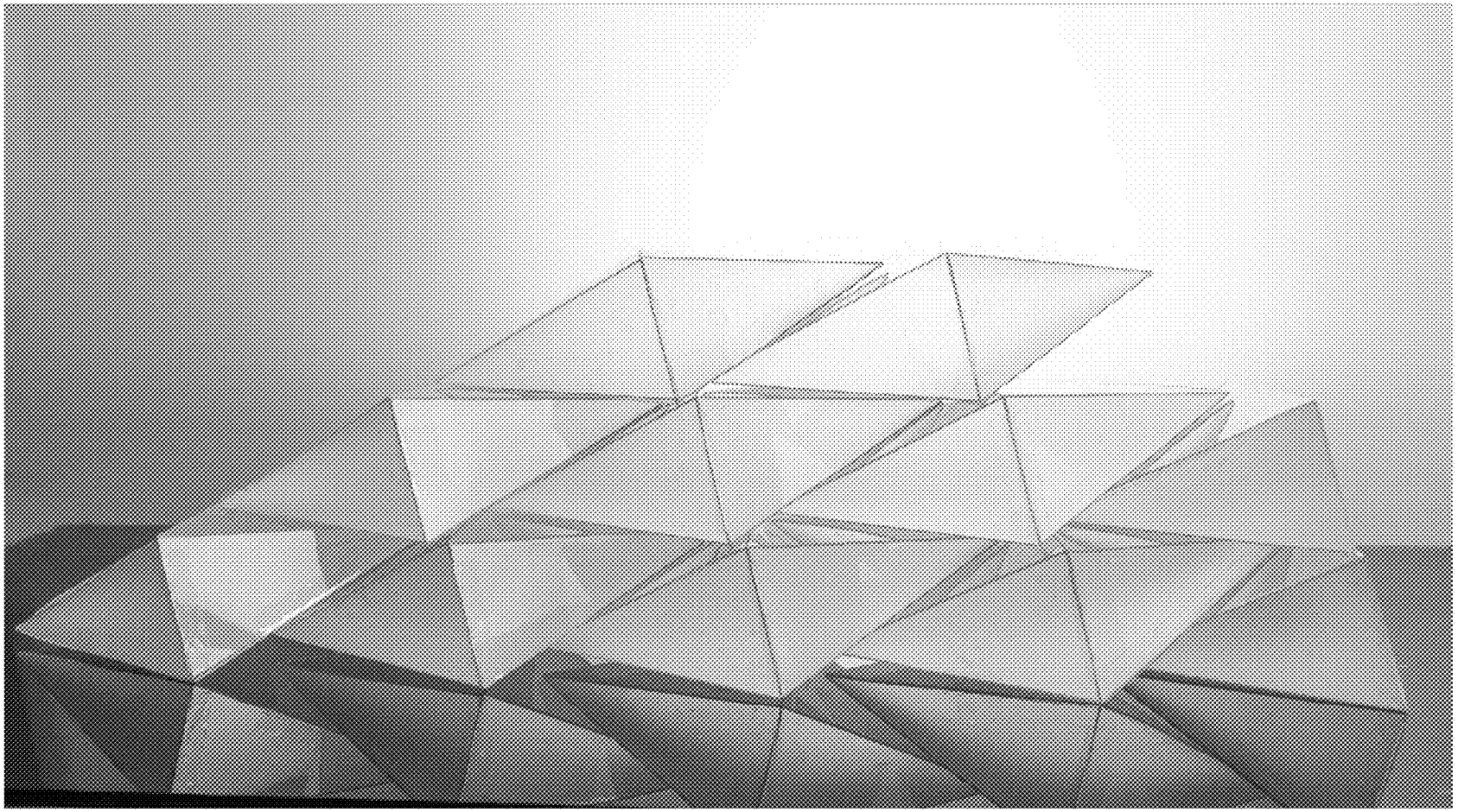

As seen in FIGS. 11A, 13A, and 13B, and referring to FIGS. 11B-11I, a wall structure 100 can be formed in which a first building block 10*a* is stacked on top of second and third building blocks 10*b*, 10*c* such that the first bottom face 24*a* of the first building block 10*a* rests on the second top face 14*b* of the second building block 10*b*, and the second bottom face 26*a* of the first building block 10*a* rests on the first top face 12*c* of the third building block 10*c*. In this example, each of the building blocks 10*a*, 10*b*, 10*c* has the same relative dimensions. However, the wall structure 100 can be built using building blocks 10*a*, 10*b*, 10*c* having different relative dimensions. The aggregation pattern of building blocks 10 in the wall structure 100 depicted in FIG. 11A may be referred to as a low horizontal pattern, while the aggregation pattern of building blocks 10 in the wall structure depicted in FIGS. 11€ 11C, 11G, 11H, 11I, 13B may be referred to as an angled lean pattern.

Figure 12A:
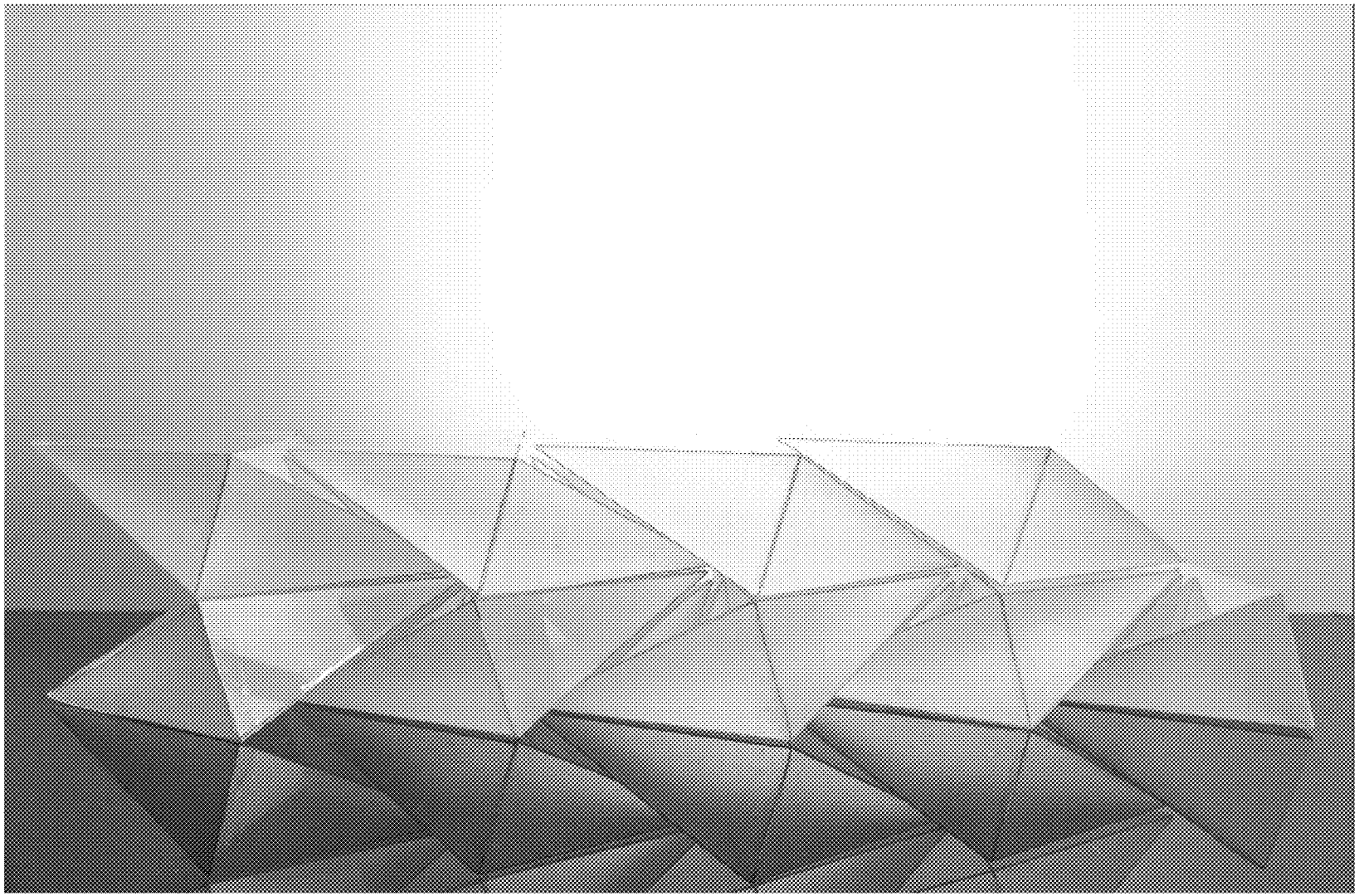
FIGS. 12A-12E: Photograph of a wall structure made from building blocks in accordance with the present disclosure (FIG. 12A), and illustrations of the wall structure from different angles (FIGS. 12B-12E).
Figure 12C:
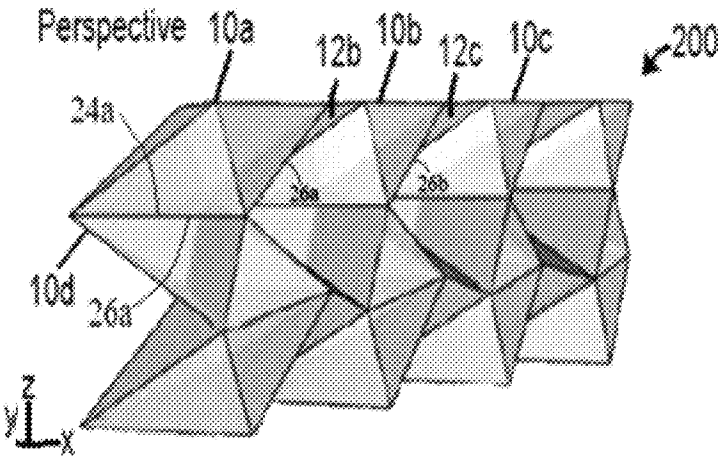
Figure 12E:
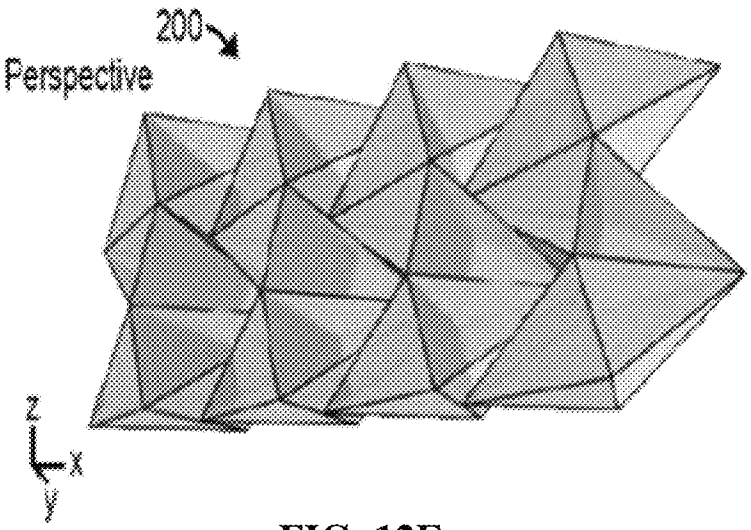
Figure 12B:
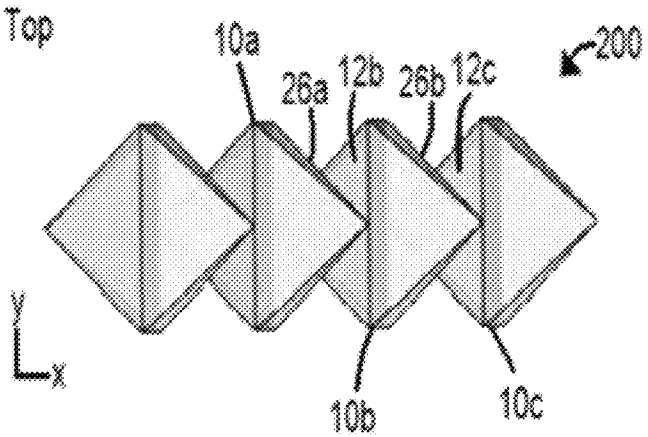
Figure 12D:
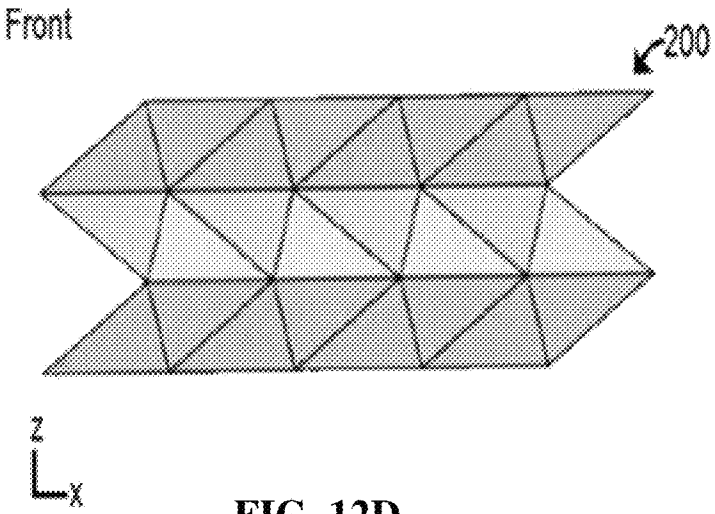

As seen in FIG. 12A and referring to FIGS. 12B-12E, a wall structure 200 can be formed in which the second bottom face 26*a* of a first building block 10*a* rests on the first top face 12*b* of a second building block 10*b*, while the second bottom face 26*b* of the second building block 10*b* rests on the first top 12*c* face of a third building block 10*c*. Further, the first bottom face 24*a* of the first building block 10*a* rests on the first top face 12*d* of the fourth building block 10*d*. In this example, each of the building blocks 10*a*, 10*b*, 10*c* has the same relative dimensions. However, the wall structure 200 can be built using building blocks 10*a*, 10*b*, 10*c*, 10*d* having different relative dimensions. The aggregation pattern of building blocks 10 in the wall structure 200 may be referred to as a switch pattern.

Figure 13C:
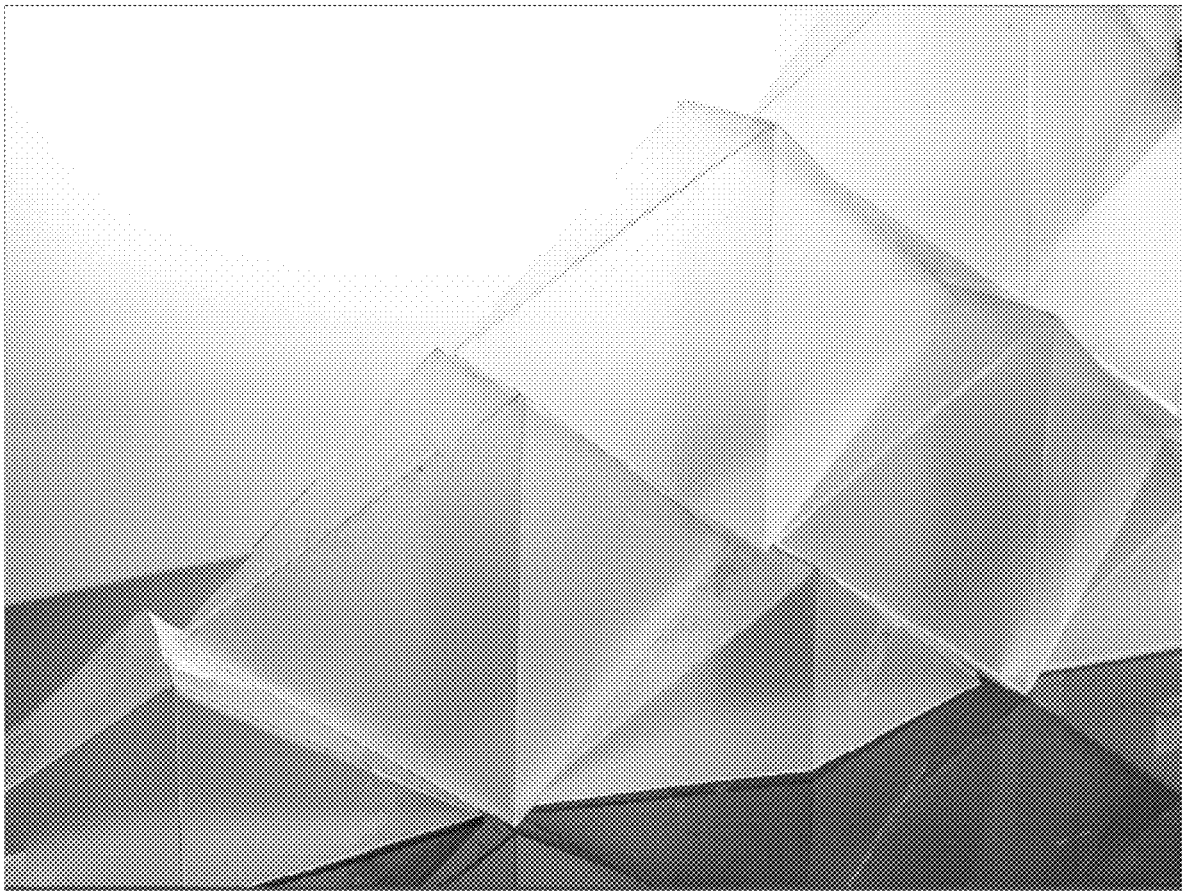
Figure 13D:
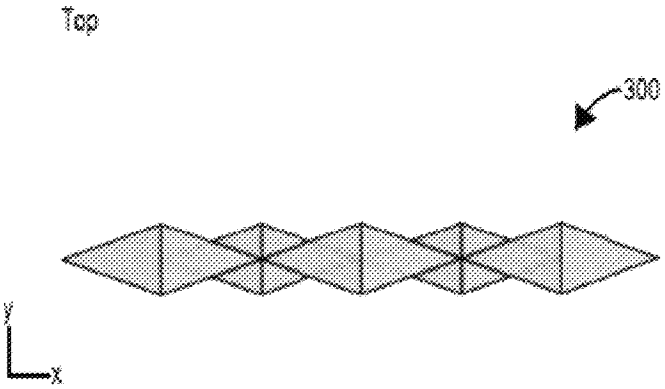
Figure 13F:
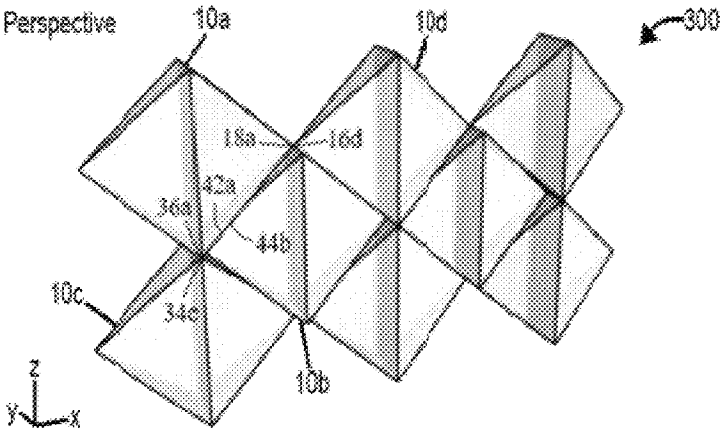
Figure 13G:
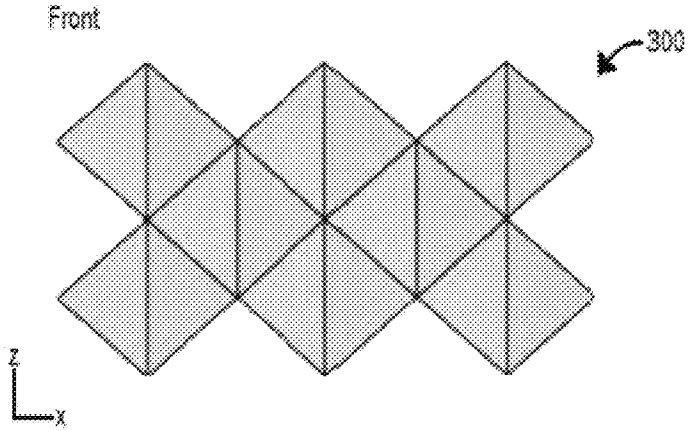
Figure 13H:
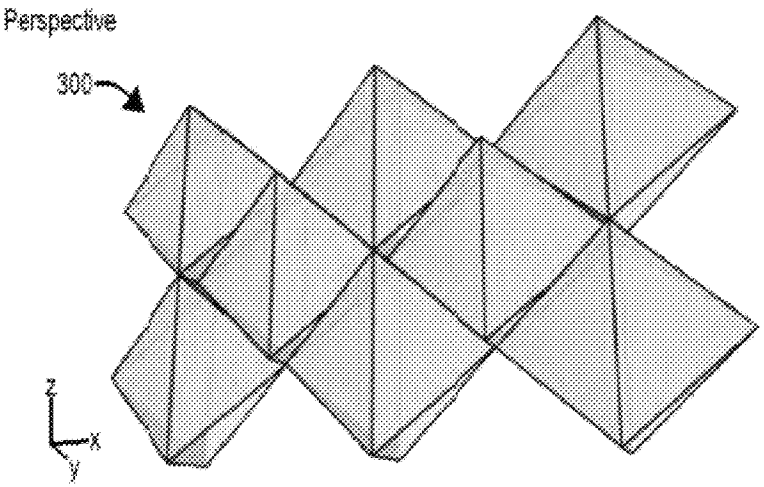
Figure 13E:
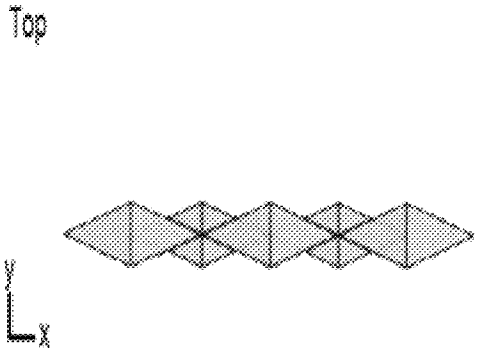
Figure 13I:
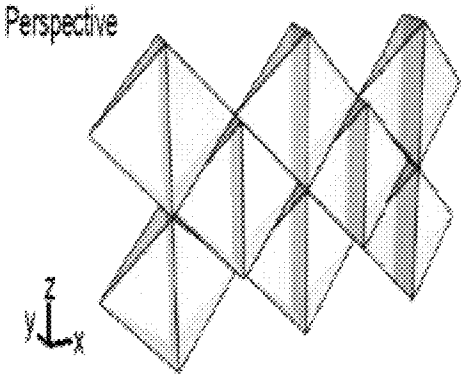
Figure 13J:
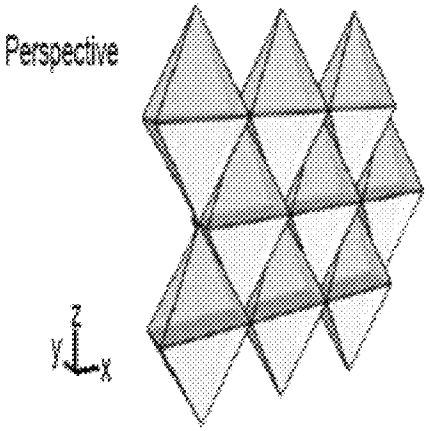
Figure 13K:
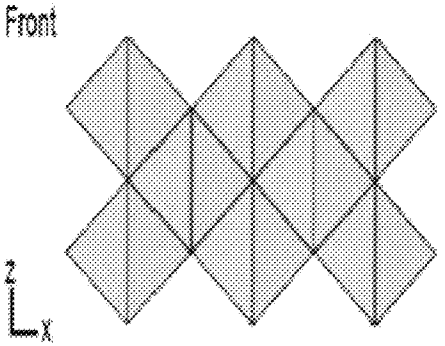
Figure 13L:
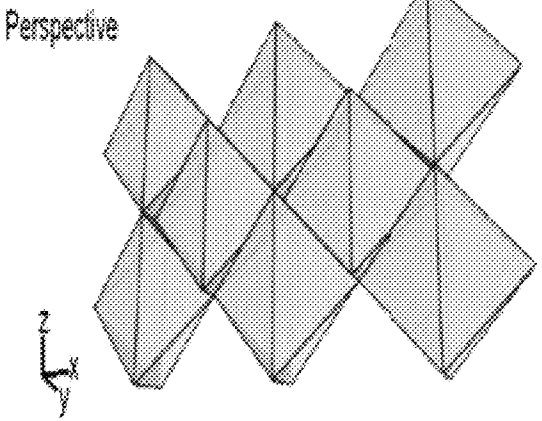
Figure 13M:
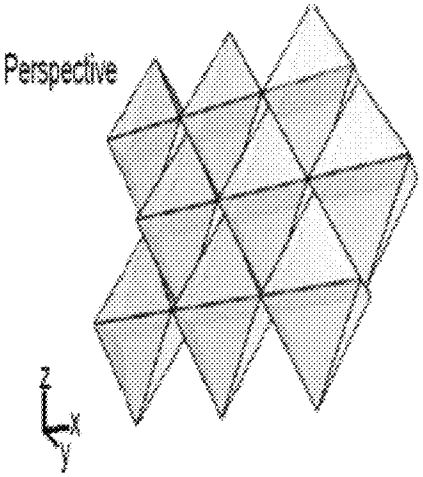
Figure 14B:
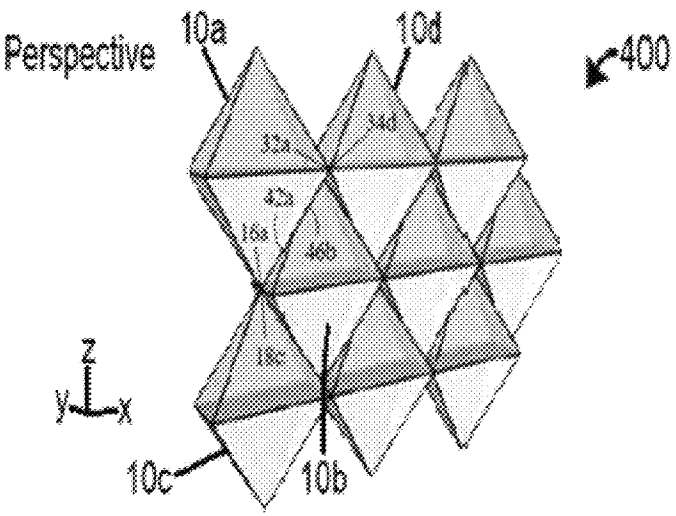
FIGS. 14A-14D: Illustrations of a wall structure from different angles.
Figure 14D:
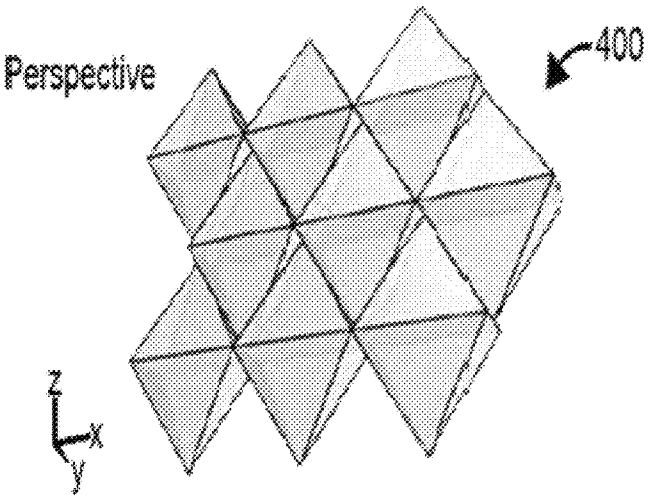
Figure 14A:
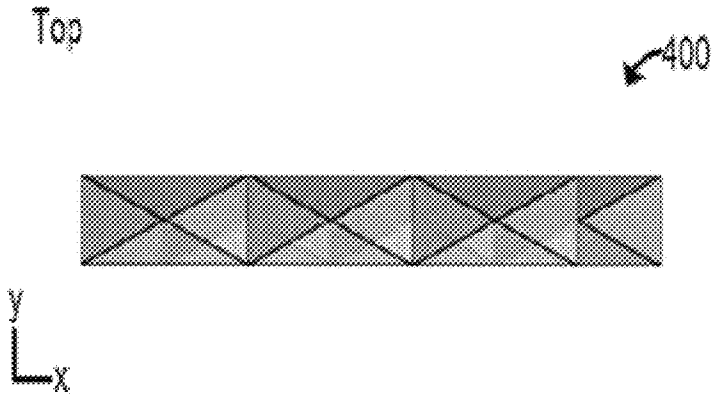
Figure 14C:
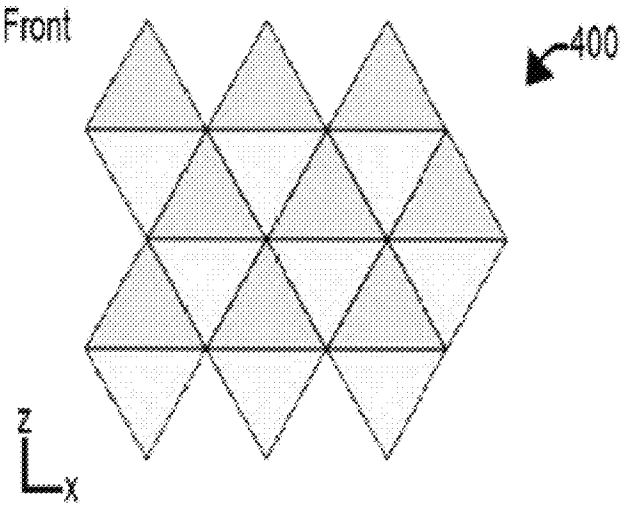

As seen in FIG. 13C and referring to FIGS. 13D-13M, a wall structure 300 can be formed in which a second side face 42*a* of a first building block 10*a* rests on a third side face 44*b* of a second building block 10*b*. The first top corner 36*a* of the first building block 10*a* contacts the second top corner 34*d* of a third building block 10*c*, and the second bottom apex corner 18*a* of the first building block 10*a* contacts the first bottom apex corner 16*d* of a fourth building block 10*d*. In this example, each of the building blocks 10*a*, 10*b*, 10*c* has the same relative dimensions. However, the wall structure 300 can be built using building blocks 10*a*, 10*b*, 10*c*, 10*d* having different relative dimensions. The aggregation pattern of building blocks 10 in the wall structure 300 depicted in FIG. 13C may be referred to as a face diamond pattern, or a face diamond tall pattern.

Referring now to FIGS. 14A-14D, a wall structure 400 can be formed in which the first side face 42*a* of a first building block 10*a* rests on the fourth side face 46*b* of a second building block 10*b*. The first bottom apex corner 16*a* of the first building block 10*a* contacts the second bottom apex corner 18*c* of a third building block 10*c*, and the first top corner 32*a* of the first building block 10*a* contacts the second top corner 34*d* of a fourth building block 10*d*. In this example, each of the building blocks 10*a*, 10*b*, 10*c* has the same relative dimensions. However, the wall structure 400 can be built using building blocks 10*a*, 10*b*, 10*c*, 10*d* having different relative dimensions.

Figure 15A:
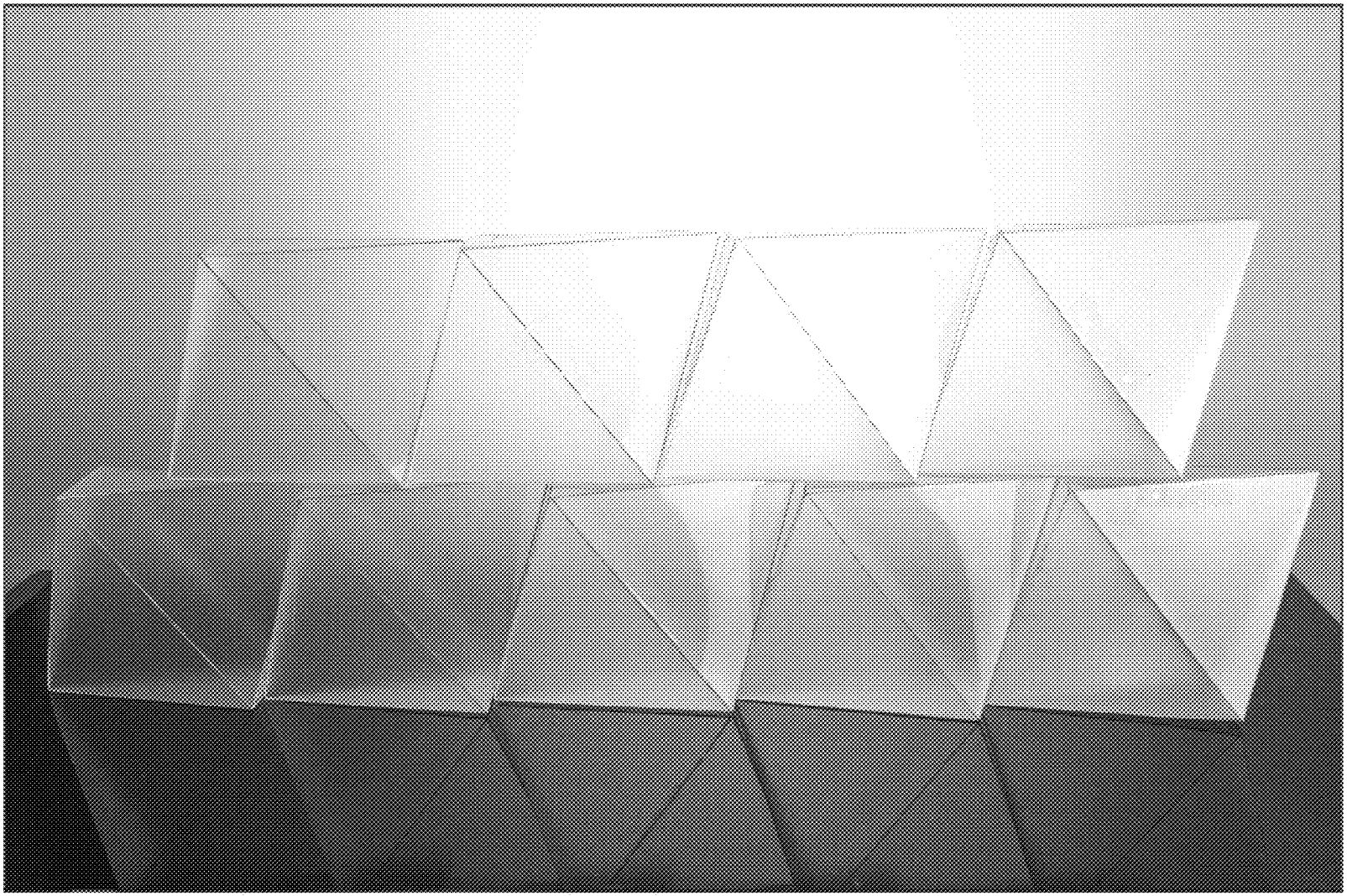
FIGS. 15A-15B: Photograph of a wall structure made from building blocks in accordance with the present disclosure (FIG. 15A), and illustrations of the wall structure from different angles (FIG. 15B).
Figure 15B:
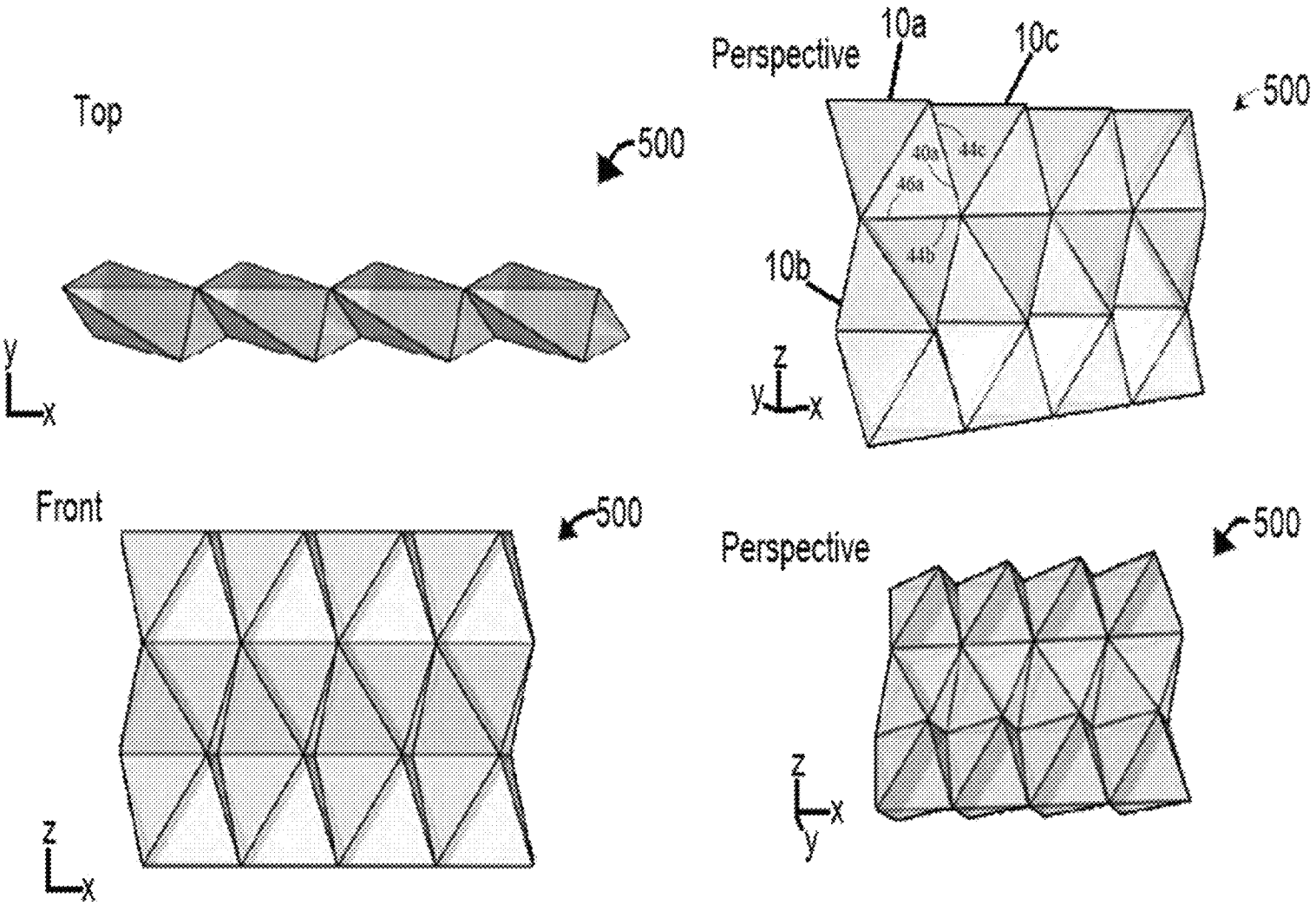

As seen in FIG. 15A and referring to FIG. 15B, a wall structure 500 can be formed in which the fourth side face 46*a* of a first building block 10*a* rests on the third side face 44*b* of a second building block 10*b* and the first side face 40*a* of the first building block 10*a* rests on the third side face 44*c* of a third building block 10*c*. In this example, each of the building blocks 10*a*, 10*b*, 10*c* has the same relative dimensions. However, the wall structure 500 can be built using building blocks 10*a*, 10*b*, 10*c* having different relative dimensions. The pattern of building blocks 10 in the wall structure 500 depicted in FIG. 11A may be referred to as a boxed pattern.

Referring now to FIGS. 16-21, there are many different ways in which a plurality of the building blocks 50, 70, 90 can be fit or arranged together, and bonded together with a suitable adhesive such as a transparent acrylate adhesive (which may or may not involve curing such as UV curing process), to make a wall structure 600, 700, 800, 900. In each of these examples, the wall structures 600, 700, 800, 900 use building blocks having the same relative dimensions. However, the wall structures 600, 700, 800, 900 can be built using building blocks with different relative dimensions.

Figure 16:
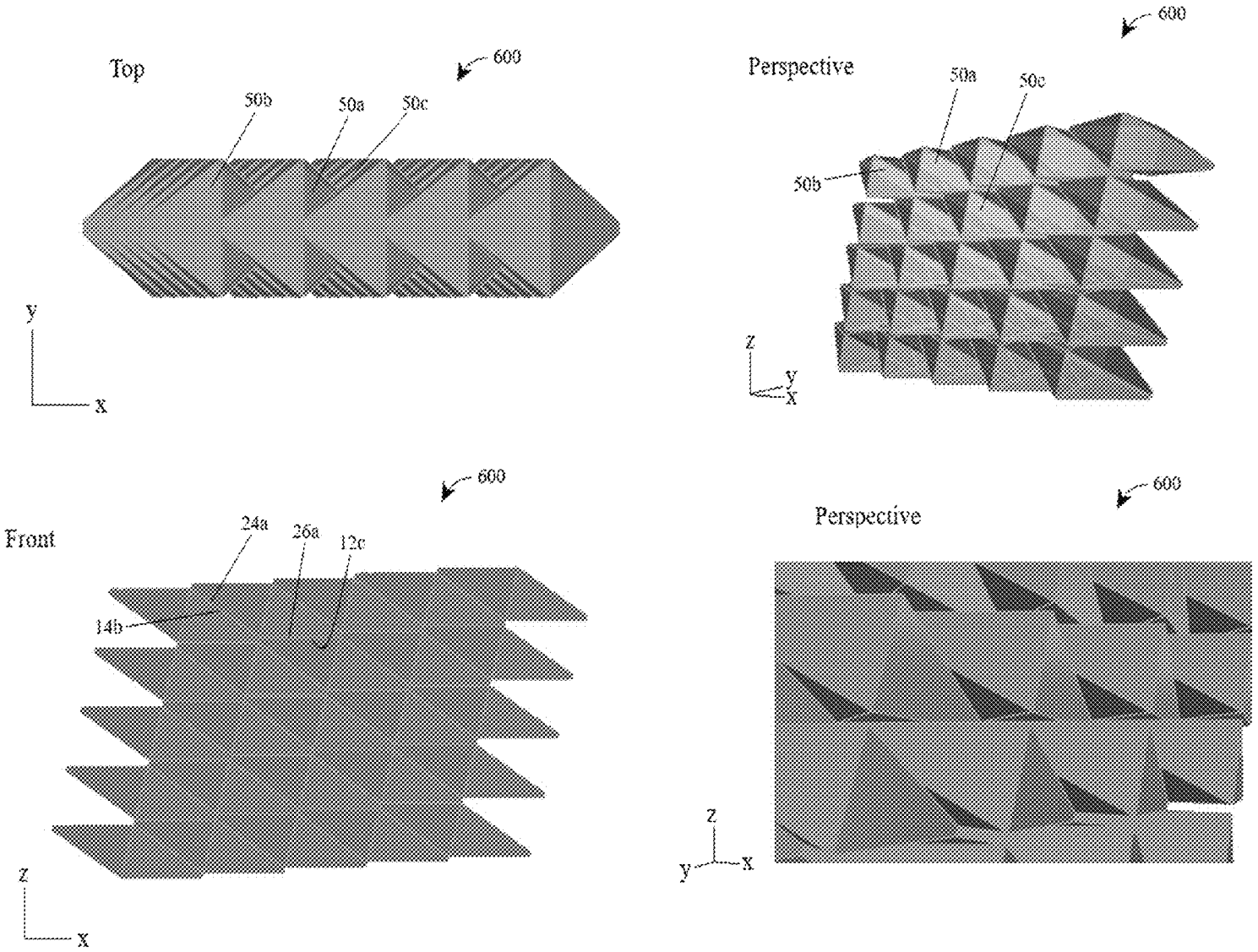
FIG. 16: Views of a wall structure formed from an aggregation of building blocks referred to as an angle lean aggregation.

Referring now to FIG. 16, depicted is an aggregation of building blocks 50 referred to as an angle lean aggregation, which forms a wall structure 600. In the angle lean aggregation, a wall structure 600 can be formed in which the first bottom face 24*a* of a first building block 50*a* rests on the second top face 14*b* of a second building block 50*b*, and the second bottom face 26*a* of the first building block rests on the first top face 12*c* of a third building block 50*c*.

Figure 17:
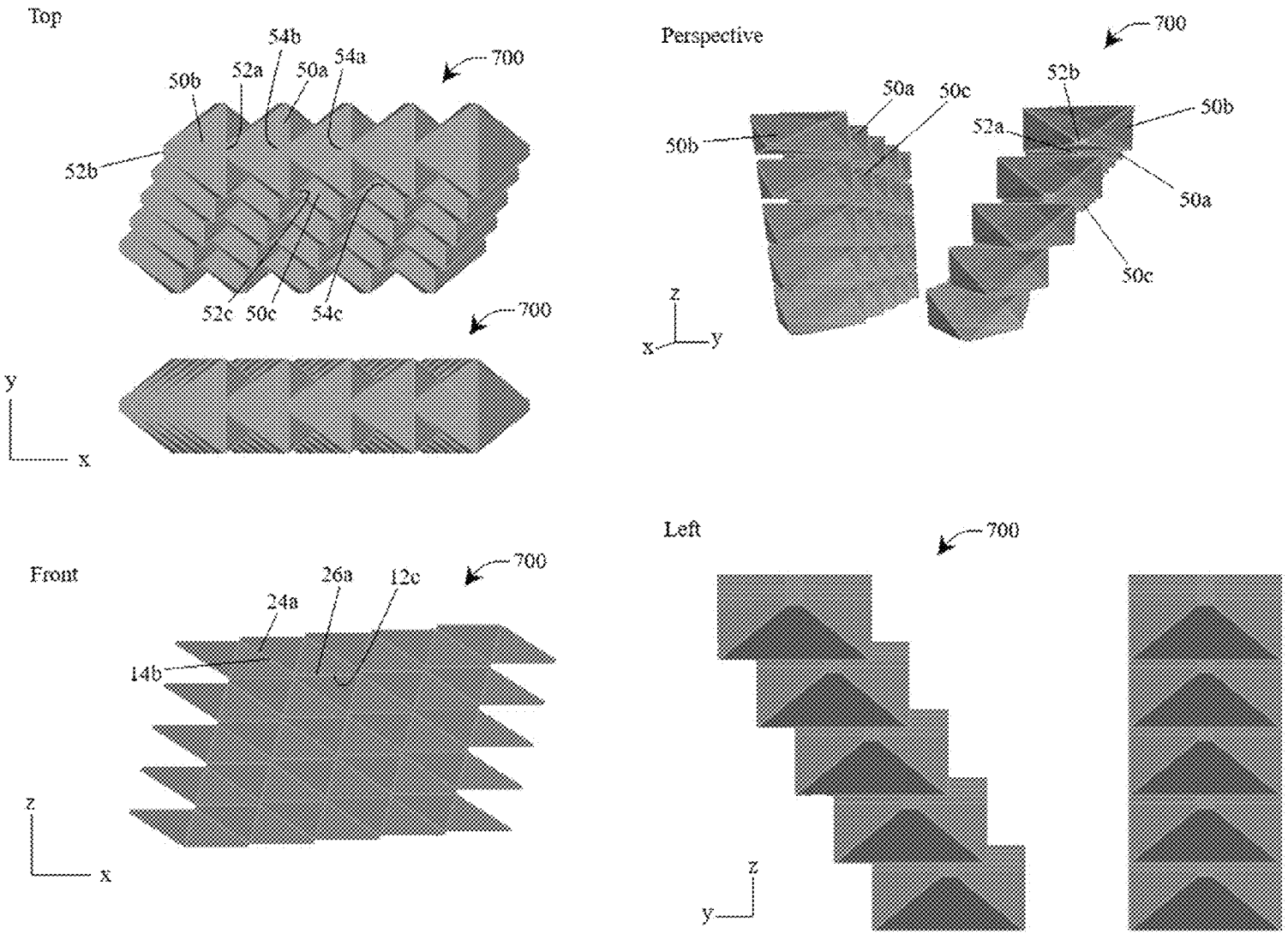
FIG. 17: Views of a wall structure formed from an aggregation of building blocks referred to as an angle lean with course step over aggregation.

Referring now to FIG. 17, depicted is an aggregation of building blocks 50 referred to as an angle lean with course step over aggregation, which forms a wall structure 700. In the angle lean with course step over aggregation, the building blocks 50 are arranged similar to how they are arranged in the angle lean aggregation shown in FIG. 16, except that a second building block 50*b* is shifted relative to the first building block 50*a* such that the ninth and tenth faces 52*c*, 54*c* of the third building block 50*c* are not aligned in the same plane as the ninth and tenth faces 52*a*, 54*a* of the first building block 50*a* and the ninth and tenth faces 52*b*, 54*b* of the second building block 50*b*. In this manner, the wall structure 700 may be tilted or leaning.

Figure 18:
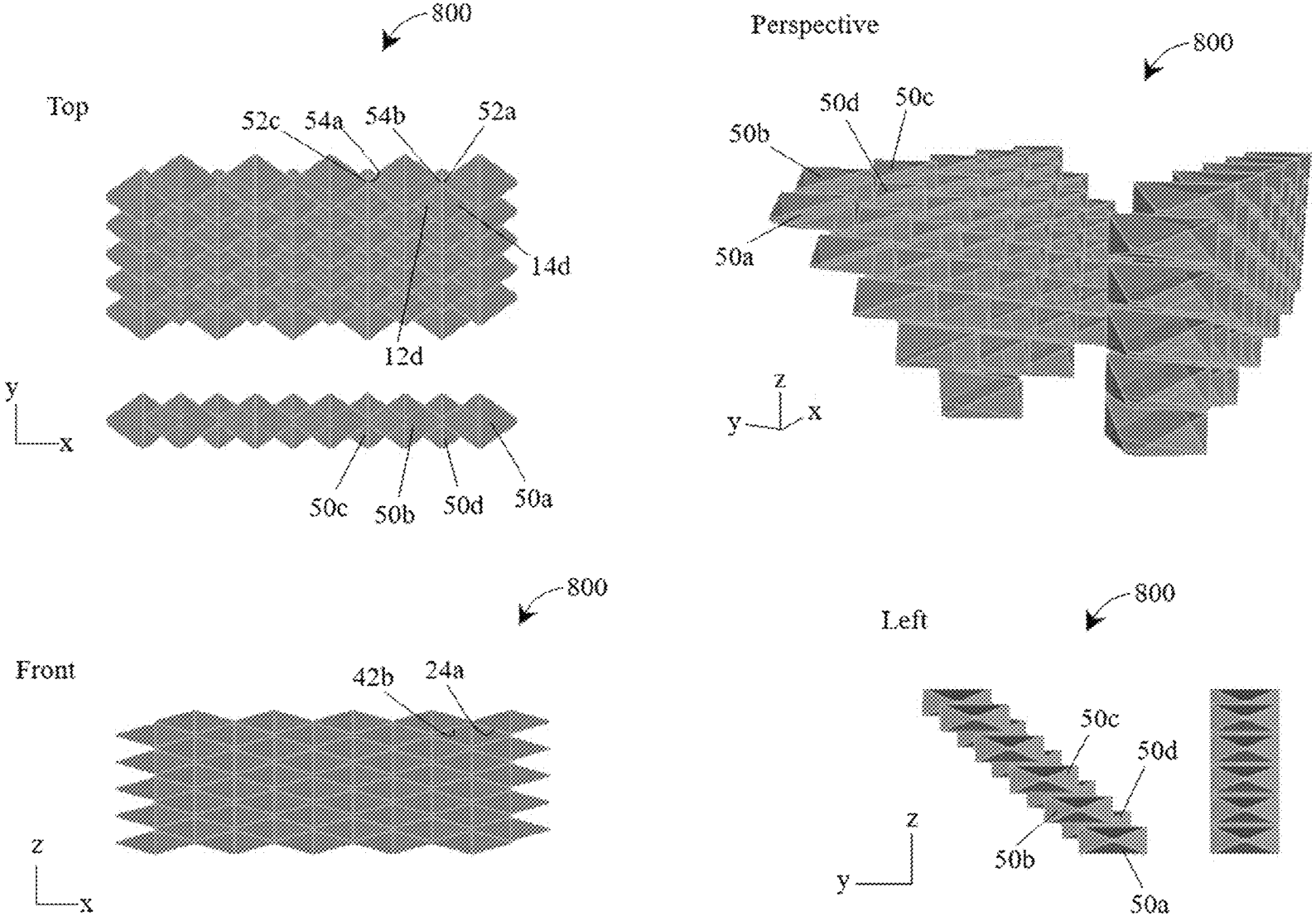
FIG. 18: Views of a wall structure formed from an aggregation of building blocks referred to as a low horizontal with course step over aggregation.

Referring now to FIG. 18, depicted is an aggregation of building blocks 50 referred to as a low horizontal aggregation (also referred to as a middle face aggregation), which forms a wall structure 800. In the low horizontal aggregation, the ninth face 52*a* of a first building block 50*a* contacts the tenth face 54*b* of a second building block 50*b*, and the ninth face 52*b* of the second building block 50*b* contacts the tenth face 54*c* of a third building block 50*c*. The first bottom face 24*a* of the first building block 50*a* rests on the second top face 14*d* of a fourth building block 50*d*, and the second side face 42*b* of the second building block 50*b* rests on the first top face 12*d* of the fourth building block 50*d*.

Referring now to FIG. 19, depicted is an aggregation of building blocks 50 referred to as a low horizontal with course step over aggregation, which forms a wall structure 900. In the low horizontal with course step over aggregation, a first building block 50*a* is tightly secured on a second building block 50*b*, a third building block 50*c*, and a fourth building block 50*d* to make a solid wall structure 900 without gaps. The bottom centerline 28*a* of the first building block 50*a* meets the tenth face 54*b* of the second building block 50*b*, the ninth face 52*c* of the third building block 50*c*, and the top centerline 20*d* of a fourth building block 50*d*.

Figure 20:
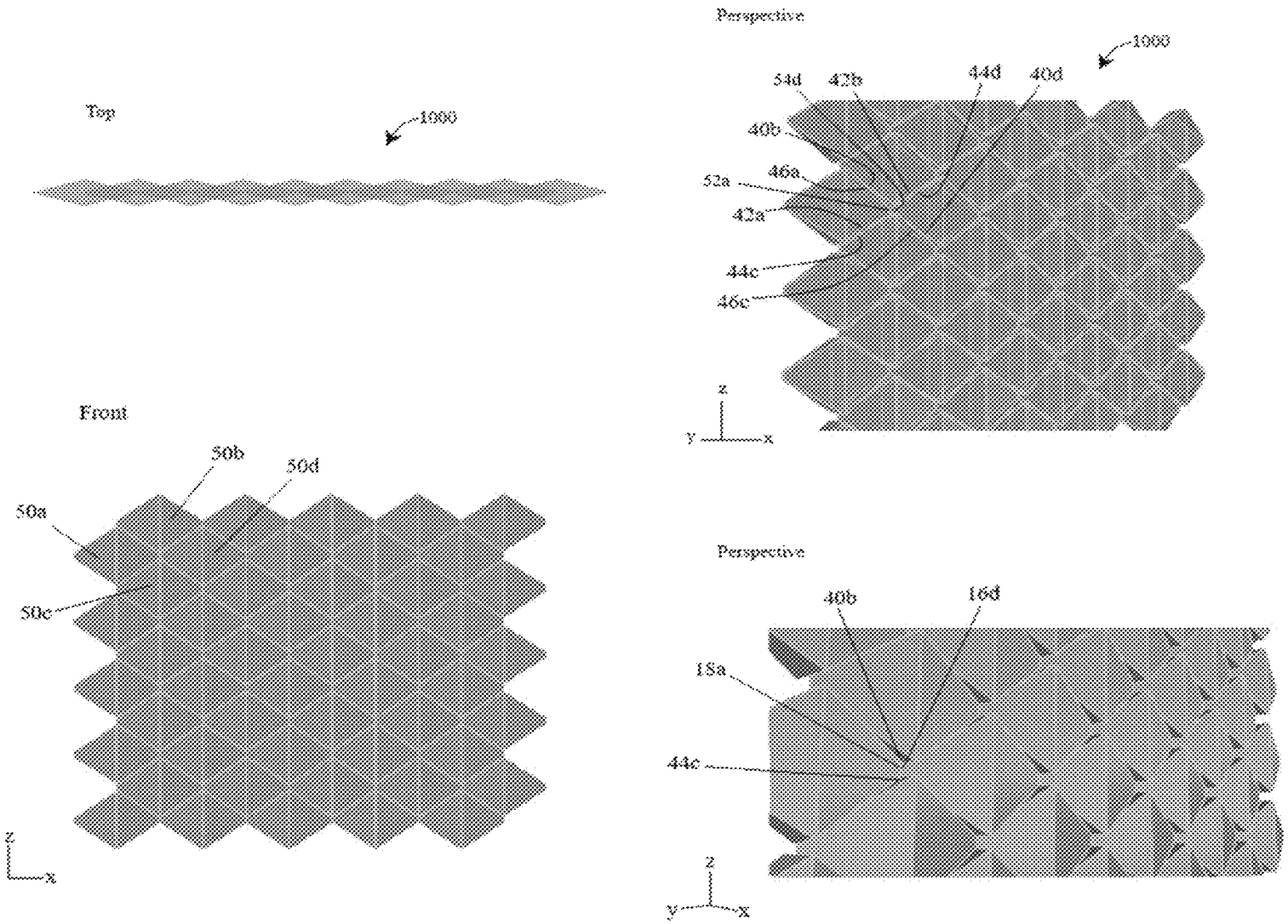
FIG. 20: Views of a wall structure formed from an aggregation of building blocks referred to as a face diamond aggregation.

Referring now to FIG. 20, depicted is an aggregation of building blocks 50 referred to as a face diamond aggregation, which forms a wall structure 1000. In the face diamond aggregation, the fourth side face 46*a* of a first building block 50*a* contacts the first side face 40*b* of a second building block 50*b*, and the second side face 42*a* of the first building block 50*a* contacts the third side face 44*c* of a third building block 50*c*. The tenth face 54*a* of the first building block 50*a* meets the ninth face 52*d* of a fourth building block 50*d*. The third side face 44*d* of the fourth building block 50*d* contacts the second side face 42*b* of the second building block 50*b*, and the first side face 40*d* of the fourth building block 50*d* contacts the fourth side face 46*c* of the third building block 50*c*.

Figure 21:
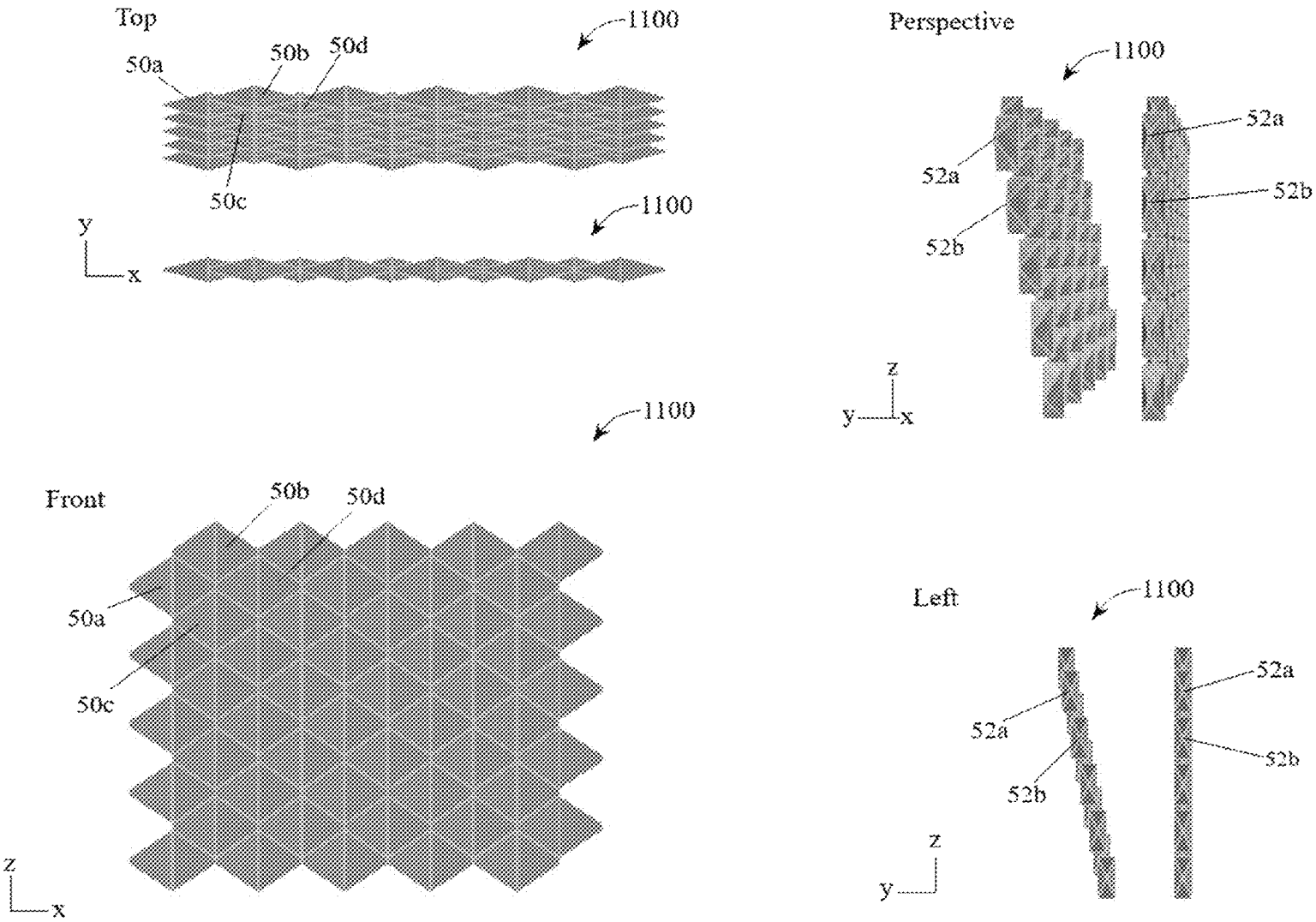
FIG. 21: Views of a wall structure formed from an aggregation of building blocks referred to as a face diamond with course step over aggregation.
Figure 22A:
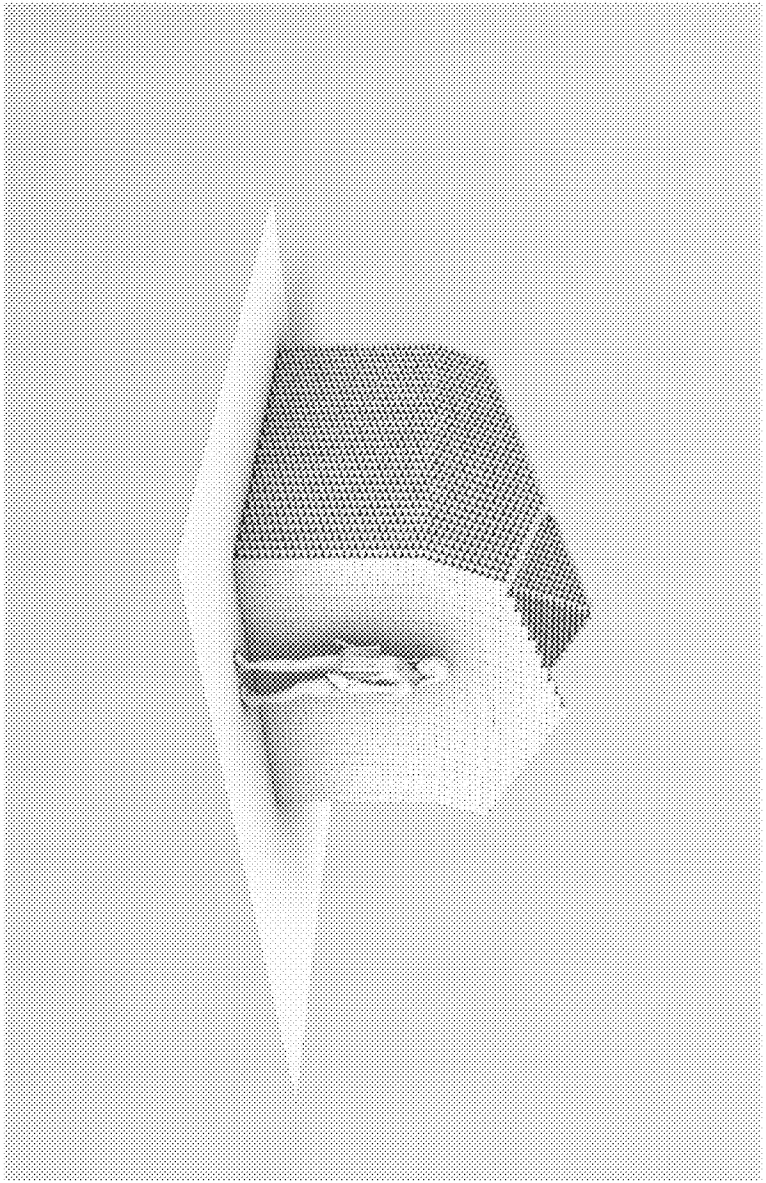
FIGS. 22A-22F: Illustrations of non-limiting example architectural structures built using light transmitting building blocks in accordance with the present disclosure. A person is depicted in FIGS. 22A, 22C-22F for scale.
Figure 22B:
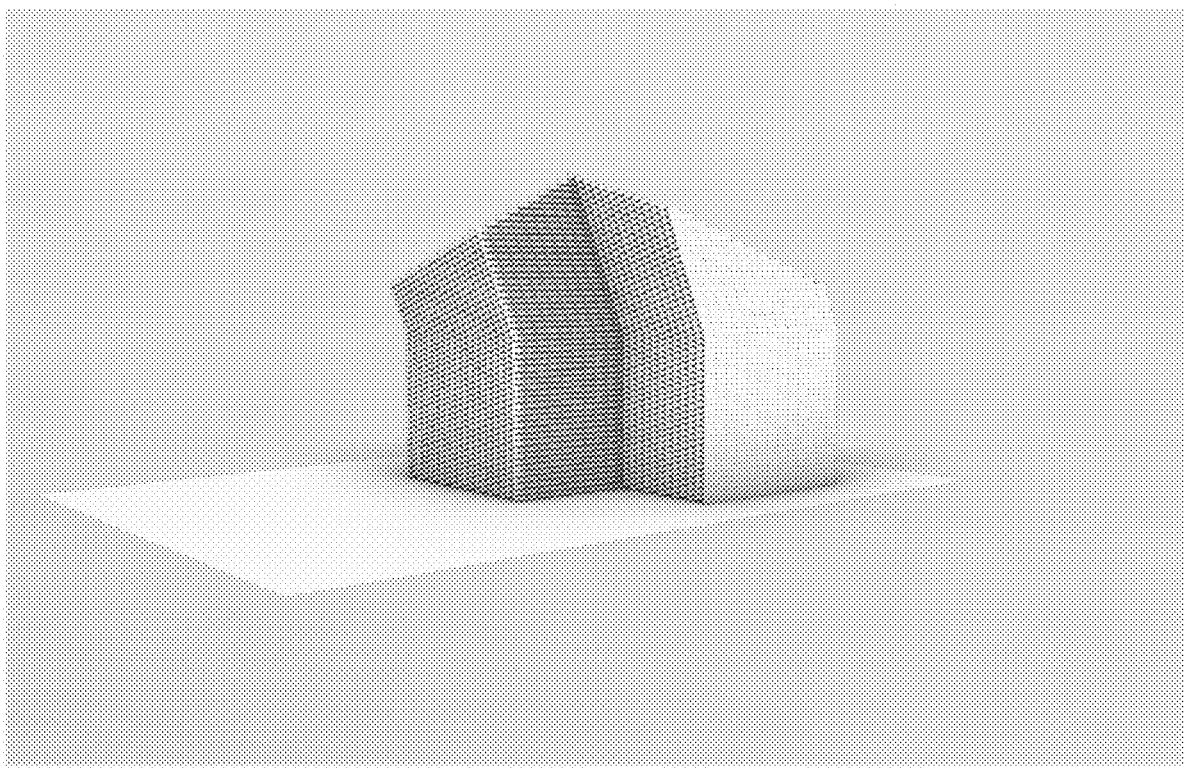
Figure 22C:
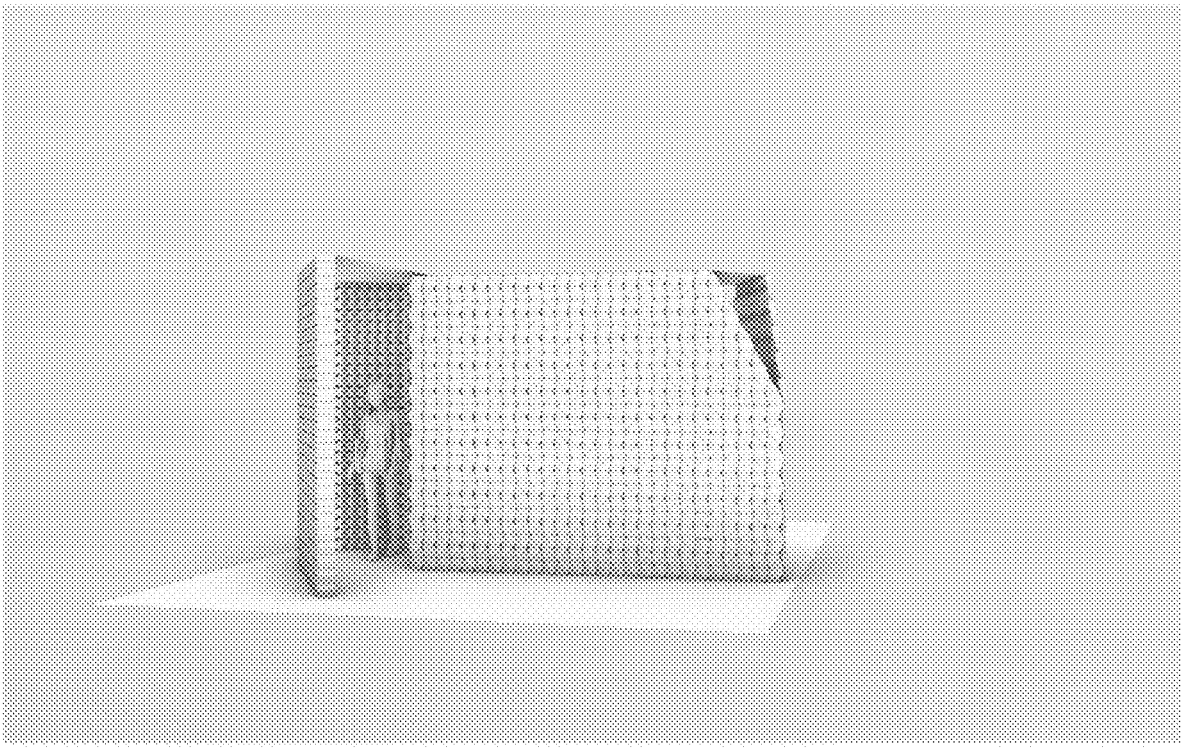
Figure 22D:
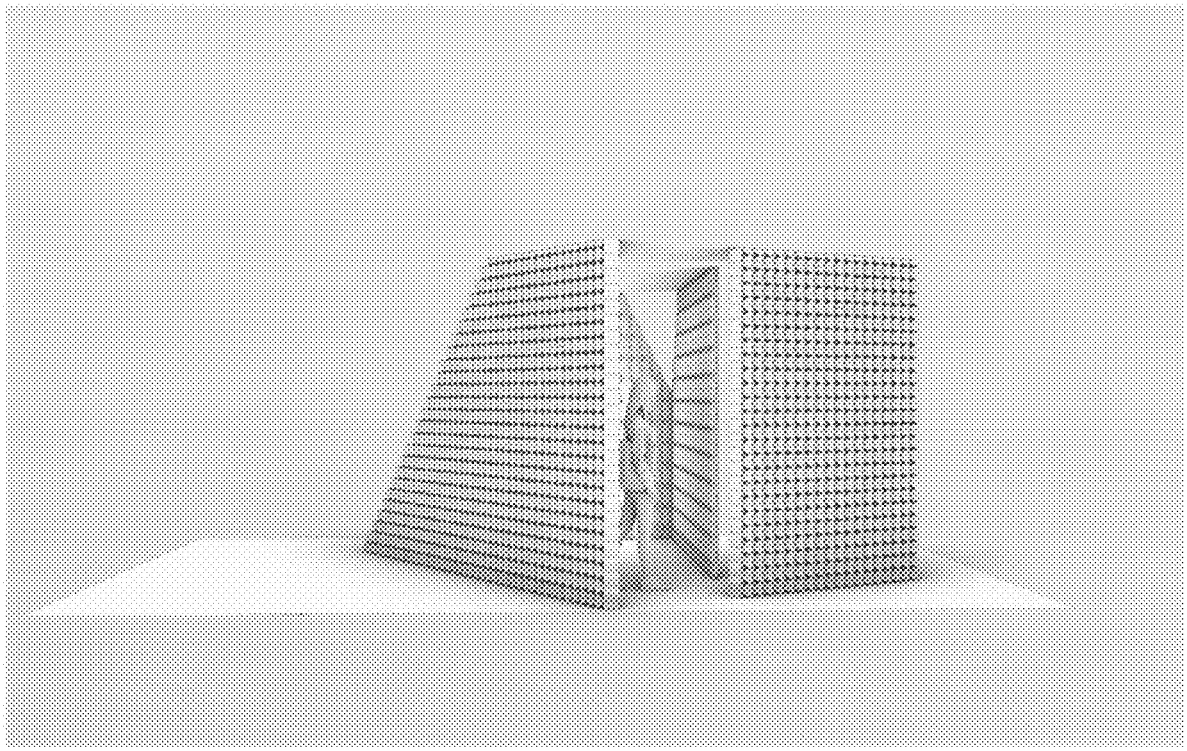
Figure 22E:
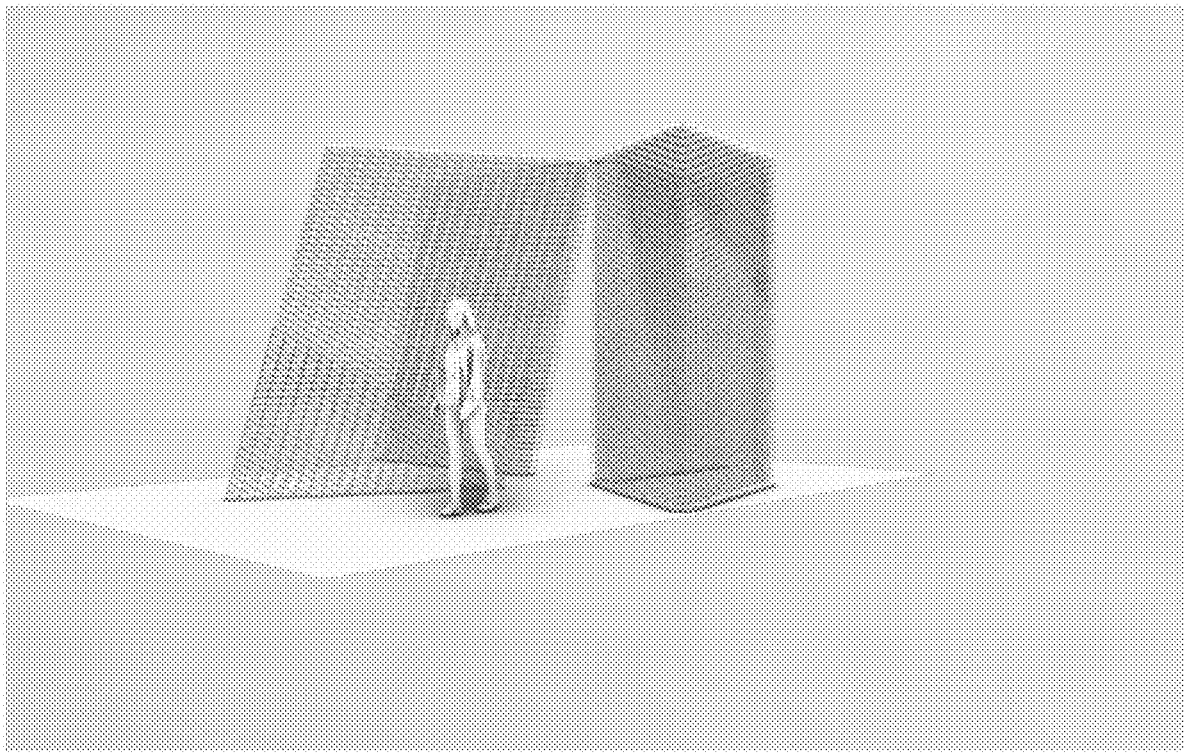
Figure 22F:
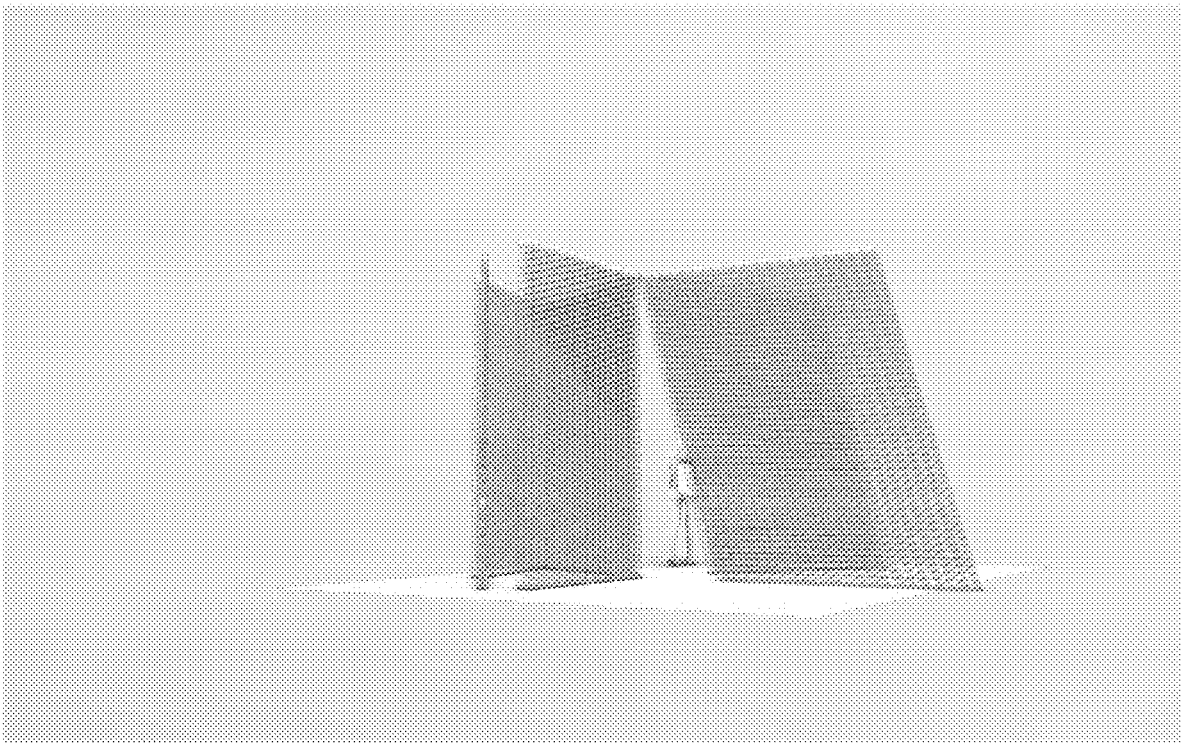

Referring now to FIG. 21, depicted is an aggregation of building blocks 50 referred to as a face diamond with course step over aggregation, which forms a wall structure 1100. In the face diamond with course step over aggregation, the building blocks 50 are arranged similar to how they are arranged in the face diamond aggregation shown in FIG. 20, except that a second building block 50*b* is shifted relative to the first building block 50*a* such that the ninth and tenth faces 52*b*, 54*b* of the second building block 50*b* are not aligned in the same plane as the ninth and tenth faces 52*a*, 54*a* of the first building block 50*a*. In this manner, the wall structure 1100 may be tilted or leaning.

Figure 31A:
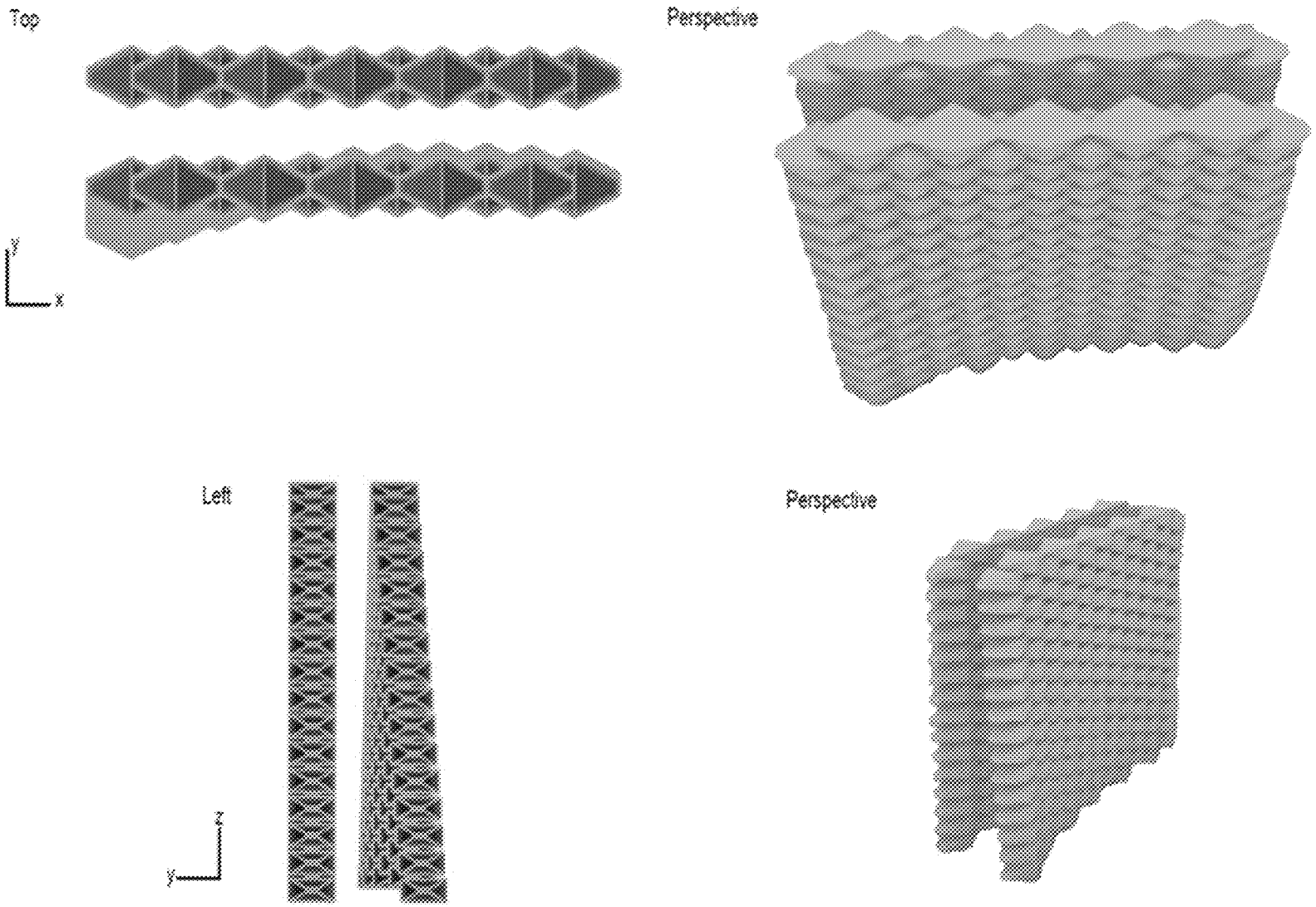
FIGS. 31A-31B: Illustrations of curved wall structures.
Figure 31B:
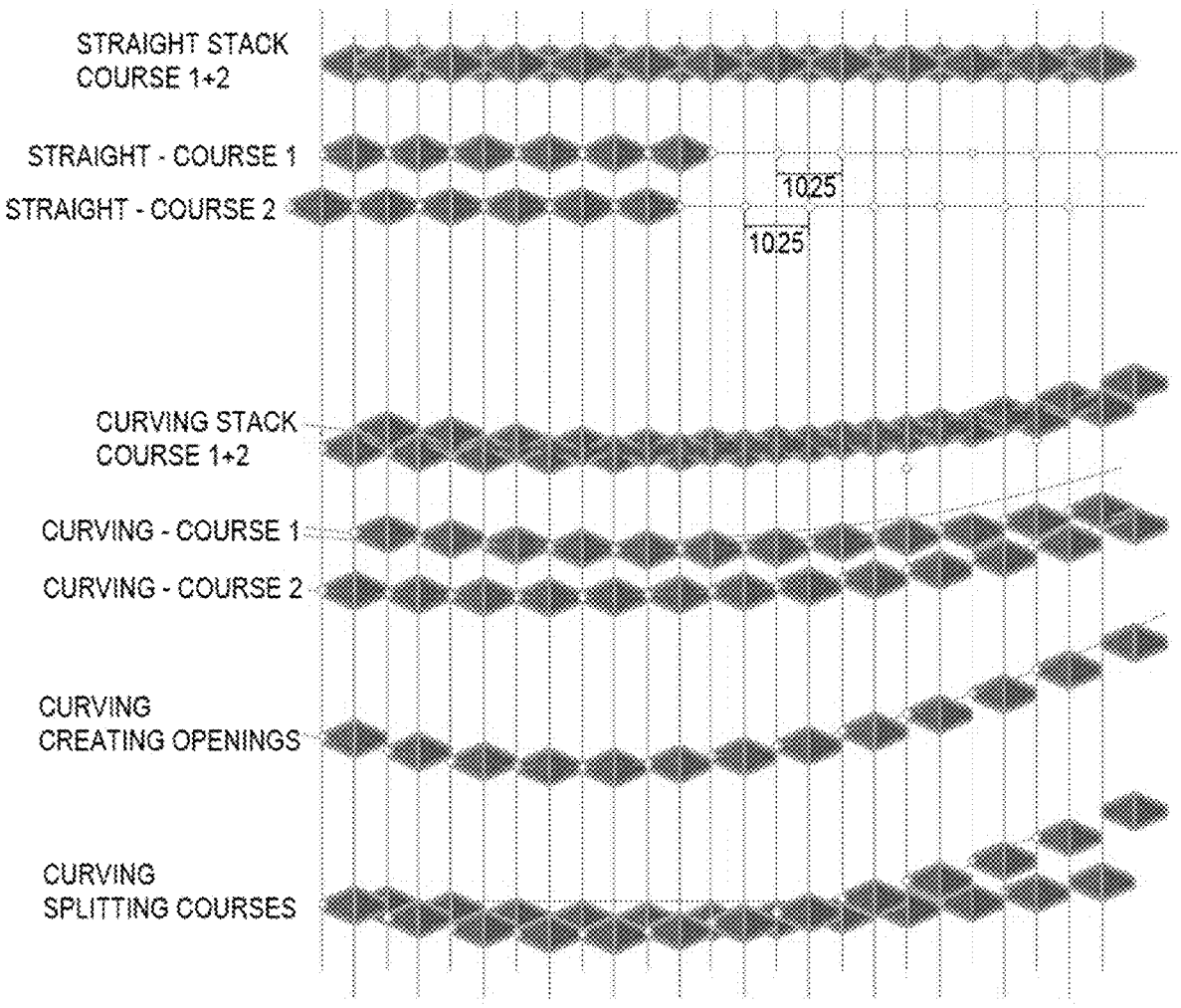

Referring now to FIGS. 31A-31B, a wall structure may also be curved in plan or elevation. It is possible to aggregate the building blocks 50 with a gradual curvature that can happen both in plan and elevation. This also allows for double curvature, along with tilting or leaning. As seen in FIG. 31B and with reference to FIG. 1B, curving the wall structure may be achieved, for example, by using the ninth and tenth faces 52, 54 to create openings between building blocks 50 in the wall structure or to allow for a building block 50 to be slightly shifted relative to adjacent building blocks 50. Adjacent building blocks 50 can be shifted along the ninth and tenth faces 52, 54 while the ninth and tenth faces 52, 54 of adjacent building blocks 50 remain planar to each other. If incrementally shifted along a course of building blocks 50, a curvature can be created, as shown in FIG. 31B.

FIGS. 22A-22F depict non-limiting example structures built with the wall structures and building blocks described herein. The structures depicted in FIGS. 22A-22F are made both from wall structures having all of the same pattern, as well as wall structures that have different stacked patterns from one another. In other words, the pattern can change within a single architectural space based on the needs of the larger form or the desired light qualities.

Advantageously, the building blocks described herein can provide a form that makes use of the strength of glass in compression. Internal pockets of air may create optical characteristics, and affect thermal and acoustic performance. The building blocks can be constructed as either one single block, or made of two parts. As two parts, there is an opportunity to alter the internal voids, as well as add color variations along an adhered connection within the block. As a solid glass block, transparency and translucency can be adjusted based on stacked formations, thickness, or detailing in the glass.

Though the present disclosure is not limited to use with glass, glass is the ideal material to harness the natural conditions of darkness and light. Glass has an uncanny combination of optical transmission and compressive strength that can be utilized in making glass the primary material within a built structure. The density and strength of glass perform well in compression, while its configurations can also enclose air pockets contributing to thermal and acoustic performance. Commonly, to introduce light, the built world relies on the insertion of flat pane windows into an otherwise opaque building, almost as if it is an afterthought. Because glass is most commonly used in built spaces as flat panes held in tension, its formation as blocks with variable thicknesses or configurations in compressive systems have been significantly underutilized. Its stiffness, even in thin sections, creates a water seal, while its configurations can also enclose air pockets contributing to thermal and acoustic performance. Glass also aids in extending a building's fireproof ratings. These conditions contribute to the longevity and performance of a building system. Still further, glass, when produced in compatible batches, is 100% recyclable. All of these qualities make glass exceptionally positioned for use in building architectural structures for lived spaces. The building blocks provided herein can harness the structural and light qualities of glass to promote wellness. Engrained deeply in every living cell is a wired attachment to the greater environment found in circadian rhythms. Undisrupted natural light and even darkness provide a primal and impactful link to a widely needed cognitive reset. However, architectural building materials that focus on this true diurnal and nocturnal presence do not yet exist. This lack of connection to the shifts of day and night, and the seasons, contributes to the widespread flustered and frayed minds of the human species.

Conventional architectural glass blocks exist primarily in two forms commercially: the ubiquitous 6"×6" hollow square block, and the cast and polished glass brick. Conventional glass modular block systems look at modular glass construction with a rectilinear block geometry. The most widely known glass block system is a two-part block that is not intended to be used structurally. It is deployed for light transmission and privacy, but fails to fully utilize the compressive strength of the glass, which is similar to that of concrete. Other known glass block systems are close in geometry to common clay brick modules, which generally favor only one orientation or configuration. These blocks are cast solid. In contrast, the building blocks described herein have a non-rectilinear shape that accumulate light in a variety of orientations, inviting a variety of light and visual effects within one modular form.

The shape of glass, its thickness, and the precise mix of its ingredients, determine the behavior and characteristics of light on, in, and exiting the material, permitting the control of light passage and characteristics. Glass performs well in compression, is recyclable in batches, and is inert and flame-proof, making it advantageous for use as a building material. In accordance with the present disclosure, glass can be used as architectural units capable of assisting in increasing one's exposure to natural light and increasing one's connections to their exact location on the planet.

The building blocks described herein account for how to provide occupants with undisrupted natural light and even darkness. The building blocks, wall structures, building systems, and structures made therefrom, account for how building materials can contribute to wellbeing and circadian rest. Natural light and darkness are important factors in determining one's relationship to their surroundings, and maintaining a healthy alignment to the natural rhythms of day and night. There are clear patterns of brain wave activity, hormone production, cell regeneration, and other biological activities linked to this daily cycle. Circadian rhythm research has found deep connections to human health and well being associated with one's connection to the natural rhythms of day and night. How light enters into a space is of critical importance to the wellbeing of the space's occupants. In an age of rapid urban growth, the digital empire, and a 24-hour clock of work and entertainment, humans have lost access to darkness and the therapeutic benefits of true light and total night. The building blocks, wall structures, building systems, and structures described herein reshape the built environment to support physical and psychological needs by connecting one's experience with their environment.

Healthy lighting is an important need to be met, but yet building materials designed to aid in harnessing natural patterns of day and night have yet to be developed. The present disclosure provides building materials which harness natural light patterns of day and night, harvesting light rhythms within architecturally constructed spaces in order to more specifically realign the connection between the built environment and its occupant.

Examples

Light transmitting building blocks were made by hot molding glass with graphite molds, and subjected to various testing for strength and light transmission. The process of hot molding with graphite molds mimics the automated pressed mold manufacturing methods used for large scale industrial production.

Compression Testing

Figure 23:
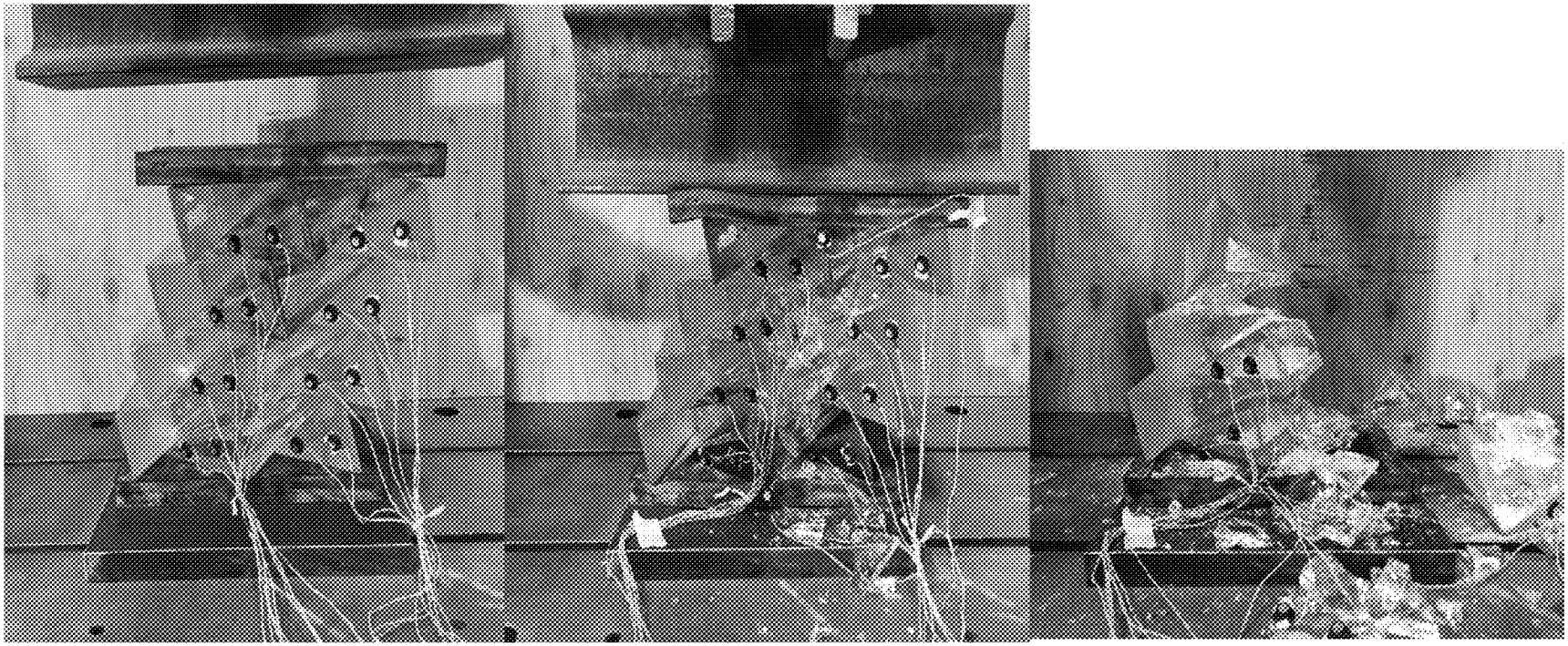
FIG. 23: Photographs showing building blocks subjected to compressive strength testing. The photograph on the right shows the building blocks having shattered after being subjected to 6,067 lbs. of compressive force.

Glass octahedron building blocks were subjected to compression testing to determine the maximum amount of force they could be subjected to. Four voided building blocks were arranged together with eight solid building block halves, and the device was pressed downward to test the compressive strength of the structure. FIG. 23 shows photographs of the test. The result was that the building blocks could withstand 6,067 lbs. of compressive force before shattering.

Tensile Testing

Different adhesives joining the two halves of the building blocks, and joining faces of adjacent building blocks in an aggregation, were tested using a 4 point flex test. A 4 point flex test was used to test the tensile strength of the assembly. Given the strength of the glass, the test results provide information about the adhesive connections between the halves and the faces. The results are shown in FIGS. 24-27.

Figure 24A:
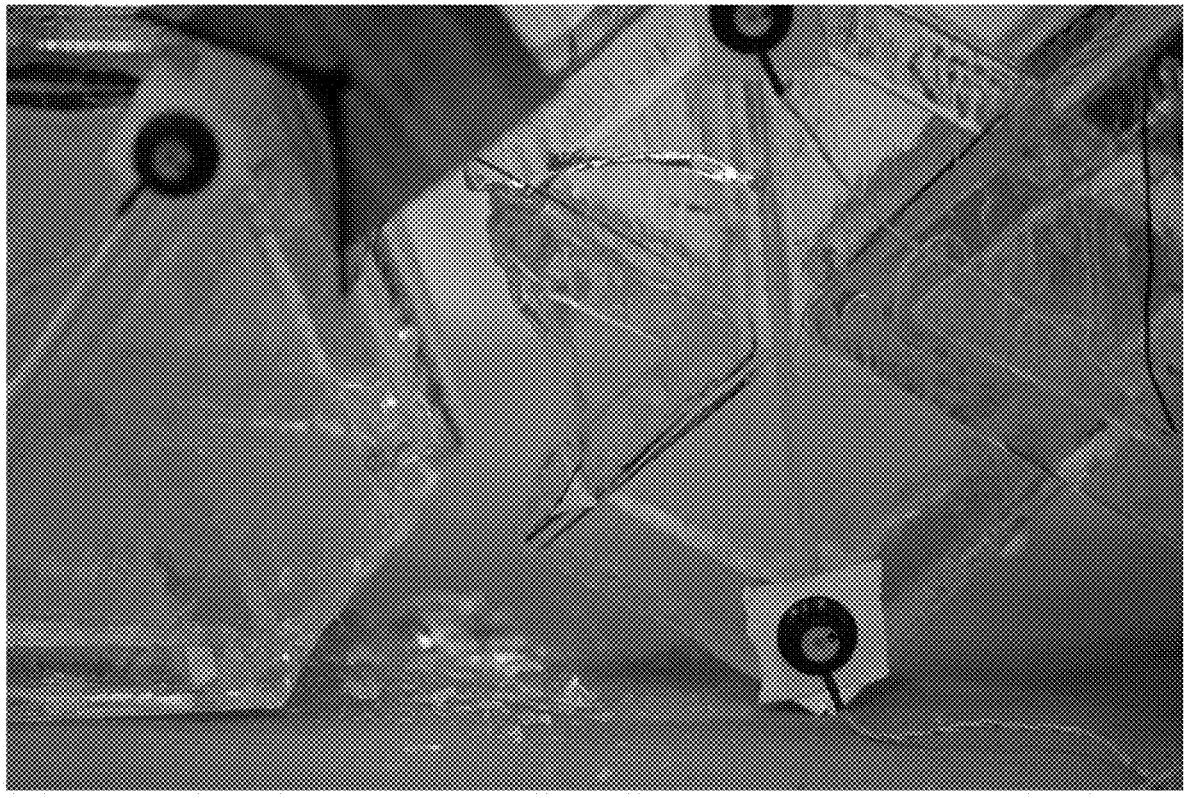
FIGS. 24A-24B: Photographs showing the results of a 4-point tensile strength test from all UV glue building block samples, where UV glue was disposed between the halves and between the faces of the building block.
Figure 24B:
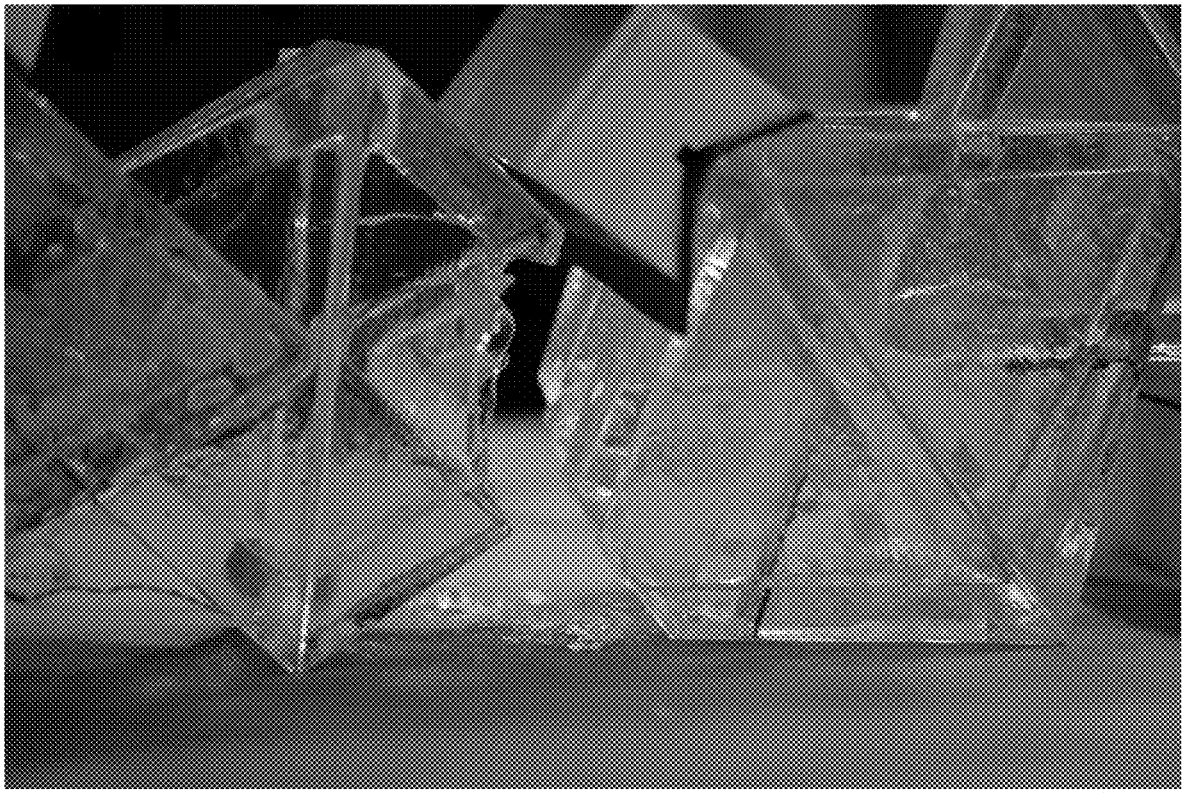

FIGS. 24A-24B show the results from building blocks that used only UV glue for adhesion, where UV glue was disposed between the two halves of each building block and between the faces of adjoining building blocks. Seven voided building blocks were tested. The max force reached was 2,156 lbs.

Figure 25A:
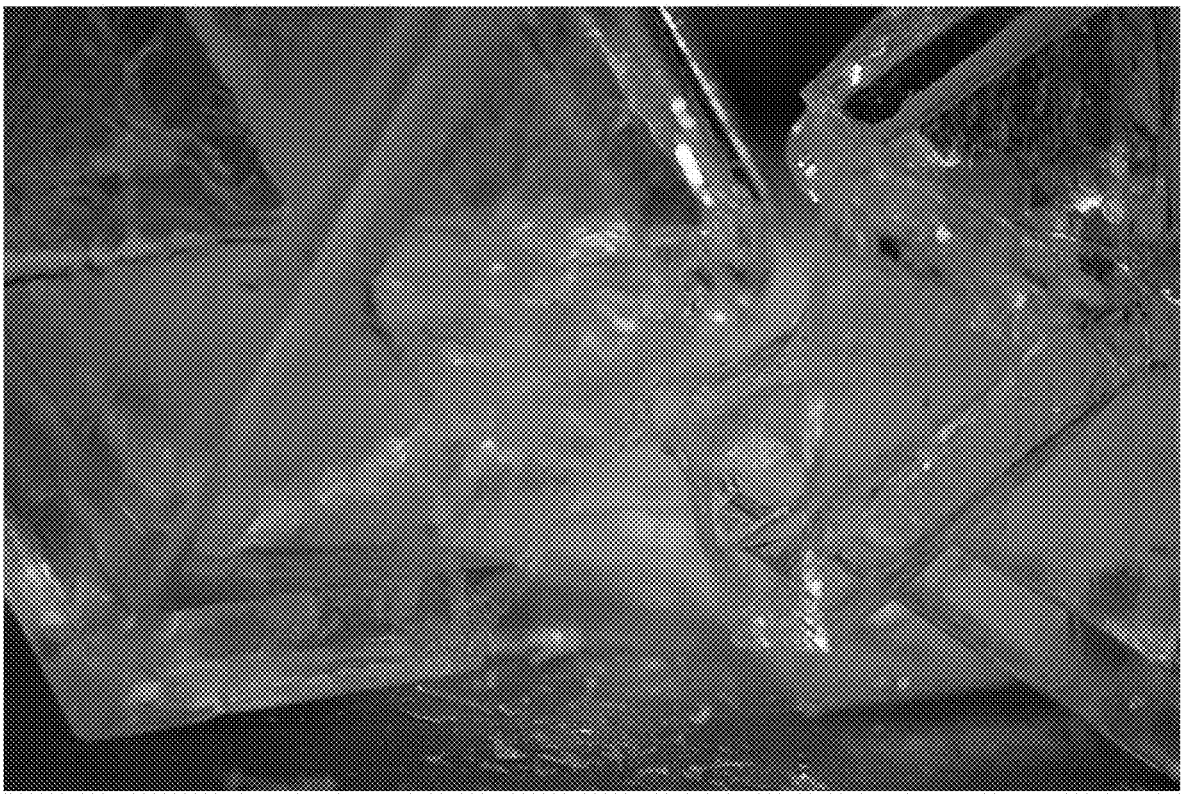
FIGS. 25A-25B: Photographs showing the results of a 4-point tensile strength test from all epoxy building block samples, where epoxy was disposed between the halves and between the faces of the building block.
Figure 25B:
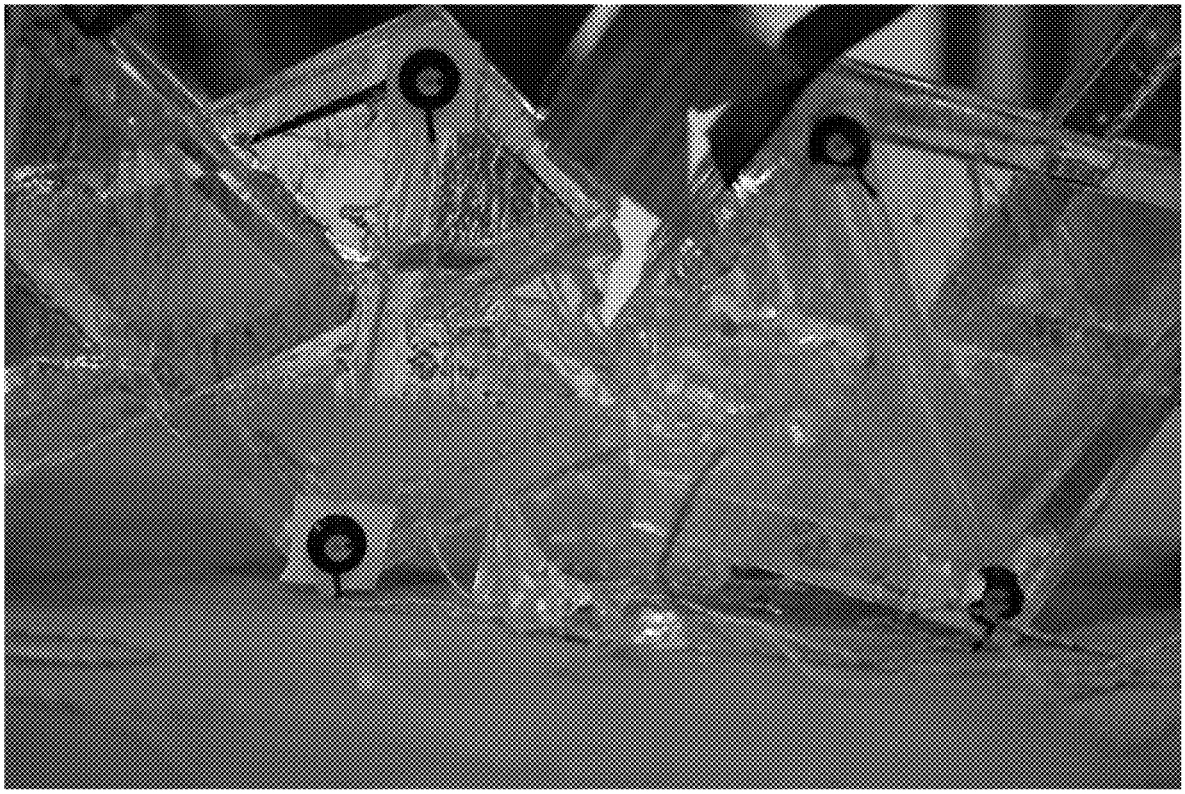

FIGS. 25A-25B show the results from building blocks that used only epoxy for adhesion, where epoxy was disposed between the two halves of each building block and between the faces of adjoining building blocks. Seven voided building blocks were tested. The max force reached was 5,047 lbs.

Figure 26A:
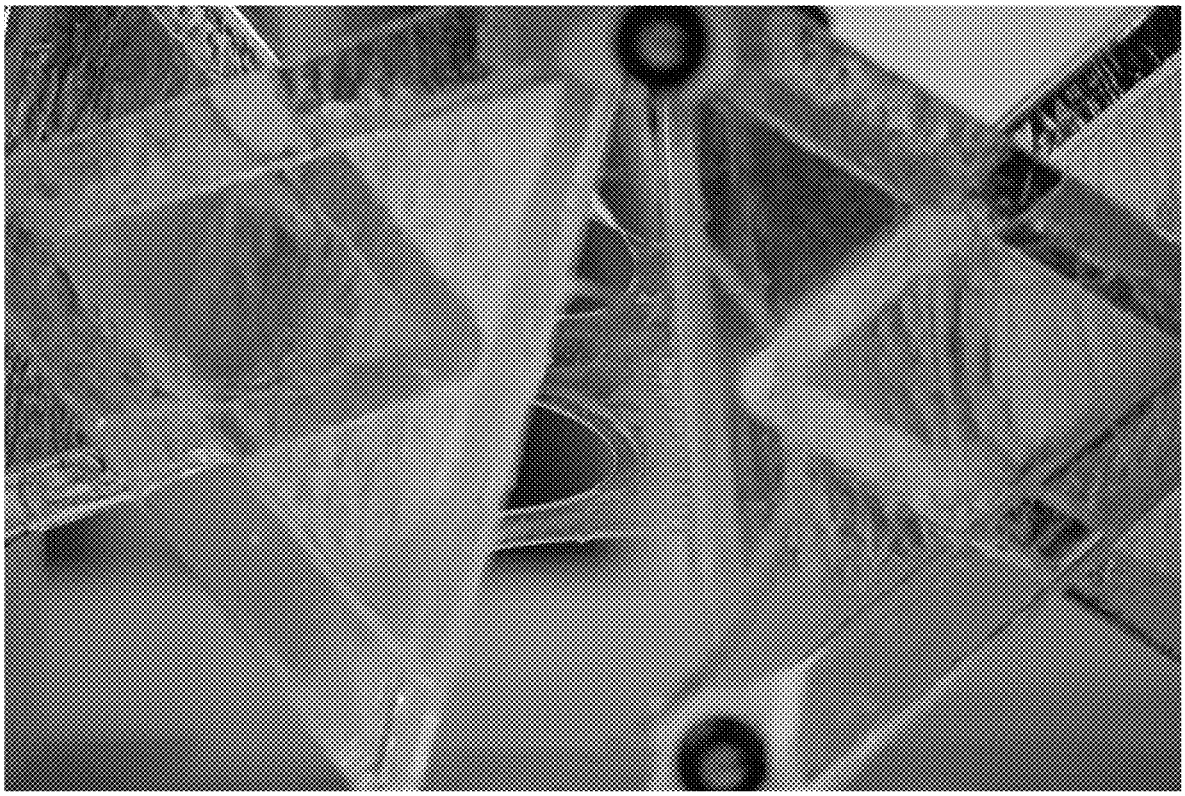
FIGS. 26A-26B: Photographs showing the results of a 4-point tensile strength test from building blocks having tape between the two halves of each building block and epoxy between faces of adjoining building blocks.
Figure 26B:
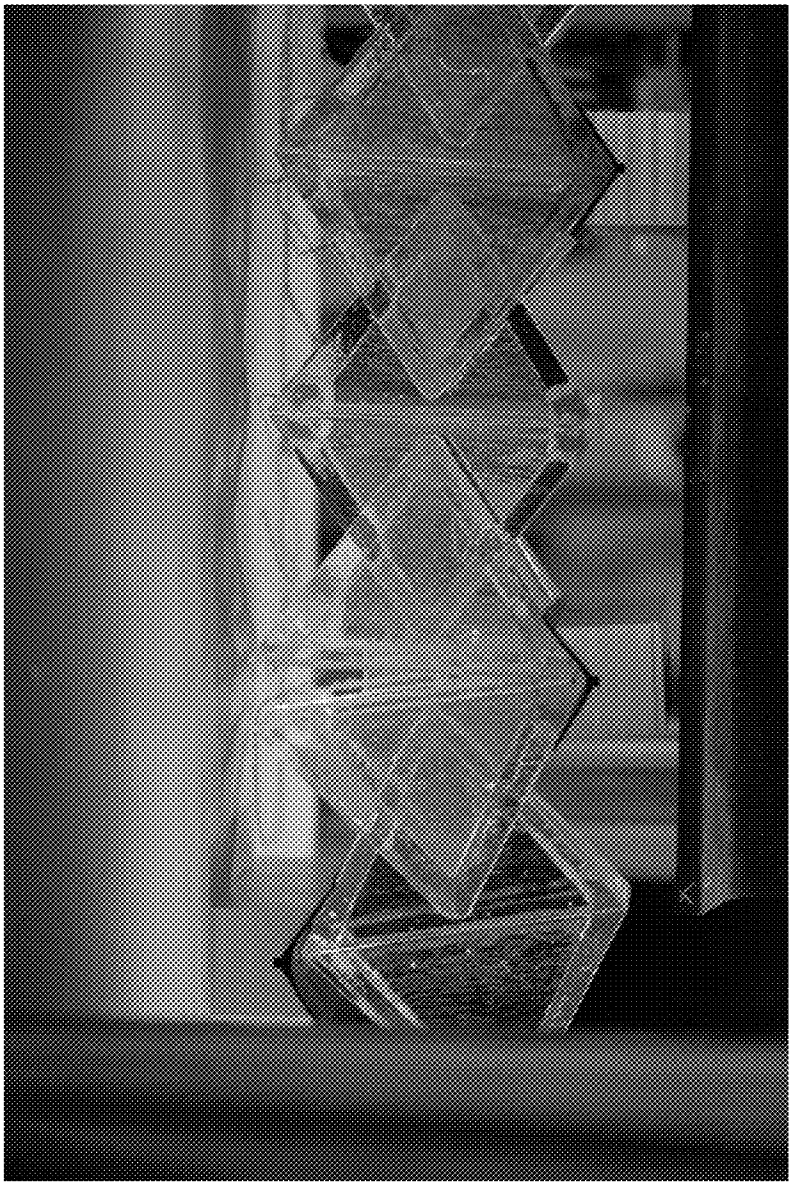

FIGS. 26A-26B show the results from building blocks having tape and epoxy for adhesion, where a very high bond tape was disposed between the two halves of each building block and epoxy was disposed between faces of adjacent building blocks. Seven voided building blocks were tested. The max force reached was 305 lbs.

Figure 27A:
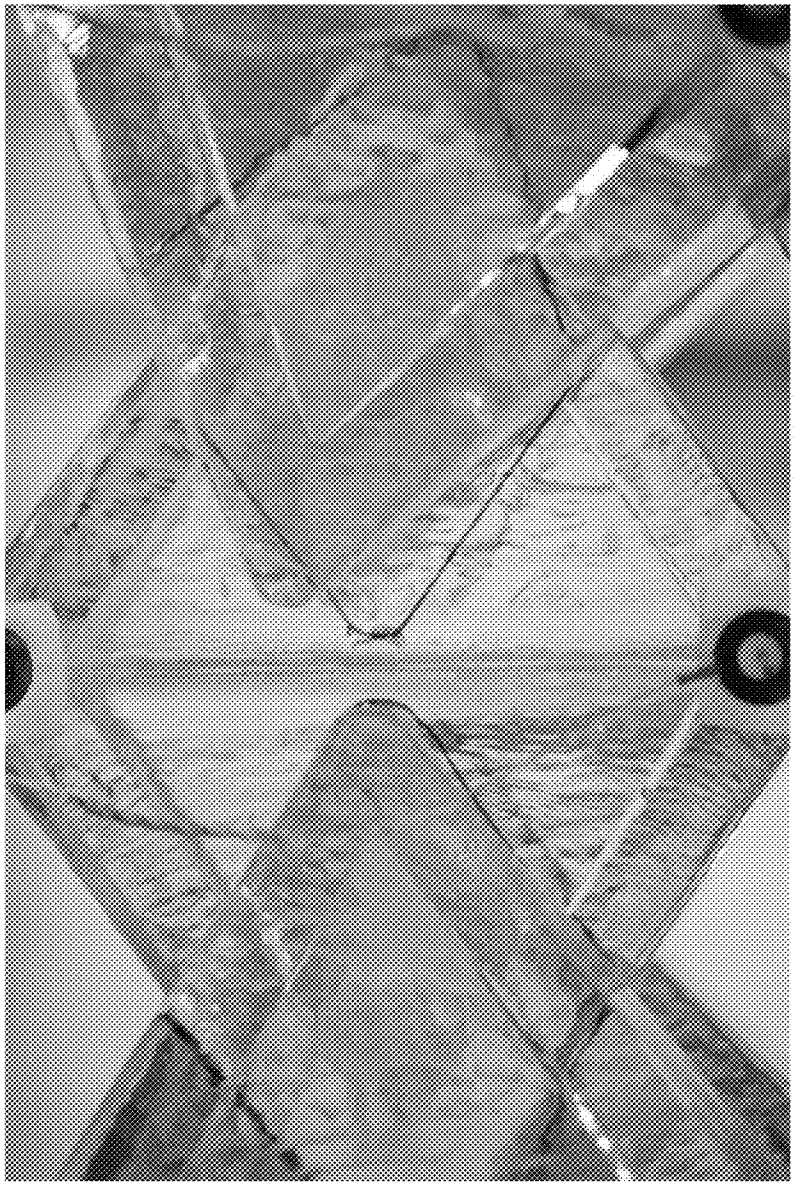
FIGS. 27A-27B: Photographs showing the results of a 4-point tensile strength test from building blocks having tape between the two halves of each building block and tape between faces of adjoining building blocks.
Figure 27B:
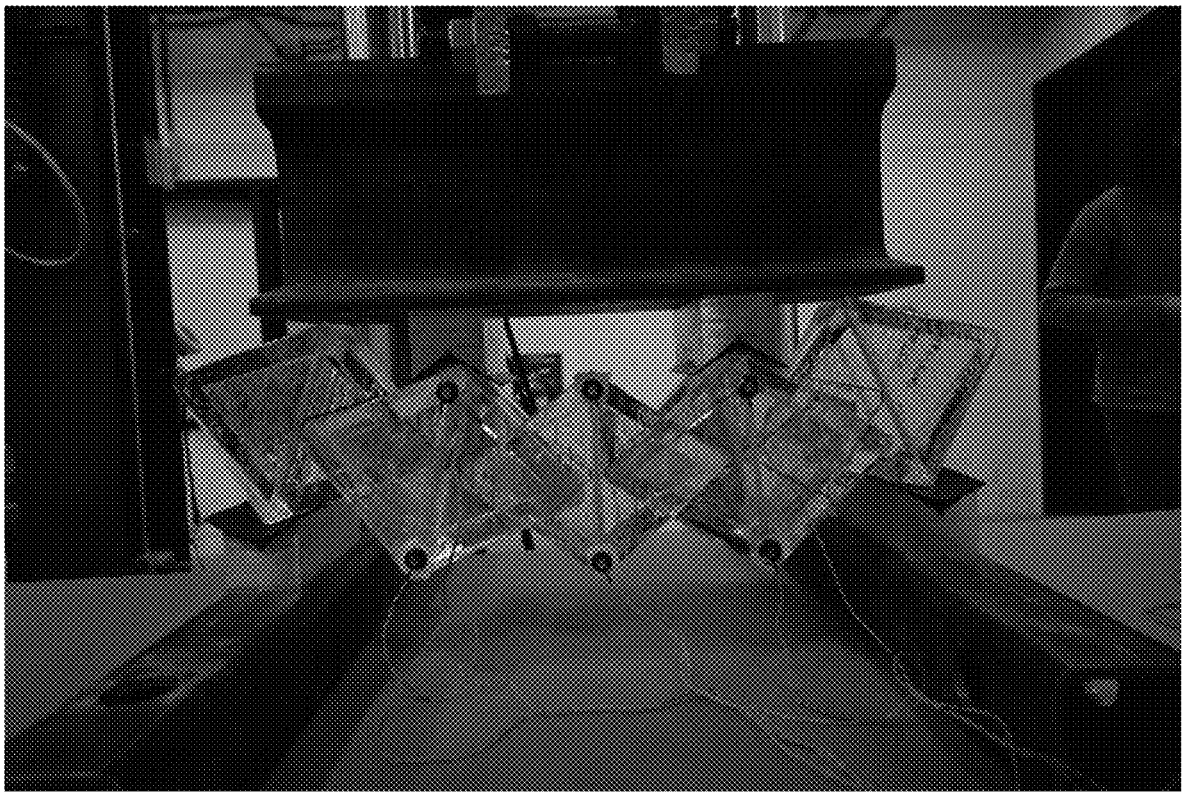

FIGS. 27A-27B show the results from building blocks having tape and tape, where a very high bond tape was disposed between the two halves of each building block and a very high bond tape was disposed between faces of adjacent building blocks. Seven voided building blocks were tested. The max force reached was 23 lbs.

These tests show that using tape as the adhesive in the building blocks does not result in a desirable tensile strength for most applications, in contrast to UV glue and epoxy.

Light and Transmission Testing

Light testing was conducted to determine the light transmission signatures of the building blocks, to understand light transmission differences in different orientations of building block aggregations, to understand the difference between light transmission of the building blocks versus traditional architectural applications, and to understand the design opportunities to accentuate circadian entrainment within a built environment. The different aggregation patterns and colored glue joints all augment the light transmission within the architectural space. A light photometer was used at regular distances to gather data on the building blocks as well as other architectural glasses.

Lux is a unit of measurement for illuminance, which is the amount of light that falls on a surface. Lux measures the intensity of light per unit area, typically in units of lumens per square meter ($lm/m^2$). Lux can be used to quantify the brightness or intensity of light, where a higher lux value indicates a brighter light on the surface. % lux is the percentage of light that is transmitted through a material or substance, relative to the amount of light that falls on it. For example, a substance that has a % lux transmitted value of 80% means that 80% of the light that falls on the substance is transmitted through it, while the remaining 20% of the light is either reflected, absorbed, or scattered by the substance. The angle of facets on a surface can affect lux by changing the way that light is reflected or refracted. For example, if a surface has facets or irregularities, the angle of reflection can vary depending on the angle of incidence and the orientation of the facet, meaning a surface with angled facets may reflect light in multiple directions, scattering the light and reducing the intensity of the light on the surface. Furthermore, the angle of facets on a surface can affect the way that light is refracted as it passes through the surface. When light enters a surface with angled facets, the angle at which the light strikes each facet can vary, which can cause the light to be refracted at different angles as it passes through each facet, resulting in a scattering effect that can disperse the light in multiple directions. The angle of facets can also affect the degree of refraction that occurs, where facets at a shallow angle refract light less than facets at a steeper angle. Additionally, a surface with more polished facets (i.e., a smoother and more reflective surface) may reflect light in a more focused direction, directing more light towards a certain area or point, which can result in a higher lux value at that point compared to a surface with angled or irregular facets that scatter the light in multiple directions.

FIGS. 28A-28D show tables showing the lux transmission of building blocks in various aggregation patterns and similar materials. The table in FIG. 28A shows the results from a middle face (i.e., low horizontal) aggregation pattern. The table in FIG. 28B shows the results from a boxed aggregation pattern. The table in FIG. 28C shows the results from a middle face aggregation pattern. The table in FIG. 28D shows the results from a boxed aggregation pattern.

Figure 29A:
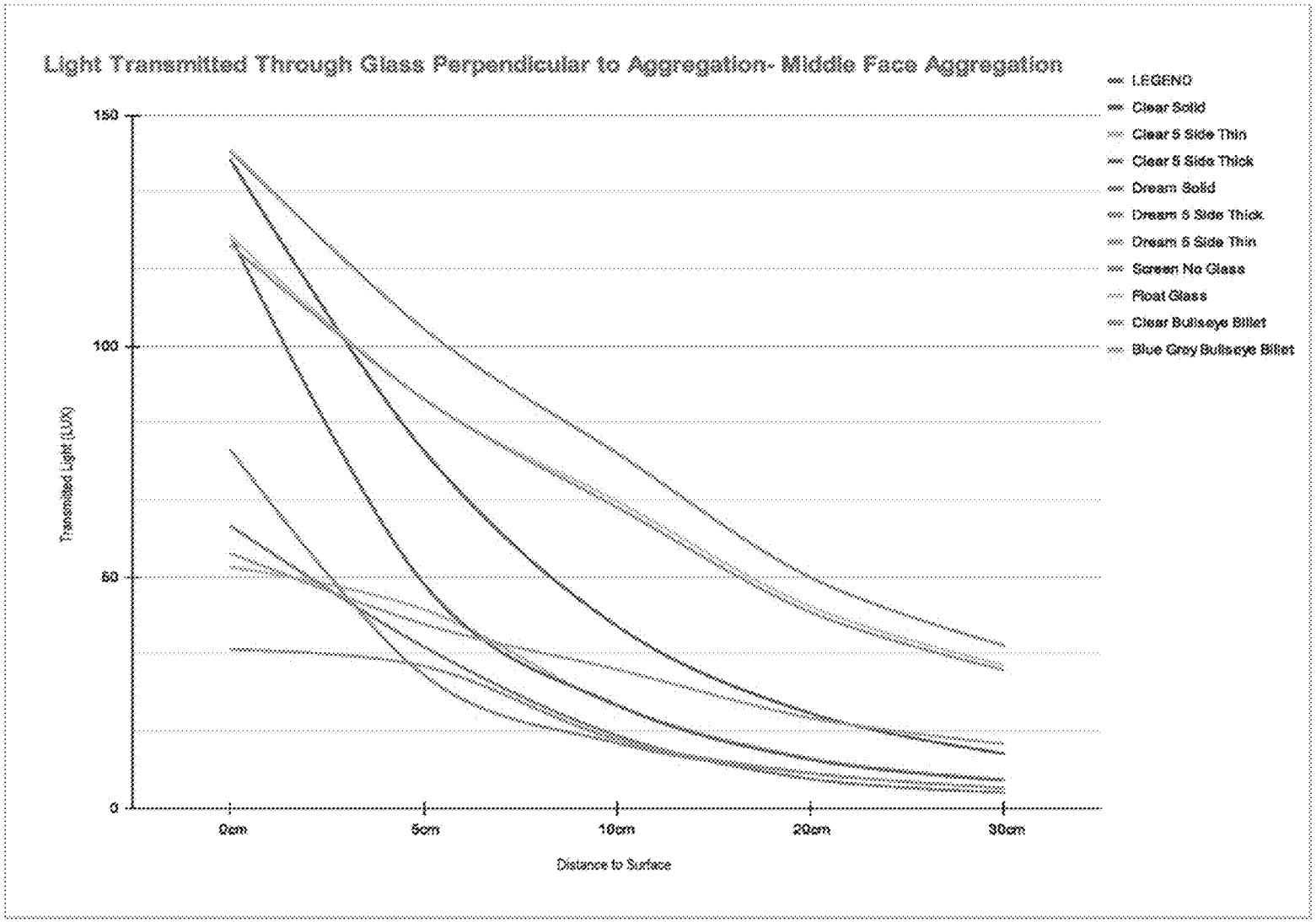
FIGS. 29A-29D: Graphs showing the results of transmission testing for building blocks, "L to aggregation" means perpendicular to aggregation.
Figure 29B:
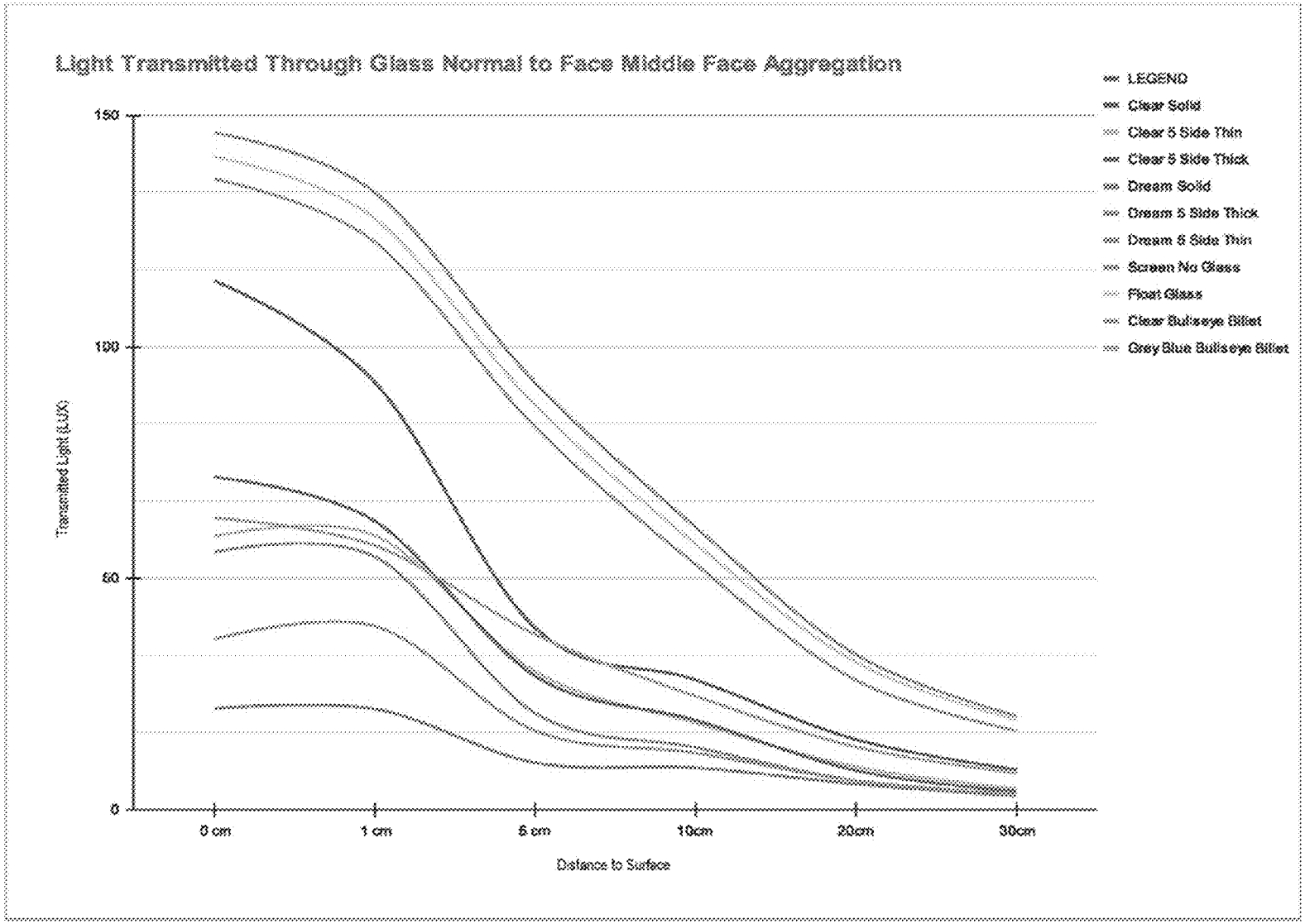
Figure 29C:
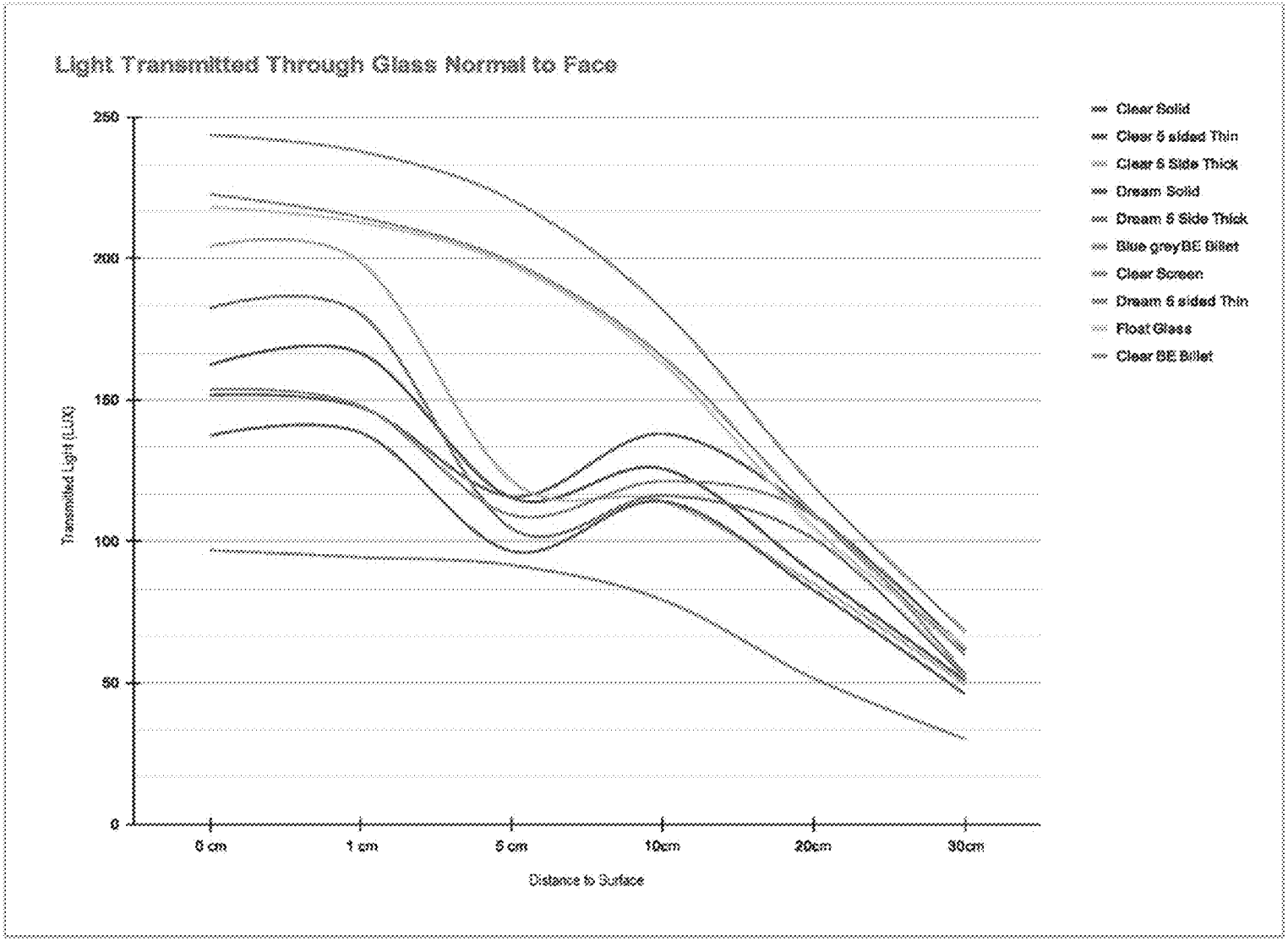
Figure 29D:
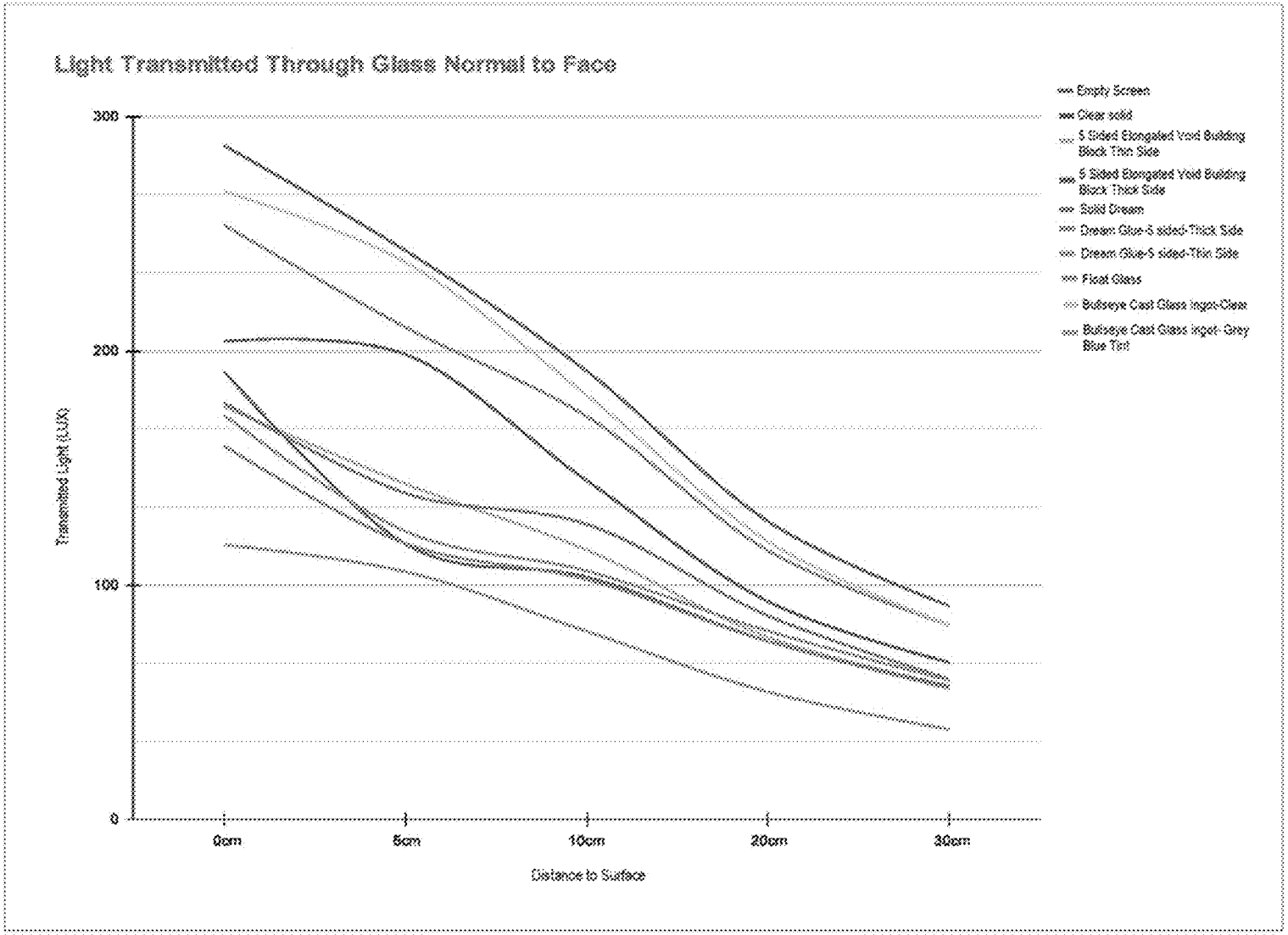

FIGS. 29A-29D show the results of transmission testing. FIG. 29A shows light transmitted through the glass as a function of the distance perpendicular to the aggregation. FIG. 29B shows light transmitted through the glass normal to the face in a middle face aggregation. FIGS. 29C-29D show light transmitted through the glass normal to the face. While entire walls of float glass do provide a higher level of light transmission, the building blocks offer more of a glow than glare and offer light transmission and privacy.

The clear solid building blocks have the highest transmittance (FIG. 29A), and from varying angles the building blocks with the colored glue joint have the lowest light transmittance. The building blocks with voids have varying light transmittance based on the shape of the internal void and the direction the void bends the light.

Based on the results of light transmitted through the glass perpendicular to the aggregation-middle face (i.e., low horizontal) aggregation (FIG. 29A), the building blocks in varying degrees all have a lower light transmission than the float glass, most markedly at the 0 cm-10 cm range, and then begin to follow the curve of the float glass light transmittance at further distances.

The results of light transmitted through the glass normal to individual block face-middle face (i.e., low horizontal) aggregation (FIG. 29B) indicate that transmittance is not as high as a float glass pane for each of the block orientation. These building blocks indicate a strong reduction of transmittance in comparison to float glass around a distance of 5 cm. From the range of 5 cm-10 cm, the strong reduction in transmittance slows, after which the light transmission rate trends converges more closely to that of float glass.

The results of light transmitted through the glass normal to indicial block face-boxed aggregation (FIG. 29C) indicate that transmittance is not as high as a float glass pane for each of the block orientations. The building blocks indicate a strong reduction of transmittance in comparison to float glass around a distance of 5 cm. From the range of 5 cm-10 cm there is a marked increase in transmittance, after which the light transmissions converge more closely to that of float glass.

The results of light transmitted through the glass perpendicular to the aggregation-boxed aggregation (FIG. 29D) indicate that transmittance is not as high as a float glass pane. The building blocks indicate a slight reduction of transmittance in comparison to float glass around a distance of 5 cm. From the range of 5 cm-10 cm the reduction in transmittance slows, after which the light transmission rate trends converges more closely to transmittance pattern of float glass. One exception is the solid clear building block marked in red in FIG. 29D, which does not transmit as much light as the float glass pane, however, holds a constant light transmittance from 0-5 cm and then follows the light transmittance trends closely to the float glass.

Distortion Effect

Figure 30:
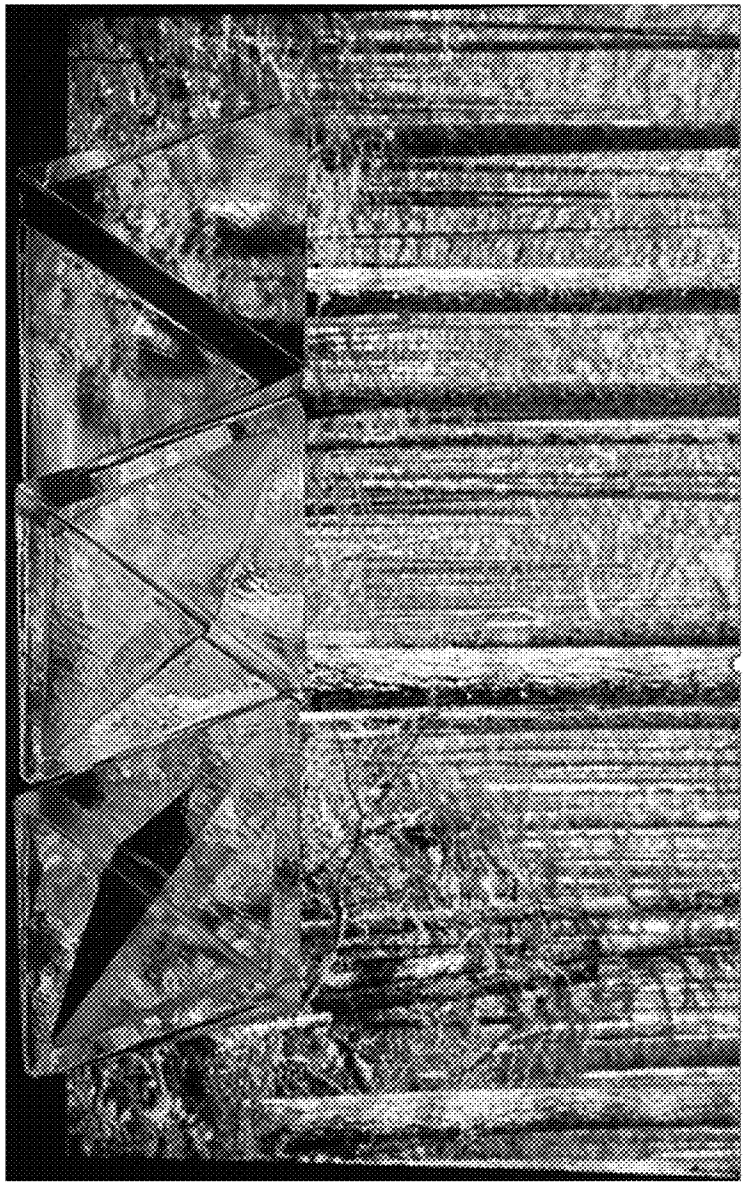
FIG. 30: Photograph showing a distortion effect of seeing imagery outside of a wall structure composed of an aggregation of the building blocks having different void structures.

The building blocks can be used to create distortion effects. FIG. 30 shows a distortion effect of seeing imagery outside of a wall structure composed of an aggregation of the transparent building blocks having different void structures. This effect can be used to provide visual privacy, where natural light is allowed to enter a space in a way that gives an inhabitant of the space a sense of the outside surroundings while still ensuring privacy for the inhabitant.

Certain embodiments of the building blocks, wall structures, building systems, structures, and methods disclosed herein are defined in the above examples. It should be understood that these examples, while indicating particular embodiments of the invention, are given by way of illustration only. From the above discussion and these examples, one skilled in the art can ascertain the essential characteristics of this disclosure, and without departing from the spirit and scope thereof, can make various changes and modifications to adapt the building blocks, wall structures, building systems, structures, and methods described herein to various usages and conditions. Various changes may be made and equivalents may be substituted for elements thereof without departing from the essential scope of the disclosure. In addition, many modifications may be made to adapt a particular situation or material to the teachings of the disclosure without departing from the essential scope thereof.

What is claimed is:

1. A building block for building an architectural structure for an occupant, the building block comprising:

a ten-sided polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face;

wherein a divergence in slope is defined along the plane due to the meeting of the third side face and the fourth side face; and wherein the building block comprises a light transmitting material configured to allow light to enter said architectural structure for said occupant.

2. The building block of claim 1, further comprising an adhesive between the first half and the second half along the plane defined.

3. The building block of claim 2, wherein the adhesive comprises a dye.

4. The building block of claim 2, wherein the adhesive is a UV glue, a silicone, epoxy, or a high bond tape.

5. The building block of claim 1, wherein the building block comprises an internal void and a solid region in one of the first half or the second half.

6. The building block of claim 5, further comprising an adhesive between the first half and the second half along the plane.

7. The building block of claim 6, wherein the adhesive comprises a dye.

8. The building block of claim 1, wherein the building block comprises an internal void and a solid region in each of the first half and the second half.

9. The building block of claim 8, further comprising an adhesive between the first half and the second half along the plane.

10. The building block of claim 9, wherein the adhesive comprises a dye.

11. The building block of claim 1, wherein the light transmitting material is glass.

12. The building block of claim 11, wherein the building block consists essentially of the light transmitting material, an adhesive between the first half and the second half along the plane, and optionally a dye in the adhesive.

13. A wall structure comprising an aggregation of a plurality of the building blocks of claim 1.

14. The wall structure of claim 13, wherein each of the building blocks in the aggregation comprises an adhesive with a dye.

15. The wall structure of claim 13, wherein the wall structure is curved.

16. A wall structure comprising:

an aggregation of a plurality of building blocks, each building block of the plurality of building blocks comprising:

a polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face;

wherein a divergence in slope is defined along the plane due to the meeting of the third side face and the fourth side face;

wherein each building block of the plurality of building blocks comprises a light transmitting material;

wherein the plurality comprises a first building block, a second building block, and a third building block;

wherein the first bottom face of the first building block contacts the second top face of the second building block; and wherein the second bottom face of the first building block contacts the first top face of the third building block.

17. The wall structure of claim 16, wherein the wall structure is tilted or leaning.

18. A wall structure comprising:

an aggregation of a plurality of building blocks, each building block of the plurality of building blocks comprising:

a polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face;

wherein a divergence in slope is defined along the plane due to the meeting of the third side face and the fourth side face;

wherein each building block of the plurality of building blocks comprises a light transmitting material;

wherein the plurality comprises a first building block, a second building block, a third building block, and a fourth building block, each building block of the plurality of building blocks having ten faces, the ten faces including the first top face, the first bottom face, the second top face, the second bottom face, and opposing ninth and tenth faces, wherein each of the ten faces is a quadrilateral;

wherein the ninth face of the first building block contacts the tenth face of the second building block;

wherein the ninth face of the second building block contacts the tenth face of the third building block;

wherein the first bottom face of the first building block contacts the second top face of the fourth building block; and wherein the second side face of the second building block contacts the first top face of the fourth building block.

19. A wall structure comprising:

an aggregation of a plurality of building blocks, each building block of the plurality of building blocks comprising:

a polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face;

wherein a divergence in slope is defined along the plane due to the meeting of the third side face and the fourth side face;

wherein each building block of the plurality of building blocks comprises a light transmitting material;

wherein the plurality comprises a first building block, a second building block, a third building block, and a fourth building block, each building block of the plurality of building blocks having ten faces, the ten faces including the first top face, the first bottom face, the second top face, the second bottom face, and opposing ninth and tenth faces, wherein each of the ten faces is a quadrilateral;

wherein the bottom centerline of the first building block contacts the tenth face of the second building block; and wherein the ninth face of the third building block contacts the top centerline of the fourth building block.

20. A wall structure comprising:

an aggregation of a plurality of building blocks, each building block of the plurality of building blocks comprising:

a polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face;

wherein a divergence in slope is defined along the plane due to the meeting of the third side face and the fourth side face;

wherein each building block of the plurality of building blocks comprises a light transmitting material;

wherein the plurality comprises a first building block, a second building block, a third building block, and a fourth building block, each building block of the plurality of building blocks having ten faces, the ten faces including the first top face, the first bottom face, the second top face, the second bottom face, and opposing ninth and tenth faces, wherein each of the ten faces is a quadrilateral;

wherein the fourth side face of the first building block contacts the first side face of the second building block;

wherein the second side face of the first building block contacts the third side face of the third building block;

wherein the tenth face of the first building block contacts the ninth face of the fourth building block;

wherein the third side face of the fourth building block contacts the second side face of the second building block; and wherein the first side face of the fourth building block contacts the fourth side face of the third building block.

21. The wall structure of claim 20, wherein the wall structure is tilted or leaning.

22. A wall structure comprising:

an aggregation of a plurality of building blocks, each building block of the plurality of building blocks comprising:

a polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face;

wherein a divergence in slope is defined along the plane due to the meeting of the third side face and the fourth side face;

wherein each building block of the plurality of building blocks comprises a light transmitting material;

wherein the plurality comprises a first building block, a second building block, a third building block, and a fourth building block;

wherein the second bottom face of the first building block contacts the first top face of the second building block;

wherein the second bottom face of the second building block contacts the first top face of the third building block; and wherein the first bottom face of the first building block contacts the first top face of the fourth building block.

23. A wall structure comprising:

an aggregation of a plurality of building blocks, each building block of the plurality of building blocks comprising:

a polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face;

wherein a divergence in slope is defined along the plane due to the meeting of the third side face and the fourth side face;

wherein each building block of the plurality of building blocks comprises a light transmitting material;

wherein the plurality comprises a first building block, a second building block, a third building block, and a fourth building block;

wherein the second side face of the first building block contacts the third side face of the second building block;

wherein a first top corner of the first building block meets a second top corner of the third building block; and wherein a second bottom apex corner of the first building block meets a first bottom apex corner of the fourth building block.

24. A wall structure comprising:

an aggregation of a plurality of building blocks, each building block of the plurality of building blocks comprising:

a polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face;

wherein a divergence in slope is defined along the plane due to the meeting of the third side face and the fourth side face;

wherein each building block of the plurality of building blocks comprises a light transmitting material;

wherein the plurality comprises a first building block, a second building block, a third building block, and a fourth building block;

wherein the first side face of the first building block contacts the fourth side face of the second building block;

wherein a first bottom apex corner of the first building block meets a second bottom apex corner of the third building block; and wherein a first top corner of the first building block meets a second top corner of the fourth building block.

25. A wall structure comprising:

an aggregation of a plurality of building blocks, each building block of the plurality of building blocks comprising:

a polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face;

wherein a divergence in slope is defined along the plane due to the meeting of the third side face and the fourth side face;

wherein each building block of the plurality of building blocks comprises a light transmitting material;

wherein the plurality comprises a first building block, a second building block, and a third building block;

wherein the fourth side face of the first building block contacts the third side face of the second building block; and wherein the first side face of the first building block contacts the third side face of the third building block.

26. A building comprising a built space defined by a plurality of the wall structures of claim 13.

27. A method of constructing a structure for an occupant, the method comprising arranging a plurality of light transmitting building blocks in an aggregation to form a wall structure, where one or more of the building blocks includes an adhesive with a colored dye along a glue joint so as to produce a thin veil of color configured to fade in and out of view depending on an orientation of a viewer relative to the building block; and wherein each light transmitting building block of the plurality of light transmitting building blocks comprises a polygon comprising a first half and a second half, wherein the first half meets the second half at a plane defined by top and bottom centerlines, the first half including a first top face, a first bottom face, a first side face, and a third side face and the second half including a second top face, a second bottom face, a second side face, and a fourth side face, wherein the first side face meets the second side face at the plane, wherein the third side face meets the fourth side face at the plane;

wherein a divergence in slope is defined along the top centerline due to the meeting of the first top face and the second top face;

wherein a divergence in slope is defined along the bottom centerline due to the meeting of the first bottom face and the second bottom face;

wherein a divergence in slope is defined along the plane due to the meeting of the first side face and the second side face; and wherein a divergence in slope is defined along the plane due to the meeting of the third side face and the fourth side face.

28. The method of claim 27, wherein at least one of the plurality of light transmitting building blocks comprises a void therein.

* * * * *